US011849796B2

(12) United States Patent
Tamm

(10) Patent No.: US 11,849,796 B2
(45) **Date of Patent: *Dec. 26, 2023**

(54) FLAT WEFT-KNITTED UPPER FOR SPORTS SHOES

(71) Applicant: adidas AG, Herzogenaurach (DE)

(72) Inventor: Stefan Tamm, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 17 days.

This patent is subject to a terminal disclaimer.

(21) Appl. No.: 17/668,499

(22) Filed: Feb. 10, 2022

(65) Prior Publication Data

US 2022/0330649 A1 Oct. 20, 2022

Related U.S. Application Data

(63) Continuation of application No. 16/575,961, filed on Sep. 19, 2019, now Pat. No. 11,272,754, which is a (Continued)

(30) Foreign Application Priority Data

Oct. 2, 2014 (DE) ..... 102014220087.3

(51) Int. Cl.
*A43B 1/04* (2022.01)
*A43B 3/02* (2006.01)
(Continued)

(52) U.S. Cl.
CPC ..... *A43B 1/04* (2013.01); *A43B 3/0036* (2013.01); *A43B 3/02* (2013.01); *A43B 5/00* (2013.01);
(Continued)

(58) Field of Classification Search
CPC .... A43B 1/04; A43B 3/02; A43B 5/02; A43B 23/0205
(Continued)

(56) References Cited

U.S. PATENT DOCUMENTS 74,962 A 2/1868 Wesson
275,142 A 4/1883 Carter
(Continued)

FOREIGN PATENT DOCUMENTS

AT 386324 8/1988
CA 989720 5/1976
(Continued)

OTHER PUBLICATIONS

Page 1 of Lyden Letter dated Apr. 21, 2010, redacted.
(Continued)

*Primary Examiner* — Sharon M Prange
(74) *Attorney, Agent, or Firm* — Kilpatrick Townsend & Stockton LLP

(57) ABSTRACT

Described are uppers for a sports shoe with flat weft-knitted knitwear. The flat weft-knitted knitwear forms a top portion and a bottom portion of the upper. The top portion is formed as tube weft-knitted knitwear such that it is configured to surround a part of a shank of a wearer of the sports shoe when worn. The bottom portion is configured to cover at least a part of a foot of the wearer of the sports shoe when worn.

20 Claims, 15 Drawing Sheets

Related U.S. Application Data continuation of application No. 14/873,605, filed on Oct. 2, 2015, now Pat. No. 10,455,885.

(51) Int. Cl.

| | |
|---|---|
| ***A43B 5/02*** | (2006.01) |
| ***A43B 23/02*** | (2006.01) |
| ***A43B 3/00*** | (2022.01) |
| ***A43B 5/00*** | (2022.01) |
| ***D04B 1/22*** | (2006.01) |

(52) U.S. Cl.

CPC ..... *A43B 5/02* (2013.01); *A43B 23/0205* (2013.01); *A43B 23/0245* (2013.01); *D04B 1/22* (2013.01); *D10B 2501/043* (2013.01); *D10B 2501/061* (2013.01)

(58) Field of Classification Search

USPC ..... 36/109

See application file for complete search history.

(56) References Cited

U.S. PATENT DOCUMENTS 299,934 A 3/1884 Muller
467,091 A 1/1892 Gernshym
578,153 A 3/1897 Lamb
601,192 A 3/1898 Woodside
601,894 A 4/1898 Lamb
D31,023 S 6/1899 Olmsted
757,424 A 4/1904 Vohl
872,163 A 11/1907 Williams
951,033 A 3/1910 Steber
1,215,198 A 2/1917 Rothstein
1,346,516 A 7/1920 Godfrey
1,370,799 A 3/1921 Egerton
1,413,314 A 4/1922 Bosworth
1,413,537 A 4/1922 Jones
1,538,263 A 5/1925 Ackerman
1,597,934 A 8/1926 Stimpson
1,811,803 A 6/1931 Oakley
1,841,518 A 1/1932 Bellak
1,869,386 A 8/1932 Marzak
1,888,172 A 11/1932 Joha
1,902,780 A 3/1933 Holden et al.
RE18,804 E 4/1933 Joha
1,910,251 A 5/1933 Joha
1,972,609 A 9/1934 Arsdale et al.
2,001,293 A 5/1935 Wilson
2,018,275 A 10/1935 Jack
2,024,180 A 12/1935 Parlante
2,038,844 A 4/1936 Dorf
2,042,146 A 5/1936 Deakin
2,047,724 A 7/1936 Zuckerman
2,048,294 A 7/1936 Roberts
2,069,083 A 1/1937 Percy
2,076,285 A 4/1937 Wiggin
2,126,186 A 8/1938 Friedland
2,147,197 A 2/1939 Glidden
2,150,730 A 3/1939 Schuessler
2,165,092 A 7/1939 Daniels
2,171,654 A 9/1939 Ralph et al.
2,178,941 A 11/1939 Schuessler
2,257,390 A 9/1941 Roy
2,276,920 A 3/1942 Charles et al.
2,292,455 A 8/1942 Hollier et al.
2,297,028 A 9/1942 Sheeler
2,302,167 A 11/1942 Austin
2,314,098 A 3/1943 Raymond
2,319,141 A 5/1943 Kuehnel
2,330,199 A 9/1943 Basch
2,343,390 A 3/1944 Ushakoff
2,364,134 A 12/1944 Dow et al.
2,371,689 A 3/1945 Gregg et al.
2,391,564 A 12/1945 Gregg
2,391,594 A 12/1945 Gaetano
2,400,487 A 5/1946 Clark
2,400,692 A 5/1946 Herbert
2,424,957 A 7/1947 Schletter
2,440,393 A 4/1948 Clark
2,460,674 A 2/1949 Lajos
2,464,301 A 3/1949 Francis
2,467,237 A 4/1949 Sherman et al.
2,467,821 A 4/1949 Gregg
2,516,697 A 7/1950 Haddad
2,538,673 A 1/1951 Ansley
2,569,764 A 10/1951 Jonas
2,584,084 A 1/1952 Rubico
2,586,045 A 2/1952 Hoza
2,603,891 A 7/1952 Gustav
2,608,078 A 8/1952 Anderson
2,623,373 A 12/1952 Vogel
2,641,004 A 6/1953 Whiting et al.
2,675,631 A 4/1954 Doughty
2,679,117 A 5/1954 Reed
2,701,458 A 2/1955 Ducharme
2,712,744 A 7/1955 Miller et al.
2,714,813 A 8/1955 Roscoe
2,783,631 A 3/1957 Sumner
2,811,029 A 10/1957 Conner
2,848,885 A 8/1958 Goodman
2,898,754 A 8/1959 Harms
2,934,839 A * 5/1960 Servin ..... A43B 1/04 36/9 R
2,948,132 A 8/1960 Gift
2,966,785 A 1/1961 Goff et al.
2,983,128 A 5/1961 Goff et al.
2,994,322 A 8/1961 Cullen et al.
3,004,354 A * 10/1961 Kramer ..... A43B 1/04 36/9 R
3,013,564 A 12/1961 Harold
3,015,943 A 1/1962 Guy
3,035,291 A 5/1962 Bingham, Jr.
3,063,074 A 11/1962 Scholl
3,070,909 A 1/1963 Hermann et al.
3,078,699 A 2/1963 Huntley
3,093,916 A 6/1963 Hiestand et al.
3,138,880 A 6/1964 Kunzli
3,159,988 A 12/1964 Reymes
3,217,336 A 11/1965 Joseph
3,228,819 A 1/1966 Bingham, Jr.
3,252,484 A 5/1966 Meyer et al.
3,298,204 A 1/1967 Hoffecker
3,310,889 A 3/1967 Samuels
3,324,220 A 6/1967 Stansfield
3,370,363 A 2/1968 Kaplan
3,416,174 A 12/1968 Novitske
3,425,246 A 2/1969 Knohl
3,463,692 A 8/1969 Brunner
3,550,402 A 12/1970 Colton
3,567,567 A 3/1971 Sherrill
3,583,081 A 6/1971 Hayashi
3,616,149 A 10/1971 Wincklhofer et al.
3,620,892 A 11/1971 Wincklhofer et al.
3,635,051 A 1/1972 Betts et al.
3,656,323 A 4/1972 Brown
3,694,940 A 10/1972 Stohr
3,695,063 A 10/1972 Betts et al.
3,704,474 A 12/1972 Winkler
3,766,566 A 10/1973 Tadokoro et al.
3,769,723 A 11/1973 Masterson et al.
3,778,856 A 12/1973 Christie et al.
3,785,173 A 1/1974 Hanney et al.
3,816,211 A 6/1974 Haigh
3,838,583 A 10/1974 Rumi et al.
3,863,272 A 2/1975 Guille
3,867,248 A 2/1975 Bauer
3,884,052 A 5/1975 Findlay et al.
3,952,358 A 4/1976 Fukuoka
3,952,427 A 4/1976 von den Benken et al.
3,967,390 A 7/1976 Anfruns
3,971,234 A 7/1976 Taylor
3,972,086 A 8/1976 Belli et al.
3,985,003 A 10/1976 Reed

(56) References Cited

U.S. PATENT DOCUMENTS 3,985,004 A 10/1976 Johnson et al.
4,027,402 A 6/1977 Liu et al.
4,028,910 A 6/1977 Wignall et al.
4,031,586 A 6/1977 von den Benken et al.
4,034,431 A 7/1977 Fukuoka
4,038,699 A 8/1977 Burn
4,038,840 A 8/1977 Castello
4,068,395 A 1/1978 Senter
4,075,383 A 2/1978 Anderson et al.
4,111,008 A 9/1978 Robinson et al.
4,120,101 A 10/1978 Drew
4,133,118 A 1/1979 Khalsa et al.
4,144,727 A 3/1979 Duhl et al.
4,183,156 A 1/1980 Rudy et al.
4,211,806 A 7/1980 Civardi et al.
4,219,945 A 9/1980 Rudy et al.
4,232,458 A 11/1980 Bartels
4,233,758 A 11/1980 Auberry
4,255,949 A 3/1981 Thorneburg
4,258,480 A 3/1981 Famolare et al.
4,265,954 A 5/1981 Romanek
4,276,671 A 7/1981 Melton
4,279,049 A 7/1981 Coiquaud
4,282,657 A 8/1981 Antonious
4,306,315 A 12/1981 Castiglia
4,306,929 A 12/1981 Menikheim et al.
4,317,292 A 3/1982 Melton
4,324,752 A 4/1982 Newton et al.
4,354,318 A 10/1982 Frederick et al.
4,356,643 A 11/1982 Kester et al.
4,373,361 A 2/1983 Thorneburg
4,430,811 A 2/1984 Okada
4,447,967 A 5/1984 Zaino
4,465,448 A 8/1984 Aldridge et al.
4,467,626 A 8/1984 Coble et al.
4,517,910 A 5/1985 Jalowsky
4,523,346 A 6/1985 Auberry et al.
4,531,525 A 7/1985 Richards
4,592,154 A 6/1986 Oatman
4,607,439 A 8/1986 Harada
4,610,685 A 9/1986 Raley
4,624,115 A 11/1986 Safrit et al.
4,642,915 A 2/1987 Pfander
4,651,354 A 3/1987 Petrey
4,658,515 A 4/1987 Oatman
4,663,946 A 5/1987 Wright
4,669,126 A 6/1987 Jones
4,682,479 A 7/1987 Pernick
4,722,202 A 2/1988 Imboden
4,729,179 A 3/1988 Quist, Jr.
4,737,396 A 4/1988 Kamat et al.
4,750,339 A 6/1988 Simpson, Jr. et al.
4,756,098 A 7/1988 Boggia
4,783,355 A 11/1988 Mueller
4,785,558 A 11/1988 Shiomura
4,788,922 A 12/1988 Clarius
4,813,158 A 3/1989 Brown
4,813,161 A 3/1989 Lesley
4,843,844 A 7/1989 Hursh et al.
4,852,272 A 8/1989 Chilewich et al.
4,899,465 A 2/1990 Bleimhofer et al.
4,941,331 A 7/1990 Cournoyer et al.
4,960,135 A 10/1990 Nelson
5,031,423 A 7/1991 Ikenaga et al.
5,052,130 A 10/1991 Barry et al.
5,095,720 A 3/1992 Tibbals
5,117,567 A 6/1992 Berger et al.
5,125,116 A 6/1992 Gaither et al.
5,152,025 A 10/1992 Hirmas et al.
5,157,791 A 10/1992 Woodson et al.
5,181,278 A 1/1993 Peleg et al.
5,192,601 A 3/1993 Neisler
5,216,827 A 6/1993 Cohen
5,240,773 A 8/1993 Dunn et al.
5,253,434 A 10/1993 Curley, Jr. et al.
5,291,671 A 3/1994 Caberlotto et al.
5,319,807 A 6/1994 Brier
5,323,627 A 6/1994 Lonati et al.
5,335,517 A 8/1994 Throneburg et al.
5,343,639 A 9/1994 Kilgore et al.
5,345,638 A 9/1994 Nishida
5,353,523 A 10/1994 Kilgore et al.
5,353,524 A 10/1994 Brier
5,371,957 A 12/1994 Gaudio et al.
5,373,713 A 12/1994 Miller
5,385,036 A 1/1995 Spillane et al.
5,388,430 A 2/1995 Essig
5,426,869 A 6/1995 Gore et al.
5,461,884 A 10/1995 McCartney et al.
5,479,791 A 1/1996 Osborne
5,484,646 A 1/1996 Mann
5,505,011 A 4/1996 Bleimhofer
5,511,323 A 4/1996 Dahlgren
5,513,450 A 5/1996 Aviles
5,519,894 A 5/1996 Imboden et al.
5,526,584 A 6/1996 Bleimhofer et al.
5,553,468 A 9/1996 Osborne
5,560,227 A 10/1996 Depoe et al.
5,572,860 A 11/1996 Mitsumoto et al.
5,575,090 A 11/1996 Condini
5,581,817 A * 12/1996 Hicks ..... A41B 11/00 2/22
5,592,836 A 1/1997 Schuster et al.
5,605,060 A 2/1997 Osborne
5,606,808 A 3/1997 Gilliard et al.
5,623,734 A 4/1997 Pugliatti
5,623,840 A 4/1997 Roell
5,708,985 A 1/1998 Ogden
5,709,107 A 1/1998 Jeffcoat
5,711,093 A 1/1998 Aumann
5,711,168 A 1/1998 Proctor et al.
5,722,262 A 3/1998 Proctor et al.
5,729,918 A 3/1998 Smets et al.
5,735,145 A 4/1998 Pernick
5,737,857 A 4/1998 Aumann
5,737,943 A 4/1998 Bernhardt
5,746,013 A 5/1998 Fay
5,758,435 A 6/1998 Miyata
5,765,296 A 6/1998 Ludemann et al.
5,774,898 A 7/1998 Malpee
5,784,806 A 7/1998 Wendt
5,787,503 A 8/1998 Murphy
5,791,163 A 8/1998 Throneburg
5,836,179 A 11/1998 Van Laar
5,850,745 A 12/1998 Albright
5,855,123 A 1/1999 Albright
5,884,419 A 3/1999 Davidowitz et al.
5,896,608 A 4/1999 Whatley
5,896,683 A 4/1999 Foxen et al.
5,896,758 A 4/1999 Rock et al.
5,906,007 A 5/1999 Roberts
5,947,845 A 9/1999 Canelas
5,996,189 A 12/1999 Wang et al.
6,021,585 A 2/2000 Cole
6,029,376 A 2/2000 Cass
6,032,387 A 3/2000 Johnson
6,052,921 A 4/2000 Oreck
6,088,936 A 7/2000 Bahl et al.
6,109,068 A 8/2000 Stoll et al.
6,128,835 A 10/2000 Ritter et al.
6,151,802 A 11/2000 Reynolds et al.
6,158,253 A 12/2000 Svoboda et al.
6,170,175 B1 1/2001 Funk et al.
6,173,589 B1 1/2001 Hayes, Jr. et al.
6,192,717 B1 2/2001 Rabinowicz
6,196,030 B1 3/2001 Stoll et al.
6,227,010 B1 5/2001 Roell
6,230,525 B1 5/2001 Dunlap
6,231,946 B1 5/2001 Brown, Jr. et al.
6,250,115 B1 6/2001 Suzuki
6,272,888 B1 8/2001 Fujita et al.
6,286,233 B1 9/2001 Gaither
6,287,168 B1 9/2001 Rabinowicz
6,299,962 B1 10/2001 Davis et al.

(56) References Cited

U.S. PATENT DOCUMENTS 6,301,759 B1 10/2001 Langer et al.
6,308,438 B1 10/2001 Throneburg et al.
6,330,814 B1 12/2001 Fujiwara
6,333,105 B1 12/2001 Tanaka et al.
6,401,364 B1 6/2002 Burt et al.
6,415,632 B1 7/2002 Vesnaver
6,430,844 B1 8/2002 Otis
6,449,878 B1 9/2002 Lyden
6,539,752 B1 4/2003 Apollonio
6,558,784 B1 5/2003 Norton et al.
6,588,237 B2 7/2003 Cole et al.
6,622,312 B2 9/2003 Rabinowicz
6,662,469 B2 12/2003 Belley et al.
6,665,955 B1 12/2003 Mizrahi et al.
6,708,348 B1 3/2004 Romay
6,735,988 B1 5/2004 Honeycutt
6,754,983 B2 6/2004 Hatfield et al.
6,779,369 B2 8/2004 Shepherd
6,871,515 B1 3/2005 Starbuck et al.
6,886,367 B2 5/2005 Mitchell et al.
6,899,591 B2 5/2005 Mitchell
6,910,288 B2 6/2005 Dua
6,922,917 B2 8/2005 Kerns et al.
6,931,762 B1 8/2005 Dua
6,944,975 B2 9/2005 Safdeye et al.
6,984,596 B2 1/2006 Dickerson
6,986,183 B2 1/2006 Delgorgue et al.
6,986,269 B2 1/2006 Dua
D517,297 S 3/2006 Jones et al.
7,016,867 B2 3/2006 Lyden
7,037,571 B2 5/2006 Fish et al.
7,043,942 B2 5/2006 Chapman
7,047,668 B2 5/2006 Burris et al.
7,051,460 B2 5/2006 Orei et al.
7,055,267 B2 6/2006 Wilson et al.
7,056,402 B2 6/2006 Koerwien et al.
7,059,156 B2 6/2006 Takeda et al.
7,081,221 B2 7/2006 Paratore et al.
7,107,235 B2 9/2006 Lyden
7,131,296 B2 11/2006 Dua et al.
7,179,414 B2 2/2007 Safdeye et al.
7,207,125 B2 4/2007 Jeppesen et al.
7,207,196 B2 4/2007 Lonati et al.
7,207,961 B1 4/2007 Benton et al.
7,213,420 B2 5/2007 Lynch et al.
7,240,522 B2 7/2007 Kondou et al.
7,346,935 B1 3/2008 Patterson et al.
7,347,011 B2 3/2008 Dua et al.
7,356,946 B2 4/2008 Hannon et al.
7,441,348 B1 10/2008 Dawson et al.
7,484,318 B2 2/2009 Finkelstein
7,543,397 B2 6/2009 Kilgore et al.
7,568,298 B2 8/2009 Kerns et al.
7,637,032 B2 12/2009 Sokolowski et al.
7,650,705 B2 1/2010 Donnadieu et al.
7,677,061 B2 3/2010 Mori et al.
7,682,219 B2 3/2010 Falla
7,721,575 B2 5/2010 Yokoyama
7,774,956 B2 8/2010 Dua et al.
7,805,859 B2 10/2010 Finkelstein
7,805,860 B2 10/2010 Fliri et al.
7,814,598 B2 10/2010 Dua et al.
7,854,076 B2 12/2010 Keppler et al.
7,882,648 B2 2/2011 Langvin
8,028,440 B2 10/2011 Sokolowski et al.
8,042,288 B2 10/2011 Dua et al.
8,056,149 B2 11/2011 Duclos et al.
8,099,881 B2 1/2012 Yamamoto
8,196,317 B2 6/2012 Dua et al.
8,209,883 B2 7/2012 Lyden
8,215,132 B2 7/2012 Dua et al.
8,225,530 B2 7/2012 Sokolowski et al.
8,266,749 B2 9/2012 Dua et al.
8,296,970 B2 10/2012 Jessiman et al.
D673,765 S 1/2013 Parker et al.
8,448,474 B1 5/2013 Tatler et al.
8,464,383 B2 6/2013 Sing
8,490,299 B2 7/2013 Dua et al.
8,522,577 B2 9/2013 Huffa
8,590,345 B2 11/2013 Sokolowski et al.
8,595,878 B2 12/2013 Farris et al.
8,621,891 B2 1/2014 Shaffer et al.
8,647,460 B1 2/2014 Koo
8,650,916 B2 2/2014 Thomas et al.
8,683,718 B2 4/2014 Fliri et al.
8,701,232 B1 4/2014 Droege et al.
8,745,895 B2 6/2014 Sokolowski et al.
8,745,896 B2 6/2014 Shaffer et al.
8,800,172 B2 8/2014 Dua et al.
8,839,532 B2 9/2014 Shaffer et al.
8,881,430 B2 11/2014 Baines et al.
8,898,932 B2 12/2014 Molyneux et al.
8,899,079 B2 12/2014 Podhajny et al.
8,959,800 B2 2/2015 Sokolowski et al.
8,959,959 B1 2/2015 Podhajny et al.
8,973,410 B1 3/2015 Podhajny et al.
8,978,422 B2 3/2015 Podhajny et al.
8,997,529 B1 4/2015 Podhajny et al.
8,997,530 B1 4/2015 Podhajny
9,003,836 B1 4/2015 Podhajny et al.
9,010,157 B1 4/2015 Podhajny et al.
9,027,260 B2 5/2015 Shaffer et al.
9,032,763 B2 5/2015 Meir et al.
9,060,562 B2 6/2015 Meir et al.
9,072,335 B1 7/2015 Podhajny
9,078,488 B1 7/2015 Podhajny et al.
9,084,449 B2 7/2015 Huffman et al.
9,095,187 B2 8/2015 Molyneux et al.
9,132,601 B2 9/2015 Beye et al.
9,139,938 B2 9/2015 Podhajny et al.
9,145,629 B2 9/2015 Podhajny
9,150,986 B2 10/2015 Shaffer et al.
9,192,204 B1 11/2015 Klug et al.
9,226,540 B2 1/2016 Podhajny et al.
9,297,097 B2 3/2016 Turner
9,301,567 B2 4/2016 Roulo et al.
9,339,076 B2 5/2016 Podhajny et al.
9,353,469 B2 5/2016 Meir et al.
9,357,813 B2 6/2016 Lyden
9,365,959 B2 6/2016 Turner
9,375,046 B2 6/2016 Meir
9,398,784 B2 7/2016 Baudouin et al.
9,498,023 B2 11/2016 Craig
9,723,890 B2 8/2017 Long
9,861,160 B2 * 1/2018 Podhajny ..... A43B 23/042
9,888,742 B2 * 2/2018 Follet ..... A43B 23/042
10,098,412 B2 10/2018 Hoffer et al.
10,455,885 B2 10/2019 Tamm
2001/0016993 A1 8/2001 Cagner
2001/0024709 A1 9/2001 Yoneda et al.
2001/0032399 A1 10/2001 Litchfield et al.
2001/0054240 A1 12/2001 Bordin et al.
2001/0055684 A1 12/2001 Davis et al.
2002/0000002 A1 1/2002 Hatch et al.
2002/0002780 A1 1/2002 Barthelemy et al.
2002/0007570 A1 1/2002 Girard
2002/0012784 A1 1/2002 Norton et al.
2002/0026730 A1 3/2002 Whatley
2002/0035796 A1 3/2002 Knoche et al.
2002/0053148 A1 5/2002 Haimerl
2002/0078599 A1 6/2002 Delgorgue et al.
2002/0092199 A1 7/2002 Fish et al.
2002/0148142 A1 10/2002 Oorei et al.
2002/0148258 A1 10/2002 Cole et al.
2002/0152638 A1 10/2002 Safdeye et al.
2002/0152776 A1 10/2002 Didier
2002/0157281 A1 10/2002 Safdeye et al.
2003/0009908 A1 1/2003 Sheets et al.
2003/0009919 A1 1/2003 Stein
2003/0033837 A1 2/2003 Higgins
2003/0039882 A1 2/2003 Wruck et al.
2003/0051372 A1 3/2003 Lyden
2003/0069807 A1 4/2003 Lyden
2003/0079374 A1 5/2003 Belley et al.

(56) References Cited

U.S. PATENT DOCUMENTS

2003/0097766 A1 5/2003 Morgan
2003/0106171 A1 6/2003 Issler
2003/0121179 A1 7/2003 Chen
2003/0126762 A1 7/2003 Tseng
2003/0131499 A1 7/2003 Silverman
2003/0191427 A1 10/2003 Jay et al.
2003/0192351 A1 10/2003 Meckley et al.
2003/0226280 A1 12/2003 Paratore et al.
2003/0227105 A1 12/2003 Paratore et al.
2004/0009731 A1 1/2004 Rabinowicz
2004/0043237 A1 3/2004 Geisler
2004/0045196 A1 3/2004 Shepherd
2004/0045955 A1 3/2004 Rock et al.
2004/0083622 A1 5/2004 Mizrahi et al.
2004/0107603 A1 6/2004 Wei
2004/0111920 A1 6/2004 Cretinon
2004/0111921 A1 6/2004 Lenormand
2004/0118018 A1 6/2004 Dua
2004/0139628 A1 7/2004 Wiener
2004/0139629 A1 7/2004 Wiener
2004/0143995 A1 7/2004 McClelland
2004/0163280 A1 8/2004 Morris et al.
2004/0168479 A1 9/2004 Mcmurray
2004/0181972 A1 9/2004 Csorba
2004/0198178 A1 10/2004 Mitchell et al.
2004/0205982 A1 10/2004 Challe
2004/0216332 A1 11/2004 Wilson et al.
2004/0226113 A1 11/2004 Wright et al.
2004/0237599 A1 12/2004 Kondou et al.
2004/0255486 A1 12/2004 Pawlus et al.
2004/0261467 A1 12/2004 Chapman
2005/0016023 A1 1/2005 Burris
2005/0028405 A1 2/2005 Wilson et al.
2005/0055843 A1 3/2005 Morlacchi
2005/0081402 A1 4/2005 Orei et al.
2005/0091725 A1 5/2005 Alley et al.
2005/0102863 A1 5/2005 Hannon et al.
2005/0108898 A1 5/2005 Jeppesen et al.
2005/0115274 A1 6/2005 Douglas
2005/0115281 A1 6/2005 Mitchell et al.
2005/0115282 A1 6/2005 Starbuck
2005/0115284 A1 6/2005 Dua
2005/0127057 A1 6/2005 Rock et al.
2005/0132614 A1 6/2005 Brennan
2005/0138845 A1 6/2005 Haimerl
2005/0155137 A1 7/2005 Berger
2005/0160626 A1 7/2005 Townsend
2005/0166426 A1 8/2005 Donnadieu et al.
2005/0166427 A1 8/2005 Greene et al.
2005/0193592 A1 9/2005 Dua et al.
2005/0208857 A1 9/2005 Baron et al.
2005/0268497 A1 12/2005 Alfaro et al.
2005/0273988 A1 12/2005 Christy et al.
2005/0284000 A1 12/2005 Kerns
2006/0006168 A1 1/2006 Rock et al.
2006/0010717 A1 1/2006 Finkelstein
2006/0016099 A1 1/2006 Marco et al.
2006/0021258 A1 2/2006 Beck
2006/0048413 A1 3/2006 Sokolowski et al.
2006/0059715 A1 3/2006 Aveni
2006/0059716 A1 3/2006 Yamashita et al.
2006/0117607 A1 6/2006 Pare et al.
2006/0130359 A1 6/2006 Dua et al.
2006/0162187 A1 7/2006 Byrnes et al.
2006/0174520 A1 8/2006 Wu
2006/0179549 A1 8/2006 Huggins et al.
2006/0243000 A1 11/2006 Turlan et al.
2007/0000027 A1 1/2007 Ganzoni et al.
2007/0003728 A1 1/2007 Hannon et al.
2007/0022627 A1 2/2007 Sokolowski et al.
2007/0074334 A1 4/2007 Steel et al.
2007/0144039 A1 6/2007 Fliri
2007/0180730 A1 8/2007 Greene et al.
2007/0197944 A1 8/2007 Bruce et al.
2007/0234593 A1 10/2007 Beck
2007/0271817 A1 11/2007 Ellis, III
2007/0283483 A1 12/2007 Jacober et al.
2008/0000108 A1 1/2008 Ellis, III
2008/0010860 A1 1/2008 Gyr
2008/0017294 A1 1/2008 Bailey et al.
2008/0032580 A1 2/2008 Fukuoka et al.
2008/0066499 A1 3/2008 Andrieu et al.
2008/0078102 A1 4/2008 Kilgore et al.
2008/0110048 A1 5/2008 Dua et al.
2008/0110049 A1 5/2008 Sokolowski et al.
2008/0155731 A1 7/2008 Kasahara
2008/0189830 A1 8/2008 Egglesfield et al.
2008/0196181 A1 8/2008 Dua et al.
2008/0235877 A1 10/2008 Murray et al.
2008/0250668 A1 10/2008 Marvin et al.
2008/0263893 A1 10/2008 Hernandez et al.
2008/0295230 A1 12/2008 Wright et al.
2008/0313939 A1 12/2008 Ardill et al.
2009/0049870 A1 2/2009 Garus
2009/0068908 A1 3/2009 Hinchcliff et al.
2009/0071036 A1 3/2009 Hooper et al.
2009/0107012 A1 4/2009 Cheney et al.
2009/0126225 A1 5/2009 Jarvis
2009/0126229 A1 5/2009 Fuerst et al.
2009/0134145 A1 5/2009 Rock et al.
2009/0172971 A1 7/2009 Peikert et al.
2009/0241374 A1 10/2009 Sato et al.
2009/0297794 A1 12/2009 Lin
2009/0300823 A1 12/2009 Connaghan et al.
2010/0018075 A1 1/2010 Meschter et al.
2010/0037483 A1 2/2010 Meschter et al.
2010/0043253 A1 2/2010 Dojan et al.
2010/0051132 A1 3/2010 Glenn et al.
2010/0064453 A1 3/2010 Haimerl
2010/0095550 A1 4/2010 Sokolowski et al.
2010/0107346 A1 5/2010 Aveni
2010/0107443 A1 5/2010 Aveni et al.
2010/0122475 A1 5/2010 Purrington et al.
2010/0154256 A1 6/2010 Dua
2010/0162590 A1 7/2010 Bonigk
2010/0170651 A1 7/2010 Scherb et al.
2010/0175276 A1 7/2010 Dojan et al.
2010/0229429 A1 9/2010 Longuet
2010/0269372 A1 10/2010 Dua et al.
2010/0299962 A1 12/2010 Fliri
2010/0325916 A1 12/2010 Dua et al.
2011/0005105 A1 1/2011 Hong
2011/0030244 A1 2/2011 Motawi et al.
2011/0061149 A1 3/2011 Polacco et al.
2011/0061265 A1 3/2011 Lyden
2011/0061842 A1 3/2011 Li et al.
2011/0078921 A1 4/2011 Greene et al.
2011/0088282 A1 4/2011 Dojan et al.
2011/0099845 A1 5/2011 Miller
2011/0113648 A1 5/2011 Leick et al.
2011/0154689 A1 6/2011 Chung
2011/0154693 A1 6/2011 Oberschneider
2011/0179677 A1 7/2011 Jessiman
2011/0219643 A1 9/2011 Tai
2011/0283567 A1 11/2011 Yin
2011/0302699 A1 12/2011 Kaneda et al.
2011/0302727 A1 12/2011 Sokolowski et al.
2011/0302810 A1 12/2011 Borel et al.
2011/0308108 A1 12/2011 Berns et al.
2011/0308110 A1 12/2011 Berns et al.
2012/0000252 A1 1/2012 Funaki et al.
2012/0005922 A1 1/2012 Dua et al.
2012/0011744 A1 1/2012 Bell et al.
2012/0023686 A1 2/2012 Huffa et al.
2012/0023778 A1 2/2012 Dojan et al.
2012/0055044 A1 3/2012 Dojan et al.
2012/0090077 A1 4/2012 Brown et al.
2012/0114883 A1 5/2012 Kapur et al.
2012/0144698 A1 6/2012 McDowell
2012/0144699 A1 6/2012 Eggert et al.
2012/0159813 A1 6/2012 Dua et al.
2012/0180195 A1 7/2012 Shull et al.
2012/0198730 A1 8/2012 Burch et al.
2012/0204448 A1 8/2012 Bracken

(56) References Cited

U.S. PATENT DOCUMENTS

2012/0216423 A1 8/2012 Lyden
2012/0216430 A1 8/2012 Stohr
2012/0233878 A1 9/2012 Hazenberg et al.
2012/0233879 A1 9/2012 Dojan et al.
2012/0233880 A1 9/2012 Chao et al.
2012/0233882 A1 9/2012 Huffa et al.
2012/0233883 A1 9/2012 Spencer et al.
2012/0233884 A1 9/2012 Greene
2012/0233885 A1 9/2012 Shaffer et al.
2012/0233886 A1 9/2012 Madore et al.
2012/0233887 A1 9/2012 Baker et al.
2012/0233888 A1 9/2012 Baker et al.
2012/0234051 A1 9/2012 Huffa
2012/0234052 A1 9/2012 Huffa et al.
2012/0234111 A1 9/2012 Molyneux et al.
2012/0234467 A1 9/2012 Rapaport et al.
2012/0235322 A1 9/2012 Greene et al.
2012/0238376 A1 9/2012 Knight et al.
2012/0238910 A1 9/2012 Nordstrom
2012/0240429 A1 9/2012 Sokolowski et al.
2012/0246973 A1 10/2012 Dua
2012/0255201 A1 10/2012 Little
2012/0272548 A1 11/2012 Downard et al.
2012/0279260 A1 11/2012 Dua et al.
2012/0285039 A1 11/2012 Lazaris et al.
2012/0285043 A1 11/2012 Dua et al.
2012/0297557 A1 11/2012 Koo et al.
2012/0297642 A1 11/2012 Schaefer et al.
2012/0297643 A1 11/2012 Shaffer et al.
2012/0297645 A1 11/2012 Berbert et al.
2012/0318026 A1 12/2012 Dua et al.
2013/0000011 A1 1/2013 Vaglio Tessitore
2013/0025157 A1 1/2013 Wan et al.
2013/0031801 A1 2/2013 Hatfield et al.
2013/0036629 A1 2/2013 Bramani et al.
2013/0047471 A1 2/2013 Liang
2013/0055590 A1 3/2013 Mokos
2013/0061405 A1 3/2013 Haimerl
2013/0074364 A1 3/2013 Lim
2013/0091741 A1 4/2013 Frank
2013/0104426 A1 5/2013 Bell
2013/0118031 A1 5/2013 Chenciner et al.
2013/0139407 A1 6/2013 Brongers et al.
2013/0145652 A1 6/2013 Podhajny et al.
2013/0152424 A1 6/2013 Dojan
2013/0160323 A1 6/2013 Hsiao
2013/0174449 A1 7/2013 Koyess et al.
2013/0219749 A1 8/2013 Dojan et al.
2013/0232820 A1 9/2013 Bramani et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0263468 A1 10/2013 Ciccarelli
2013/0269209 A1 10/2013 Lang
2013/0312284 A1 11/2013 Berend et al.
2013/0318837 A1 12/2013 Dua et al.
2014/0020923 A1 1/2014 Su
2014/0068968 A1 3/2014 Podhajny et al.
2014/0082965 A1 3/2014 Greene et al.
2014/0101824 A1 4/2014 Spanks et al.
2014/0123409 A1 5/2014 Huffa et al.
2014/0130373 A1 5/2014 Baines et al.
2014/0130374 A1 5/2014 Minami et al.
2014/0130375 A1 5/2014 Baines et al.
2014/0130376 A1 5/2014 Fahmi et al.
2014/0137433 A1* 5/2014 Craig ..... A43B 5/06 66/170
2014/0137434 A1* 5/2014 Craig ..... A43B 23/0215 66/170
2014/0144190 A1 5/2014 Tatler et al.
2014/0150292 A1 6/2014 Podhajny et al.
2014/0150295 A1 6/2014 Dua et al.
2014/0150296 A1 6/2014 Dua et al.
2014/0157831 A1 6/2014 Huffa et al.
2014/0173934 A1 6/2014 Bell
2014/0196314 A1 7/2014 Beye et al.
2014/0209233 A1 7/2014 Dua et al.
2014/0223777 A1 8/2014 Whiteman et al.
2014/0237855 A1 8/2014 Podhajny et al.
2014/0237856 A1 8/2014 Podhajny et al.
2014/0238082 A1 8/2014 Meir et al.
2014/0238083 A1 8/2014 Meir et al.
2014/0245544 A1 9/2014 Huffa et al.
2014/0245546 A1 9/2014 Huffa et al.
2014/0245547 A1 9/2014 Baudouin et al.
2014/0245633 A1 9/2014 Podhajny et al.
2014/0245634 A1 9/2014 Podhajny et al.
2014/0245636 A1 9/2014 Seamarks et al.
2014/0245637 A1 9/2014 Fahmi et al.
2014/0245639 A1 9/2014 Dua et al.
2014/0245643 A1 9/2014 Huffa et al.
2014/0259760 A1 9/2014 Dojan et al.
2014/0310983 A1 10/2014 Tamm et al.
2014/0310984 A1 10/2014 Tamm et al.
2014/0310985 A1 10/2014 Tran et al.
2014/0310986 A1 10/2014 Tamm et al.
2014/0338226 A1 11/2014 Zavala
2014/0345158 A1 11/2014 Fox
2014/0352082 A1 12/2014 Shaffer et al.
2014/0352173 A1 12/2014 Bell et al.
2014/0360048 A1 12/2014 Dehaven et al.
2015/0013080 A1 1/2015 Thomas et al.
2015/0013188 A1 1/2015 Baines et al.
2015/0013394 A1 1/2015 Huffa
2015/0013395 A1 1/2015 Huffa
2015/0033585 A1* 2/2015 Otus ..... A43B 5/025 36/109
2015/0040431 A1 2/2015 Molyneux
2015/0047225 A1 2/2015 Dealey et al.
2015/0059209 A1* 3/2015 Dekovic ..... D04B 1/104 36/84
2015/0059211 A1 3/2015 Podhajny et al.
2015/0075031 A1 3/2015 Podhajny et al.
2015/0101212 A1 4/2015 Dekovic et al.
2015/0107307 A1 4/2015 Kosui et al.
2015/0143716 A1 5/2015 Savage et al.
2015/0143720 A1 5/2015 Avar et al.
2015/0216254 A1 8/2015 Podhajny et al.
2015/0216255 A1 8/2015 Podhajny
2015/0216257 A1 8/2015 Meir et al.
2015/0223552 A1* 8/2015 Love ..... A43C 15/02 12/142 P
2015/0250256 A1 9/2015 Podhajny et al.
2015/0264995 A1 9/2015 Hilderbrand, IV
2015/0272261 A1 10/2015 Huffman et al.
2015/0342285 A1 12/2015 Bell et al.
2015/0359290 A1 12/2015 Podhajny et al.
2015/0366293 A1 12/2015 Clarkson et al.
2016/0029736 A1 2/2016 Meir
2016/0088894 A1 3/2016 Podhajny et al.
2016/0088899 A1 3/2016 Klug et al.
2016/0090670 A1 3/2016 Meir
2016/0095377 A1* 4/2016 Tamm ..... D04B 1/22 66/170
2016/0166010 A1 6/2016 Bruce et al.
2016/0198797 A1* 7/2016 Ikenaka ..... A43B 23/0245 12/142 G
2016/0206039 A1 7/2016 Cross et al.
2016/0206040 A1 7/2016 Cross et al.
2016/0206042 A1 7/2016 Cross et al.
2016/0206046 A1 7/2016 Cross
2016/0295971 A1 10/2016 Arnese et al.
2017/0156434 A1 6/2017 Tamm et al.
2017/0258169 A1* 9/2017 Zavala ..... D04B 1/106
2017/0311650 A1 11/2017 Hupperets et al.
2018/0064201 A1 3/2018 Tran et al.
2018/0092432 A1 4/2018 Hoffer et al.

FOREIGN PATENT DOCUMENTS

CA 2387640 4/2003
CN 2044806 9/1989

(56) References Cited

FOREIGN PATENT DOCUMENTS

| | | |
|---|---|---|
| CN | 1067566 | 1/1993 |
| CN | 2187379 | 1/1995 |
| CN | 2438730 | 7/2001 |
| CN | 1392833 | 1/2003 |
| CN | 1411762 | 4/2003 |
| CN | 1429512 | 7/2003 |
| CN | 1155597 | 6/2004 |
| CN | 1960650 | 5/2007 |
| CN | 101316526 | 12/2008 |
| CN | 201356120 | 12/2009 |
| CN | 102939023 | 2/2013 |
| CN | 104413996 | 3/2015 |
| DE | 71153 | 4/1893 |
| DE | 627878 | 7/1936 |
| DE | 870963 | 3/1953 |
| DE | 1736512 | 12/1956 |
| DE | 1785183 | 3/1959 |
| DE | 1084173 | 6/1960 |
| DE | 1910713 | 7/1970 |
| DE | 1785183 | 11/1971 |
| DE | 2044031 | 3/1972 |
| DE | 1685690 | 1/1973 |
| DE | 2162456 | 6/1973 |
| DE | 2305693 | 8/1973 |
| DE | 2505537 | 8/1976 |
| DE | 2801984 | 7/1979 |
| DE | 3820094 | 12/1989 |
| DE | 4400739 | 7/1995 |
| DE | 68922952 | 11/1995 |
| DE | 4419802 | 12/1995 |
| DE | 4419803 | 12/1995 |
| DE | 4441555 | 6/1996 |
| DE | 19629317 | 10/1997 |
| DE | 19738433 | 4/1998 |
| DE | 19728848 | 1/1999 |
| DE | 4443002 | 2/1999 |
| DE | 19855542 | 6/2000 |
| DE | 19910785 | 9/2000 |
| DE | 10022254 | 11/2001 |
| DE | 10037728 | 2/2002 |
| DE | 10145073 | 4/2003 |
| DE | 10228143 | 11/2003 |
| DE | 3903242 | 7/2004 |
| DE | 4138836 | 7/2004 |
| DE | 19910785 | 12/2004 |
| DE | 602004000536 | 12/2006 |
| DE | 102005030651 | 1/2007 |
| DE | 10316979 | 2/2007 |
| DE | 60031821 | 9/2007 |
| DE | 102006009974 | 9/2007 |
| DE | 102006022494 | 11/2007 |
| DE | 202007011165 | 1/2008 |
| DE | 202009010225 | 2/2010 |
| DE | 202009011928 | 2/2010 |
| DE | 102009018942 | 11/2010 |
| DE | 102009028627 | 3/2011 |
| DE | 102010037585 | 3/2012 |
| DE | 102011055154 | 5/2012 |
| DE | 202012100938 | 5/2012 |
| DE | 202007019490 | 1/2013 |
| DE | 202009018763 | 4/2013 |
| DE | 202009018765 | 4/2013 |
| DE | 102012206062 | 10/2013 |
| DE | 202012013113 | 11/2014 |
| DE | 202012013114 | 11/2014 |
| DE | 202012013118 | 11/2014 |
| DE | 202012013119 | 11/2014 |
| DE | 202012013120 | 11/2014 |
| EP | 0037629 | 10/1981 |
| EP | 45372 | 2/1982 |
| EP | 0105773 | 4/1984 |
| EP | 279950 | 8/1988 |
| EP | 0384059 | 8/1990 |
| EP | 446583 | 9/1991 |
| EP | 0472743 | 3/1992 |
| EP | 499710 | 8/1992 |
| EP | 508712 | 10/1992 |
| EP | 0664092 | 7/1995 |
| EP | 448714 | 7/1996 |
| EP | 728860 | 8/1996 |
| EP | 0733732 | 9/1996 |
| EP | 758693 | 2/1997 |
| EP | 845553 | 6/1998 |
| EP | 864681 | 9/1998 |
| EP | 898002 | 2/1999 |
| EP | 0959704 | 12/1999 |
| EP | 1004829 | 5/2000 |
| EP | 1031656 | 8/2000 |
| EP | 1091033 | 4/2001 |
| EP | 0758693 | 10/2001 |
| EP | 0833000 | 3/2002 |
| EP | 1219191 | 7/2002 |
| EP | 1233091 | 8/2002 |
| EP | 1273693 | 1/2003 |
| EP | 1275761 | 1/2003 |
| EP | 1437057 | 7/2004 |
| EP | 1148161 | 4/2005 |
| EP | 1563752 | 8/2005 |
| EP | 1602762 | 12/2005 |
| EP | 1352118 | 10/2006 |
| EP | 1972706 | 9/2008 |
| EP | 2023762 | 2/2009 |
| EP | 2079336 | 7/2009 |
| EP | 2088887 | 8/2009 |
| EP | 1571938 | 11/2009 |
| EP | 2248434 | 11/2010 |
| EP | 2378910 | 10/2011 |
| EP | 1919321 | 8/2012 |
| EP | 2485619 | 8/2012 |
| EP | 2520188 | 11/2012 |
| EP | 1571938 | 5/2013 |
| EP | 2088887 | 5/2013 |
| EP | 2591694 | 5/2013 |
| EP | 2649898 | 10/2013 |
| EP | 2716177 | 7/2014 |
| EP | 2803283 | 1/2015 |
| EP | 2904920 | 8/2015 |
| EP | 2952346 | 12/2015 |
| EP | 2977205 | 1/2016 |
| EP | 2686467 | 4/2016 |
| EP | 2713793 | 6/2016 |
| EP | 2505092 | 8/2016 |
| FR | 858875 | 12/1940 |
| FR | 862088 | 2/1941 |
| FR | 2171172 | 9/1973 |
| FR | 2491739 | 9/1982 |
| FR | 2506576 | 12/1984 |
| FR | 2504786 | 1/1986 |
| FR | 2648684 | 12/1990 |
| FR | 2776485 | 4/2000 |
| FR | 2780619 | 9/2000 |
| FR | 2784550 | 1/2001 |
| FR | 2848807 | 7/2013 |
| GB | 109091 | 8/1917 |
| GB | 273968 | 7/1927 |
| GB | 323457 | 1/1930 |
| GB | 413279 | 7/1934 |
| GB | 538865 | 8/1941 |
| GB | 674835 | 7/1952 |
| GB | 761519 | 11/1956 |
| GB | 782562 | 9/1957 |
| GB | 832518 | 4/1960 |
| GB | 1102447 | 2/1968 |
| GB | 1219433 | 1/1971 |
| GB | 1328693 | 8/1973 |
| GB | 1539886 | 2/1979 |
| GB | 2018837 | 10/1979 |
| GB | 1572493 | 7/1980 |
| GB | 1581999 | 12/1980 |
| GB | 1603487 | 11/1981 |
| GB | 2044073 | 3/1983 |
| GB | 2133273 | 3/1983 |
| GB | 2131677 | 6/1984 |
| GB | 2214939 | 4/1992 |

(56) References Cited

FOREIGN PATENT DOCUMENTS

| | | | |
|---|---|---|---|
| GB | 317184 | | 8/2003 |
| GB | 413017 | | 7/2004 |
| GB | 2408190 | | 5/2005 |
| JP | S39-16845 | | 6/1939 |
| JP | S59-166706 | U | 11/1984 |
| JP | S63-57909 | U | 4/1988 |
| JP | 02079336 | | 3/1990 |
| JP | H02-116806 | U | 9/1990 |
| JP | H03-003203 | U | 1/1991 |
| JP | H05-176804 | A | 7/1993 |
| JP | H06-068722 | Y2 | 3/1994 |
| JP | 06113905 | | 4/1994 |
| JP | H06-154001 | A | 6/1994 |
| JP | H06-248501 | A | 9/1994 |
| JP | H06-296507 | A | 10/1994 |
| JP | 3005269 | U | 12/1994 |
| JP | H0759604 | | 3/1995 |
| JP | H07-025804 | | 5/1995 |
| JP | H07-148004 | A | 6/1995 |
| JP | H07-246101 | A | 9/1995 |
| JP | 08109553 | | 4/1996 |
| JP | H09-047302 | A | 2/1997 |
| JP | H09-238701 | A | 9/1997 |
| JP | H10-000103 | A | 1/1998 |
| JP | H10-130991 | A | 5/1998 |
| JP | H10-155504 | A | 6/1998 |
| JP | H10-179209 | A | 7/1998 |
| JP | H03-064834 | U | 5/1999 |
| JP | H11-229253 | A | 8/1999 |
| JP | 11302943 | | 11/1999 |
| JP | 2000-015732 | | 1/2000 |
| JP | 2000-279201 | A | 10/2000 |
| JP | 2001017206 | | 1/2001 |
| JP | 2001-104091 | A | 4/2001 |
| JP | 2001-164407 | A | 6/2001 |
| JP | 2001-164444 | A | 6/2001 |
| JP | 2002-088512 | | 3/2002 |
| JP | 2002146654 | | 5/2002 |
| JP | 2004-230151 | | 8/2004 |
| JP | 2004-283586 | | 10/2004 |
| JP | 2006-150064 | A | 6/2006 |
| JP | 2006-249586 | A | 9/2006 |
| JP | 3865307 | B2 | 1/2007 |
| JP | 2007204864 | | 8/2007 |
| JP | 2007236612 | | 9/2007 |
| JP | 2007239151 | | 9/2007 |
| JP | 4376792 | | 12/2009 |
| JP | 2010-030289 | A | 2/2010 |
| JP | 2010-163712 | A | 7/2010 |
| JP | 2010-275649 | A | 12/2010 |
| JP | 2011-256506 | A | 12/2011 |
| JP | 2012-500071 | A | 1/2012 |
| JP | 4851688 | B2 | 1/2012 |
| JP | 2012062615 | | 3/2012 |
| JP | 2012-512698 | A | 6/2012 |
| JP | 2012-522551 | A | 9/2012 |
| JP | 2012533404 | | 12/2012 |
| JP | 2013-151783 | A | 8/2013 |
| JP | 2015-025223 | A | 2/2015 |
| NL | 7304678 | | 10/1974 |
| NL | 7505389 | | 11/1975 |
| WO | 9003744 | | 4/1990 |
| WO | 9221806 | | 12/1992 |
| WO | 1997/046127 | A1 | 12/1997 |
| WO | 9843506 | | 10/1998 |
| WO | 9914415 | | 3/1999 |
| WO | 9943229 | | 9/1999 |
| WO | 0032861 | | 6/2000 |
| WO | 0033694 | | 6/2000 |
| WO | 0112003 | | 2/2001 |
| WO | 0112004 | | 2/2001 |
| WO | 0231247 | | 4/2002 |
| WO | 0241721 | | 5/2002 |
| WO | 2002072325 | | 9/2002 |
| WO | 2004064558 | | 8/2004 |
| WO | 2004066770 | | 8/2004 |
| WO | 2004098333 | | 11/2004 |
| WO | 2005004656 | | 1/2005 |
| WO | 2005025841 | | 3/2005 |
| WO | 2005055754 | | 6/2005 |
| WO | 2005074737 | | 8/2005 |
| WO | 2007005459 | | 1/2007 |
| WO | 2009143000 | | 11/2009 |
| WO | 2010020391 | | 2/2010 |
| WO | 2010090923 | | 8/2010 |
| WO | 2011108954 | | 9/2011 |
| WO | 2011/138638 | A1 | 11/2011 |
| WO | 2011138639 | | 11/2011 |
| WO | 2012018731 | | 2/2012 |
| WO | 2012125473 | | 9/2012 |
| WO | 2012125483 | | 9/2012 |
| WO | 2012125490 | | 9/2012 |
| WO | 2012138488 | | 10/2012 |
| WO | 2012151408 | | 11/2012 |
| WO | 2012166602 | | 12/2012 |
| WO | 2012166607 | | 12/2012 |
| WO | 2013/086145 | A1 | 6/2013 |
| WO | 2013121578 | | 8/2013 |
| WO | 2013126314 | | 8/2013 |
| WO | 2013192363 | | 12/2013 |
| WO | 2014078152 | | 5/2014 |
| WO | 2014078158 | | 5/2014 |
| WO | 2014078160 | | 5/2014 |
| WO | 2014078161 | | 5/2014 |
| WO | 2014081680 | | 5/2014 |
| WO | 2014085205 | | 6/2014 |
| WO | 2014085206 | | 6/2014 |
| WO | 2014113352 | | 7/2014 |
| WO | 2014115284 | | 7/2014 |
| WO | 2014134236 | | 9/2014 |
| WO | 2014134237 | | 9/2014 |
| WO | 2014134239 | | 9/2014 |
| WO | 2014134242 | | 9/2014 |
| WO | 2014134244 | | 9/2014 |
| WO | 2014134247 | | 9/2014 |
| WO | 2014137825 | | 9/2014 |
| WO | 2015030914 | | 3/2015 |
| WO | 2015076893 | | 5/2015 |
| WO | 2015134648 | | 9/2015 |
| WO | 2016018904 | | 2/2016 |

OTHER PUBLICATIONS

Eberle et al., Excerpt from Clothing Technology, 2002, 3 pages.

Compendium Warp Knitting, Sonderdruck, Karl Mayer GmbH, Aug. 1, 1978, 8 pages.

Duolastic—an elastic fabric sets new standards, HKS 1 MSU E-Magazine—weft elastic tricot machine, Sonderdruck, Karl Mayer GmbH, Aug. 4, 1989, 8 pages.

Fabric Pictures, www.karlmayer.com, Karl Mayer GmbH, undated, 7 pages.

Jacquard Rashchel machine for the Production of Curtains, Karl Mayer GmbH, Jan. 12, 1996, 4 pages.

Knitting Wear, SM8 Top 1, Santoni S.p.A. undated, 2 pages.

MRSS 42 SU: for producing the finest laces with ground in 22 dtex monofilaments, Sonderdruck, Karl Mayer GmbH, Aug. 4, 1988, 3 pages.

Multibar Jacquard Raschel Machine for Lace, Net Curtains and Patterned Elastic Products, Sonderdruck, Karl Mayer GmbH, Aug. 4, 1978, 6 pages.

Exhibit 2008, Decision on Appeal in U.S. Reexam Application No. 95/001,320, filed in IPR2013-00067 on Dec. 28, 2012, 37 pages.

Anand et al., Technical Fabric Structures—2. Knitted Fabrics, Handbook of Technical Textiles, Woodhead Publishing, 2000, 5 pages.

Chinese Patent Application No. 2005800066703, Office Action dated Jun. 13, 2008, 17 pages.

Chinese Patent Application No. 2005800066703, Office Action dated Jul. 27, 2007, 18 pages.

Chinese Patent Application No. 2005800066703, Office Action dated Aug. 21, 2009, 19 pages.

(56) References Cited

OTHER PUBLICATIONS

Chinese Patent Application No. 2005800066703, Office Action dated Feb. 15, 2008, 6 pages.
Chinese Patent Application No. 2009101783949, Office Action dated May 13, 2011, 13 pages.
European Patent Application No. 15187862.6, Search Report dated Mar. 4, 2016, 7 pages.
German Patent Application No. 102014220087.3, Office Action dated Apr. 21, 2015, 6 pages (a brief description of the relevance is included with the transmittal page).
Ebrlle et al., Clothing Technology, Sixth German Edition and Third English Edition, Veriag Europa-Lehrmittel, Nourney, Vollmer GmbH & Co., D-42781 Haa-Guriten, ISBN 3-8085-6223-4, Nov. 28, 2012, 3 pages.
Exhibit 2004, R. Shishoo, Chapter 16 of Textiles in Sport, filed in IPR2013-00067 on Nov. 28, 2012, 22 pages.
Decision Institution of Inter Partes Review 37 C.F.R. § 42.108, filed in IPR2013-00067 on May 17, 2013, 38 pages.
Decision Motion to Withdraw § 42.10(e) filed in IPR2013-00067 on Oct. 30, 2013, 3 pages.
Exhibit 1001, Declaration and Curriculum Vitae of Dr. Edward C. Frederick filed in IPR2013-00067 on Nov. 28, 2012, 178 pages.
Exhibit 2002, Declaration Edward C. Frederick with note filed in IPR2013-00067 on Aug. 19, 2013, 23 pages.
Exhibit 2010, Declaration of Raymond Tonkel filed in IPR2013-00067 on Aug. 19, 2013, 101 pages.
Exhibit 2009, Edward Frederick Deposition Transcript filed in IPR2013-00067 on Jul. 23, 2013, 187 pages.
Exhibit 2013, Errata Sheet from Edward Frederick Deposition filed in IPR2013-00067 on Aug. 29, 2013, 1 page.
Exhibit 2011, Excerpts from Man-Made Fiber and Textile Dictionary filed in IPR2013-00067 on Aug. 19, 2013, 4 pages.
Exhibit 1015, Cross Examination Deposition of Raymond Tonkel filed in IPR2013-00067 on Nov. 12, 2013, 114 pages.
Exhibit 1016, Declaration of Sabut Adanur Ph.D. filed in IPR2013-00067 on Nov. 12, 2013, 57 pages.
Exhibit 1017, Excerpt of Knitted Fabrics filed in IPR2013-00067 on Nov. 12, 2013, 73 pages.
Exhibit 1018, Excerpt of Bharat J. Gaijar, Wrap Knit Fabrics filed in IPR2013-00067 on Nov. 12, 2013, 16 pages.
Exhibit 1019, J. Watel, the Milanese Machine: Little Progress Made in Development of Milanese Fabric filed in IPR2013-00067 on Nov. 12, 2013, 4 pages.
Exhibit 1023, Supplemental Declaration of Edward C. Frederick filed in IPR2013-00067 on Nov. 12, 2013, 18 pages.
Exhibit 2007, U.S. Pat. No. 7,347,011 with markings filed in IPR2013-00067 on Nov. 12, 2013, 22 pages.
Exhibit 2015, Excerpts from Celanese Corporation Man-Made Fiber and Textile Dictionary filed in IPR2013-00067 on Dec. 11, 2013, 5 pages.
Exhibit 2016, Excerpts from Hoechst Celanese "Dictionary of Fiber & Textile Technology" filed in IPR2013-00067 on Dec. 11, 2013, 4 pages.
Exhibit 2017, Excerpts from Celanese Corporation Man-Made Fiber and Textile Dictionary filed in IPR2013-00067 on Dec. 11, 2013, 10 pages.
Exhibit 2018, Excerpts from Hoechst Celanese Dictionary of Fiber & Textile Technology filed in IPR2013-00067 on Dec. 11, 2013, 11 pages.
Exhibit 2020, Transcript of Dec. 3, 2013, second cross-examination deposition of Edward C. Frederick filed in IPR2013-00067 on Dec. 11, 2013, 59 pages.
Exhibit 2021, Transcript of Dec. 3, 2013, cross-examination deposition of Sabit Adanur filed in IPR2013-00067 on Dec. 11, 2013, 139 pages.
Exhibit 2022, Signature page for transcript of Dec. 3, 2013, Frederick deposition (Ex. 2020) filed in IPR2013-00067 on Jan. 7, 2014, 1 page.
Exhibit 2023, Signature page for transcript of Dec. 3, 2013, Adanur deposition (Ex. 2021) filed in IPR2013-00067 on Jan. 7, 2014, 1 page.
Exhibit 3001 filed in IPR2013-00067 on Apr. 28, 2014, 3 pages.
Exhibit 3002 filed in IPR2013-00067 on Apr. 28, 2014, 4 pages.
Exhibit 1003, File History for U.S. Pat. No. 7,347,011, filed in IPR2013-00067 on Nov. 28, 2012, 201 pages.
Final Written Decision filed in IPR2013-00067 dated Apr. 28, 2014, 43 pages.
Exhibit 1024, Hunter, Billy, viewpoint: Nike Flyknit Quantum Leap for Flat Knitting, www.knittingindustry.com, filed in IPR2013-00067 on Nov. 12, 2013, 5 pages.
Exhibit 1025, Hunter, Billy, viewpoint: Nike Flyknit Ready, Steady, Go, www.knittingindustry.com, filed in IPR2013-00067 on Nov. 12, 2013, 5 pages.
Nike, Inc. Notice of Appeal filed in IPR2013-00067 on Jun. 30, 2014, 5 pages.
Nike's Motion to Amend filed in IPR2013-00067 on Aug. 19, 2013, 19 pages.
Notice of Filing Date Accorded to Petition and Time for Filing Patent Owner Preliminary Response filed in IPR2013-00067 on Dec. 4, 2012, 8 pages.
Oral Hearing Transcript filed in IPR2013-00067 on Mar. 5, 2014, 41 pages.
Order Conduct of the Proceeding filed in IPR2013-00067 on Jun. 19, 2013, 4 pages.
Order Conduct of the Proceeding filed in IPR2013-00067 on Aug. 2, 2013, 5 pages.
Order Conduct of the Proceeding § 4.25 filed in IPR2013-00067 on Jan. 23, 2014, 3 pages.
Order Trial Hearing filed in IPR2013-00067 on Jan. 13, 2014, 4 pages.
Patent Owner Corrected Certificate of Service filed in IPR2013-00067 on Aug. 19, 2013, 3 pages.
Patent Owner Opposition to Motion to Exclude filed in IPR2013-00067 on Jan. 21, 2014, 8 pages.
Patent Owner's Motion to Amend U.S. Pat. No. 7,347,011 filed in IPR2013-00067 on Aug. 19, 2013, 19 pages.
Patent Owner's Preliminary Response to Petition filed in IPR2013-00067 on Feb. 28, 2013, 8 pages.
Patent Owner's Reply to Petitioner's Opposition to Motion to Amend filed in IPR2013-00067 on Dec. 11, 2013, 9 pages.
Patent Owner's Trial Hearing Demonstratives filed in IPR2013-00067 on Feb. 6, 2014, 47 pages.
Petition for Inter Partes Review Under 35 U.S.C. 311-319 and 37 CFR 42.100 et seq. filed in IPR2013-00067 on Nov. 28, 2012, 66 pages.
Petitioner's Amended Notice of Cross Examination of Raymond Tonkel filed in IPR2013-00067 on Nov. 1, 2013, 3 pages.
Petitioner's Opposition to Patent Owner's Motion to Amend filed in IPR2013-00067 on Nov. 12, 2013, 20 pages.
Petitioner's Motion to Exclude Evidence filed in IPR2013-00067 on Jan. 7, 2014, 8 pages.
Petitioner's Opposition to Patent Owner Motion to Amend filed in IPR2013-00067 on Nov. 12, 2013, 20 pages.
Petitioner's Reply to Patent Owner's Opposition to Petitioner's Motion to Exclude Evidence filed in IPR2013-00067 on Jan. 28, 2014, 8 pages.
Exhibit 2012, Random House Webster Dictionary Excerpts filed in IPR2013-00067 on Aug. 19, 2013, 4 pages.
Revised Petition for Inter Partes Review Under 35 U.S.C. §§ 311-319 and 37 C.F.R. § 42.100 filed in IPR2013-00067 on Dec. 10, 2012, 64 pages.
Submission of Patent Owner's Trial Hearing Demonstratives filed in IPR2013-00067 on Feb. 6, 2014, 3 pages.
Exhibit 2006, U.S. Pat. No. 2,147,197 with markings filed in IPR2013-00067 on Aug. 19, 2013, 5 pages.
Exhibit 2003, U.S. Pat. No. 4,354,318 filed in IPR2013-00067 on Aug. 19, 2013, 6 pages.
PCT Patent Application No. PCT/US2005/004776, International Search Report and Written Opinion dated May 19, 2005, 15 pages.
PCT Patent Application No. PCT/US2009/056795, International Search Report and Written Opinion dated Apr. 20, 2010, 16 pages.

(56) References Cited

OTHER PUBLICATIONS

PCT Patent Application No. PCT/US2012/028534, International Preliminary Report on Patentability dated Sep. 17, 2013, 8 pages.
PCT Patent Application No. PCT/US2012/028534, International Search Report and Written Opinion dated Oct. 17, 2012, 14 pages.
PCT Patent Application No. PCT/US2012/028559, International Search Report and Written Opinion dated Oct. 19, 2012, 9 pages.
PCT Patent Application No. PCT/US2012/028576, International Preliminary Report on Patentability dated Sep. 17, 2013, 7 pages.
PCT Patent Application No. PCT/US2012/028576, International Search Report and Written Opinion dated Oct. 1, 2012, 10 pages.
Spencer, "Knitting Technology", Woodhead Publishing Limited, 1989 and 2001, 413 pages.
*Robert M. Lyden* v. *adidas America, Inc., adidas AG, adidas International Marketing B.V., The Finish Line, Inc., and Dick's Sporting Goods, Inc.,* "Original Complaint", Case No. 3:14-CV-1586 MO, United States District Court, District of Oregon, Portland Division, filed Oct. 8, 2014, 54 pages.
Freshness Magazine (Youtube Video), "The Story Behind Nike Flyknit Technology", http://web.archive.org/web/20120225004803/http://www.freshnessmag.com/2012/02/21/the-story-behind-nike-flyknit-technology-video, published on Feb. 21, 2012, 3 pages (website screenshot submitted).
Reissue Patent Application No. RE95/002,094, "Patent Owner's Rebuttal Brief", filed Sep. 3, 2014, 40 pages.
Reissue Patent Application No. RE95/002,094, "Patent Owner's Rebuttal Brief", filed Sep. 22, 2014, 25 pages.
Underwood, Jenny, "The Design of 3D Shape Knitted Preforms", Ph.D. Thesis for School of Fashion and Textile, Design and Social Context Portfolio, RMIT University, Nov. 2009, 201 pages.
ISO 8117:2003(E), "Textile Machinery—Knitting Machines—Nominal diameters of circular machines", Second Edition, Feb. 15, 2003, 6 pages.
Burall, Paul, "CoID Design Awards", Design, Jun. 1969, pp. 46-47.
IPR2016-00920, Petition for Inter Partes Review of U.S. Pat. No. 8,042,288 filed Apr. 19, 2016, 67 pages.
IPR2016-00920, Exhibit 1003, Declaration of Lenny M. Holden, Apr. 19, 2016, 166 pages.
IPR2016-00921, Petition for Inter Partes Review of U.S. Pat. No. 7,814,598 filed Apr. 19, 2016, 57 pages.
IPR2016-00922, Petition for Inter Partes Review of U.S. Pat. No. 8,266,749 filed Apr. 19, 2016, 67 pages.
IPR2016-00921 and IPR-00922, Exhibit 1003, Declaration of Lenny M. Holden, Apr. 19, 2016, 154 pages.
"From Fiber To Fabric: Silk", Clothing And Textiles, Utah State University Cooperative Extension, http://extension.usu.edu./files/publications/factsheet/FC_Clothing&Textiles_2012-25pr.pdf, 2011, 3 pages.
Office Action, Chinese Patent Application No. 201510645049.7, dated Nov. 28, 2016, 8 pages.
Petition for Inter Partes Review Under 35 U.S.C. §§ 311-319 and 37 C.F.R. § 42.100 Et Seq. with Exhibit 1003, Declaration of Lenny M. Holden, Inter Partes Review No. 2017-00263, Nov. 14, 2016.
Petition for Inter Partes Review Under 35 U.S.C. §§ 311-319 and 37 C.F.R. § 42.100 Et Seq. with Exhibit 1003, Declaration of Lenny M. Holden, Inter Partes Review No. 2017-00264, Nov. 14, 2016.
Federal Circuit Case No. 14-1719 , Federal Circuit Mandate to PTAB, Apr. 4, 2016, 1 page.
Federal Circuit Case No. 14-1719 , United States Patent and Trademark Office's Solicitor's Brief to Federal Circuit, Apr. 9, 2015, 27 pages.
Federal Circuit Case No. 14-1719 , Appellant's Reply Brief, May 27, 2015, 38 pages.
Federal Circuit Case No. 14-1719 , Federal Circuit Decision, Feb. 11, 2016, 41 pages.
Federal Circuit Case No. 14-1719 , Appellant's Opening Brief to Federal Circuit, Dec. 15, 2014, 47 pages.
Federal Circuit Case No. 14-1719 , Appellee's Response Brief to Federal Circuit, Apr. 10, 2015, 76 pages.
Federal Circuit Case Nos. 18-1180 & 18-1181 , Appellant's Reply in Support of Motion to Remand, Jun. 5, 2018, 16 pages.
Federal Circuit Case Nos. 18-1180 & 18-1181 , Appellant's Motion for Remand to PTAB, May 24, 2018, 19 pages.
Federal Circuit Case Nos. 18-1180 & 18-1181 , Appellee's Opposition to Motion to Remand to PTAB, Jun. 1, 2018, 21 pages.
Federal Circuit Case Nos. 18-1180 & 18-1181 , Federal Circuit Decision to Remand to PTAB, Jul. 2, 2018, 4 pages.
Federal Circuit Case Nos. 18-1180 & 18-1181 , Appellant's Reply Brief, May 1, 2018, 41 pages.
Federal Circuit Case Nos. 18-1180 & 18-1181 , Appellee's Corrected Response Brief, Apr. 12, 2018, 75 pages.
Federal Circuit Case Nos. 18-1180 & 18-1181 , Appellant's Opening Brief, Feb. 26, 2018, 79 pages.
IPR2013-00067 , Patent Owner's Response Brief, Nov. 16, 2017, 12 pages.
IPR2013-00067 , Petitioner's Opening Brief, Nov. 6, 2017, 12 pages.
IPR2013-00067 , Exhibit 1027, Petitioner's Oral Hearing Demonstratives Slides, 25 pages.
IPR2013-00067 , Exhibit 3003, Email regarding Aqua Products Conference Call, 3 pages.
IPR2013-00067 , Order Conduct of Remand Proceeding, Aug. 10, 2016, 4 pages.
IPR2013-00067 , Patent Owner's Notice of Appeal, Jun. 30, 2014, 5 pages.
IPR2013-00067 , Petitioner's Reply Brief on Remand, Nov. 22, 2017, 6 pages.
IPR2013-00067 , Decision on Remand, Sep. 18, 2018, 65 pages.
IPR2016-00920 , Decision Denying Institution of Inter Partes Review, Oct. 20, 2016, 8 pages.
IPR2016-00921 , Petitioners Brief Addressing Newly Instituted Ground, Sep. 10, 2018, 12 pages.
IPR2016-00921 , Order Modifying Institution Decision and Granting Request for Additional Briefing, Aug. 24, 2018, 14 pages.
IPR2016-00921 , Patent Owner's Response Brief Addressing the Newly Instituted Ground, Sep. 24, 2018, 14 pages.
IPR2016-00921 , Decision on Institution of Inter Partes Review, Oct. 21, 2016, 24 pages.
IPR2016-00921 , Petitioner's Reply to Patent Owner Response, Apr. 21, 2017, 32 pages.
IPR2016-00921 , Patent Owner's Objection to Admissability of Evidence, Apr. 28, 2017, 4 pages.
IPR2016-00921 , Petitioner's Notice of Supplemental Evidence in Response to Patent Owner's Objection to Evidence, May 12, 2017, 4 pages.
IPR2016-00921 , Petitioner's Notice of Appeal, Nov. 13, 2017, 4 pages.
IPR2016-00921 , Final Written Decision, dated Oct. 19, 2017, 49 pages.
IPR2016-00921 , Patent Owner's Response Brief, Jan. 23, 2017, 64 pages.
IPR2016-00921 & IPR2016-00922 , Exhibit 1014, Merriam-Webster Dictionary Definition of Impart, Apr. 10, 2017, 11 pages.
IPR2016-00921 & IPR2016-00922 , Exhibit 2004, Transcript of Deposition of Lenny Holden, Jan. 10, 2017, 226 pages.
IPR2016-00921 & IPR2016-00922 , Exhibit 3001, Random House Webster's College Dictionary Definition of Impart and Texture, Apr. 1999, 4 pages.
IPR2016-00921 & IPR2016-00922 , Record of Oral Hearing, Jul. 26, 2017, 74 pages.
IPR2016-00921 & IPR2016-00922 , Exhibit 1013, Analyzing the Color, Design and Texture of Fabric, 8 pages.
IPR2016-00921 & IPR2016-00922 , Exhibit 1016, Adidas's Oral Hearing Demonstratives, Jul. 12, 2017, 84 pages.
IPR2016-00922 , Petitioner's Brief Addressing Newly Instituted Ground, Sep. 10, 2018, 12 pages.
IPR2016-00922 , Order Modifying Institution Decision and Granting for Additional Briefing, Aug. 24, 2018, 14 pages.
IPR2016-00922 , Patent Owner's Response Brief Addressing Newly Instituted Ground, Sep. 24, 2018, 14 pages.
IPR2016-00922 , Decision on Institution of Inter Partes Review, Oct. 21, 2016, 24 pages.

(56) References Cited

OTHER PUBLICATIONS

IPR2016-00922 , Petitioner's Reply Brief, Apr. 21, 2017, 34 pages.
IPR2016-00922 , Patent Owner's Objection to Admissability of Evidence, Apr. 28, 2017, 4 pages.
IPR2016-00922 , Petitioner's Notice of Supplemental Evidence in Response to Patent Owner's Objections to Evidence 37 C.F.R. § 42.64(B)(1), May 12, 2017, 4 pages.
IPR2016-00922 , Petitioner's Notice of Appeal, Nov. 13, 2017, 4 pages.
IPR2016-00922 , Final Written Decision, dated Oct. 19, 2017, 52 pages.
IPR2016-00922 , Patent Owner's Response Brief, Jan. 23, 2017, 66 pages.
IPR2017-00263 , Decision Denying Institution of Inter Partes Review, Jun. 7, 2017, 11 pages.
IPR2017-00263 , Decision Denying Request for Rehearing, Jul. 20, 2017, 12 pages.
IPR2017-00263 , Petitioner's Request for Rehearing, Jul. 7, 2017, 17 pages.
IPR2017-00263 , Patent Owner's Corrected Preliminary Response, dated Mar. 27, 2017, 24 pages.
IPR2017-00263 , Patent Owner's Preliminary Response, dated Mar. 9, 2017, 24 pages.
IPR2017-00264 , Decision Denying Request for Rehearing, Jul. 20, 2017, 12 pages.
IPR2017-00264 , Decision Denying Institution of Inter Partes Review, Jun. 7, 2017, 12 pages.
IPR2017-00264 , Petitioner's Request for Rehearing, Jul. 7, 2017, 17 pages.
IPR2017-00264 , Patent Owner's Corrected Preliminary Response, dated Mar. 27, 2017, 24 pages.
IPR2017-00264 , Patent Owner's Preliminary Response, dated Mar. 9, 2017, 24 pages.
"Knitting Machine Wins Design Award—The Textile Institute & Industry", EBSCO Host, Textile Institute & Industry, vol. 7, Issue 7, Jul. 1969, 3 pages.
"Polyamide 6.6 Emana Yarn", 5 pages.
Aibibu et al., "Textile Cell-free Scaffolds for in Situ Tissue Engineering Applications", Journal of Materials Science: Materials in Medicine, vol. 27, No. 3, Mar. 2016, 20 pages.
Atalay et al., "Knitted Strain Sensors: Impact of Design Parameters on Sensing Properties", Sensors, vol. 14, No. 3, 2014, 8 pages.
Atalay et al., "Textile-Based Weft Knitted Strain Sensors: Effect of Fabric Parameters on Sensor Properties , Sensors (Basel)", vol. 13, No. 8, Aug. 21, 2013, 6 pages.
Barton et al., "Development and Evaluation of a Tool for the Assessment of Footwear Characteristics", Journal of Foot and Ankle Research, vol. 2, Apr. 23, 2009, 13 pages.
Hamlin , "The Hamlin Cleanroom Bootie", MO-LA Inc., Technical Developments, vol. 18, Mar. 1993, 2 pages.
IPR2013-00067 , Excerpts from Man-Made Fiber and Textile Dictionary , Exhibit 2011, Aug. 19, 2013, 12 pages.
Lo et al., "Effects of Custom-Made Textile Insoles on Plantar Pressure Distribution and Lower Limb Emg Activity During Turning", Journal of Foot and Ankle Research, vol. 9, Jul. 13, 2016, 11 pages.
Office Action, Japanese Patent Application No. 2015-193370, dated Jul. 17, 2018, 11 pages.
Saenz-Cogollo et al., "Pressure Mapping Mat for Tele-Home Care Applications", Sensors, vol. 16, No. 3, E365, Mar. 11, 2016, 9 pages.
Singh et al., "Medical Textiles as Vascular Implants and Their Success to Mimic Natural Arteries", Journal of functional biomaterials, vol. 6, No. 3, Sep. 2015, 15 pages.
Stoppa et al., "Wearable Electronics and Smart Textiles: A Critical Review", Sensors, vol. 14, No. 7, Jul. 2014, 20 pages.
Photograph of Adizero Prime SP Olympia, 2012.
Photograph of Adios, 2012.
Buckley et al., "New Textile Concepts for Use in Control of Body Environments", Presented at RTO HFM Symposium on "Blowing Hot and Cold: Protecting Against Climatic Extremes", Dresden, Germany, Oct. 8-10, 2001, 7 pages.
Hong et al., "The Development of 3D Shaped Knitted Fabrics for Technical Purposes on a Flat Knitting Machine", Indian Journal of Fibre & Textile Research, vol. 19, pp. 189-194, Sep. 1994, 6 pages.
Lu et al. , "The Development of the Flat-Knitted Shaped Uppers Based on Ergonomics", AUTEX Research Journal, vol. 16, No. 2, pp. 67-74, Jun. 2016, 8 pages.
U.S. Appl. No. 14/257,668 , Final Office Action, dated Feb. 1, 2019, 29 pages.
U.S. Appl. No. 14/257,719 , Final Office Action, dated Jan. 24, 2019, 15 pages.
U.S. Appl. No. 14/257,737 , Final Office Action, dated Jan. 2, 2019, 15 pages.
U.S. Appl. No. 14/619,586 , Non-Final Office Action, dated Jan. 14, 2019, 10 pages.
Federal Circuit Case No. 19-1262, Principal Brief of Appellant Nike, Inc., May 17, 2019, 59 pages.
IPR2016-00921, Petitioner adidas AG's Notice of Appeal, Apr. 19, 2019, 71 pages.
IPR2016-00922, Petitioner adidas AG's Notice of Appeal, Apr. 19, 2019, 75 pages.
Office Action, Japanese Patent Application No. 2015-193370, dated Jun. 4, 2019, 11 pages.
Federal Circuit Case No. 19-1262, Appellee Adidas AG's Response Brief, Aug. 9, 2019, 60 pages.
IPR2019-1787, Appellant Adidas AG's Opening Brief, Aug. 30, 2019, 319 pages.
"Adjacent", dictionary.com. Web, Available online at: https://www.dictionary.com/browse/adjacent, Jun. 8, 2019, 7 pages.
Appellee Nike Response to Citation of Supplemental Authority, Federal Circuit Case No. 19-1987, May 20, 2020, 3 pages.
Decision of Dismissal of Amendment, Japanese Patent Application No. 2015-193370, Mar. 3, 2020, 10 pages.
Decision of Refusal, Japanese Patent Application No. 2015-193370, dated Mar. 3, 2020, 2 pages.
Federal Circuit Case No. 19-1262, Reply Brief of Appellant Nike, Inc., Sep. 13, 2019, 38 pages.
Federal Circuit Case No. 19-1787, Appellant Adidas Citation of Supplemental Authority, May 15, 2020, 31 pages.
Federal Circuit Case No. 19-1787, Reply Brief for Appellant Adidas AG, Dec. 23, 2019, 40 pages.
Federal Circuit Case No. 19-1787, Joint Appendix, Dec. 30, 2019, 582 pages.
Federal Circuit Case No. 19-1787, Appellee Nike, Inc.'s Response Brief, Nov. 25, 2019, 77 pages.
Federal Circuit Case No. 2019-1262, Appellant's Citation of Supplemental Authority Pursuant to Rule 28(j), Jan. 29, 2020, 11 pages.
"Symmetrical", dictionary.com, Available online at https://www.dictionary.com/browse/symmetrical, Jun. 8, 2019, 8 pages.
U.S. Appl. No. 14/873,605, Final Office Action, dated Feb. 8, 2019, 6 pages.
U.S. Appl. No. 14/873,605, Non-Final Office Action, dated Jun. 28, 2018, 17 pages.
U.S. Appl. No. 14/873,605, Notice of Allowance, dated Jun. 3, 2019, 12 pages.
U.S. Appl. No. 14/873,605, Restriction Requirement, dated Jan. 11, 2018, 6 pages.
U.S. Appl. No. 14/873,605, Supplemental Notice of Allowability, dated Aug. 6, 2019, 2 pages.
U.S. Appl. No. 14/873,605, Supplementary Notice of Allowability, dated Sep. 30, 2019, 2 pages.
Chamberlain, "Knitted Fabrics", Pitman's Common Commodities and Industries, 1919, 13 pages.
Chamberlain, "Principles of Machine Knitting", Textile Institute, 1951, 3 pages.
Federal Circuit Case No. 19-1262, Decision on Appeal, Apr. 9, 2020, 17 pages.
Federal Circuit Case No. 19-1262, Judgment, Apr. 9, 2020, 1 page.
IPR2013-00067, IDS under 37 C.F.R. 1.501, Exhibit 1026, Nov. 12, 2013, 2 pages.
IPR2013-00067, IDS under 37 C.F.R. 1.501, Exhibit 1004, Nov. 28, 2012, 2 pages.

(56) References Cited

OTHER PUBLICATIONS

IPR2013-00067, List of Related Matters, Dec. 14, 2012, 3 pages.
IPR2013-00067, Mandatory Notice Information, Jan. 25, 2013, 4 pages.
IPR2013-00067, Mandatory Notice Information, Feb. 28, 2013, 5 pages.
IPR2013-00067, Nike's Notice of Appeal, Nov. 20, 2018, pp. 1-69.
IPR2013-00067, Notice of Stipulation, Jun. 14, 2013, 3 pages.
IPR2013-00067, Patent Owner Exhibit List, Aug. 19, 2013, 6 pages.
IPR2013-00067, Patent Owner Exhibit List, Aug. 29, 2013, 6 pages.
IPR2013-00067, Patent Owner's List of Proposed Motions, Jun. 14, 2013, 5 pages.
IPR2013-00067, Patent Owner's Notice of Cross Examination, Jul. 17, 2013, 4 pages.
IPR2013-00067, Petitioner Power of Attorney, Nov. 28, 2012, 2 pages.
IPR2013-00067, Petitioner's Exhibit List, Nov. 12, 2013, 23 pages.
IPR2013-00067, Petitioner's Opposition to Patent Owner's Motion to Amend, Nov. 12, 2013, 53 pages.
IPR2013-00067, Petitioner's Power of Attorney, Jul. 11, 2013, 3 pages.
IPR2013-00067, Scheduling Order, May 17, 2013, 7 pages.
IPR2013-00067, Submission of Power of Attorney, Jan. 25, 2013, 5 pages.
IPR2016-00921, Decision on Remand—35 USC 144 and 37 CFR 42.5(a), Feb. 19, 2019, pp. 1-67.
IPR2016-00921-00922, Hearing Transcript, Nov. 29, 2018, 37 pages.
IPR2016-00921-00922, Nike's Demonstratives for Additional Oral Hearing, Nov. 15, 2018, pp. 1-21.
IPR2016-00921-00922, Patent Owner Nike's Demonstratives, Jul. 11, 2017, pp. 1-27.
IPR2016-00921-00922, Petitioner's Demonstratives for Supplemental Oral Hearing , Nov. 7, 2018, pp. 1-21.
IPR2016-00921-00922, Record of Oral Hearing, Nov. 15, 2018, 37 pages.
IPR2016-00921-00922, Transcript of Proceedings, Oct. 15, 2018, pp. 1-44.
IPR2016-00922, Decision on Remand—35 USC 144 and 37 CFR42.5(a), Feb. 19, 2019, 67 pages.
Wignall, "Knitting", Pitman's Common Commodities and Industries, 1964, 12 pages.
Federal Circuit Case Nos. 19-1787 and 19-1788, Opinion, dated Jun. 25, 2020, 8 pages.
IPR2013-00067, Exhibit 2024, Intervener's Petition for Panel Hearing, Appeal No. 2015-1928, Feb. 5, 2018, 38 pages.
IPR2013-00067, Patent Owner's Opening Brief on Second Remand, Aug. 20, 2020, 12 pages.
IPR2013-00067, Patent Owner's Reply Brief on Second Remand, Sep. 3, 2020, 7 pages.
IPR2013-00067, Petitioner's Opening Brief on Remand, Aug. 20, 2020, 12 pages.
IPR2013-00067, Petitioner's Response Brief on Remand, Sep. 3, 2020, 7 pages.
Order—Conduct of the Proceeding on Remand, IPR Case No. 2013-00067, Jul. 24, 2020, 6 pages.
Final Written Decision on Remand, IPR2013-00067, dated Mar. 1, 2021, 40 pages.
Patent Owner's Notice of Appeal, IPR2013-00067, Apr. 26, 2021, 44 pages.
European Extended Search Report, European Patent Application No. 21182385.1, dated Oct. 11, 2021, 9 pages.
Non-Final Office Action, U.S. Appl. No. 16/575,961, dated Jun. 24, 2021, 6 pages.
Notice of Allowance, U.S. Appl. No. 16/575,961, dated Nov. 3, 2021, 5 pages.

* cited by examiner

FLAT WEFT-KNITTED UPPER FOR SPORTS SHOES

CROSS REFERENCE TO RELATED APPLICATION

This application is a continuation patent application of U.S. application Ser. No. 16/575,961, filed Sep. 19, 2019, entitled FLAT WEFT-KNITTED UPPER FOR SPORTS SHOES ("the '961 application"), which is a continuation patent application of U.S. application Ser. No. 14/873,605, filed Oct. 2, 2015, now U.S. Pat. No. 10,455,885, entitled FLAT WEFT-KNITTED UPPER FOR SPORTS SHOES ("the '605 application"), which is related to and claims priority benefits from German Patent Application No. DE 10 2014 220 087.3, filed on Oct. 2, 2014, entitled FLAT WEFT-KNITTED UPPER FOR SPORTS SHOES ("the '087 application"). The '961, '605, and '087 applications are hereby incorporated herein in their entireties by this reference.

FIELD OF THE INVENTION

The present invention relates to a flat weft-knitted upper for a shoe, in particular for sports shoes.

BACKGROUND

A number of requirements are imposed on a sports shoe, such as a running shoe, soccer shoe, basketball shoe, American Football shoe, baseball shoe or tennis shoe. This particularly includes the fact that a sports shoe is to provide very good support to the person wearing it. This is particularly important in sports with longitudinal or lateral accelerations, such as running, tennis or soccer. However, good support by the footwear is also important in sports such as climbing.

A further requirement imposed on a sports shoe is the lowest weight possible. This is particularly important when running and during fast sprints, as occur in tennis or soccer, for example.

It is currently difficult to simultaneously realize the mentioned requirements of "good support" on the one hand and "low weight" on the other hand in conventional sports shoes. Thus, a reduction of a sports shoe's weight usually results in the sports shoe providing the wearer with less support since material is dispensed with which would otherwise support the foot and ensure a firm coupling of the sports shoe to the foot.

On the other hand, the improvement of the support provided by a sports shoe to the wearer usually results in an increase in weight, for example by the application of additional fastening elements, such as buckles or hook-and-loop fasteners, or by additional reinforcements in certain areas.

Thus, there is tension between the mentioned requirements imposed on a soccer shoe so that, at best, solutions which do meet one of the mentioned requirements while disregarding other requirements are known to date.

The present invention is therefore based on the problem of providing a sports shoe which is light on the one hand and provides very good support to a wearer on the other hand.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an upper for a sports shoe comprises flat weft-knitted knitwear, wherein the flat weft-knitted knitwear forms a top portion and a bottom portion of the upper, wherein the top portion is formed as tube weft-knitted knitwear such that it is configured to surround a part of a shank of a wearer of the sports shoe when worn, and wherein the bottom portion is configured to cover at least a part of a foot of the wearer of the sports shoe when worn.

In some embodiments, the top portion and the bottom portion are connected to one another by linking and/or by weft-knitting. In further embodiments, the top portion and the bottom portion are connected to one another by ultrasonic welding. The welded seam may be covered by a band of adhesive material.

In certain embodiments, the knitwear is formed as single-surface knitwear.

According to some embodiments, the top portion and the bottom portion are adjacent to one another below an ankle of the wearer of the sports shoe when worn.

In some embodiments, knitwear is manufactured on a flat weft-knitting machine with two beds of needles. The bottom portion may be formed as two-ply knitwear.

The top portion may further comprise a weft-knitted-in pocket for a shin guard.

In some embodiments, the bottom portion comprises at least one lace bar, formed integrally with the knitwear, with at least one lace eyelet. The at least one lace bar may be formed as a layer of the knitwear. The bottom portion may comprise two lace bars, and the knitwear may be more elastic in an area between the two lace bars than in other areas.

In some embodiments, the upper further comprises a front portion not formed as knitwear. The front portion may comprise leather or artificial leather.

In certain embodiments, the top portion, at its upper edge, may comprise an elastic cuff formed integrally with the knitwear. The top portion may be adjusted to anatomical conditions of the shank of a wearer of the sports shoe and/or may be tapered from an upper edge to an ankle area. In certain embodiments, the top portion is elastic and exerts pressure on at least a part of the shank. The exerted pressure may be adjusted to the sport for which the sports shoe is used and/or may be adjusted to the respective wearer of the sports shoe. In some embodiments, the top portion comprises an elastic yarn.

According to certain embodiments, a sports shoe comprises an upper as described above and a sole connected to the upper.

According to certain embodiments of the present invention, a method of manufacturing a shoe upper comprising flat weft-knitted knitwear comprises flat-knitting the knitwear such that the flat weft-knitted knitwear forms a top portion and a bottom portion of the upper, forming the top portion as tube weft-knitted knitwear such that it is configured to surround a part of a shank of a wearer of the sports shoe when worn, and forming the bottom portion such that it is configured to cover at least a part of a foot of the wearer of the sports shoe when worn.

BRIEF DESCRIPTION OF THE DRAWINGS

In the following detailed description, embodiments of the invention are described referring to the following figures.

BRIEF DESCRIPTION

Figure 1A:
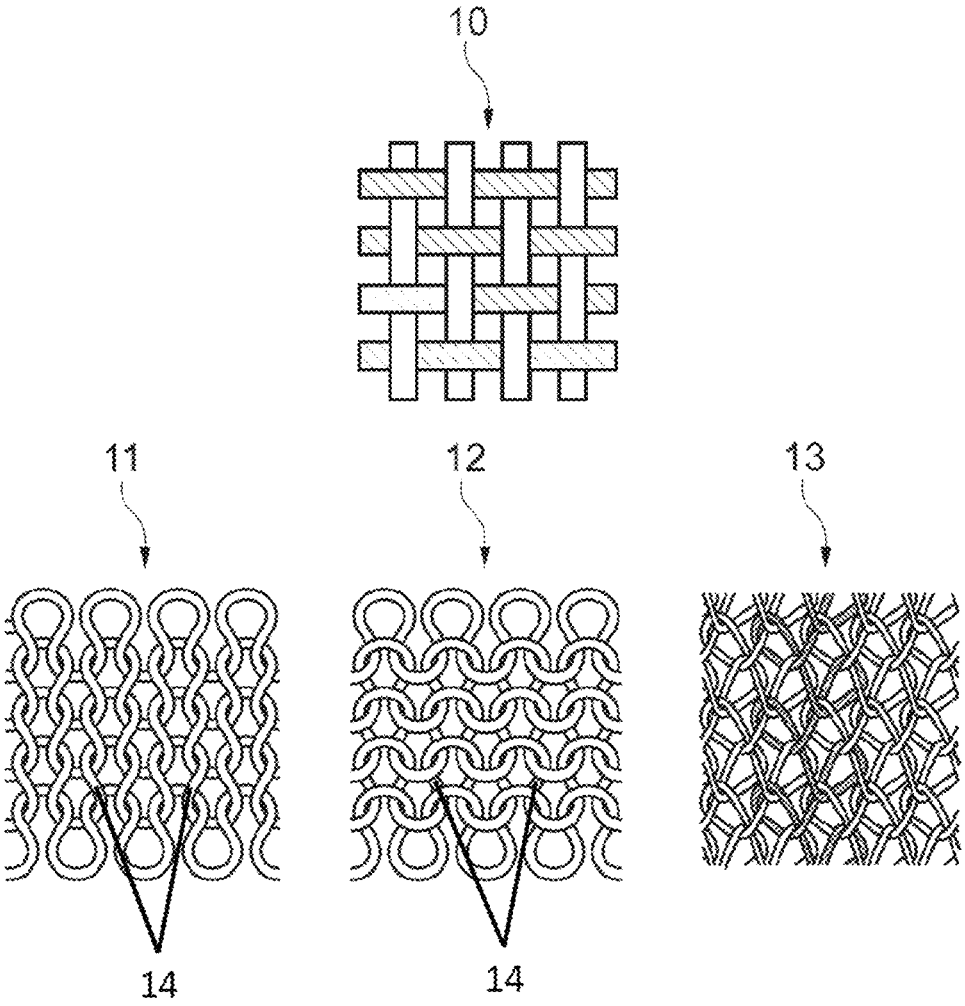
FIG. 1*a* is a schematic representation of textile structures, according to certain embodiments of the present invention.

The mentioned problem is solved by an upper for a sports shoe, comprising flat weft-knitted knitwear, wherein the flat weft-knitted knitwear forms a top portion and a bottom portion of the upper, wherein the top portion is formed as tube weft-knitted knitwear such that it is suitable for surrounding a part of the shank of a wearer of the sports shoe, and wherein the bottom portion is suitable for covering at least a part of a foot of the wearer of the sports shoe.

According to certain embodiments of the invention, the upper comprises flat weft-knitted knitwear. This makes the sports shoe particularly light already, since knitwear has a low weight due to hollow spaces caused by the stitches and hollow spaces in the yarns.

The flat weft-knitted knitwear of the upper according to certain embodiments of the invention forms a top portion and a bottom portion of the upper. The top portion is positioned essentially above the bottom portion when the sports shoe in which the upper is used is standing. In other words, the top portion is located closer to the edge of the foot opening than the bottom portion, with the foot opening being the opening through which a foot is inserted when the sports shoe is put on. The top portion and the bottom portion can be directly adjacent to one another or they can be spaced from one another.

According to certain embodiments of the invention, the top portion is formed as tube weft-knitted knitwear such that it is suitable for surrounding a part of the shank of a wearer of the sports shoe. Tube weft-knitted knitwear is two-ply knitwear which was manufactured on a flat weft-knitting machine with at least two beds of needles and the two plies of which are only connected on the edges. Tube weft-knitted knitwear can have a constant or a variable diameter along its length. For example, the diameter of tube weft-knitted knitwear may be tapered towards one end.

By the top portion being formed as tube weft-knitted knitwear, the top portion can tightly surround a part of a shank of a wearer of the sports shoe and thus provides additional support. Moreover, tube weft-knitted knitwear does not comprise any seams. Pressure sores or chafe marks are reduced or avoided by this.

Additionally, tube weft-knitted knitwear can be ideally adjusted to anatomical conditions. For example—in contrast to circular weft-knitted knitwear—the width, i.e. the diameter of the tube weft-knitted knitwear can be varied along its length. Due to this, it is possible to take into account the fact that the human shank is usually tapered towards the ankle. The top portion can then be formed such that it exerts essentially, i.e. palpably, constant pressure on the shank along its length. Moreover, tube weft-knitted knitwear can be asymmetrical so as to be able to even better adjust to the anatomical conditions.

The bottom portion of the upper according to the invention is suitable for covering at least a part of a foot of the wearer of the sports shoe. In certain embodiments of the invention, the bottom portion covers the foot essentially completely, i.e. from the toes to below the ankle, for example.

In summary, advantages according to certain embodiments of the invention may be achieved by using flat weft-knitted knitwear in the top and bottom portions, with the knitwear being tube weft-knitted in the bottom portion.

In some embodiments of the invention, the top portion and the bottom portion are connected to one another by linking and/or by weft-knitting (e.g. flat weft-knitting). In linking, two edges of knitwear are connected to each other according to the stitches (usually stitch by stitch). Due to this, no seam or at most a seam which only adds a little thickness is created at the line connecting the top portion and the bottom portion. Pressure sores or chafe marks are avoided or at least reduced by this. The same applies with regard to the alternative connection by weft-knitting, in case of which the top portion and the bottom portion are formed as single-surface knitwear.

Additionally or alternatively, the top portion and the bottom portion are connected to one another by sewing, gluing and/or welding.

In some embodiments of the invention, the top portion and the bottom portion are connected to one another by ultrasonic welding. Ultrasonic welding enables a simple and cost-efficient connection.

In certain embodiments of the invention, the welded seam is covered by a band of adhesive material (e.g. thermoplastic or duroplastic (thermoset) material or adhesive). The band can be arranged on the inside of the upper. In this way, the band avoids or reduces pressure sores or chafe marks. Alternatively or additionally, the band can be arranged on the outside of the upper. This can improve the optical appeal of the upper.

In certain embodiments of the invention, the knitwear is formed as single-surface knitwear. In this case, the top portion and the bottom portion are weft-knitted on a flat weft-knitting machine in one go and connected to one another in the process. This avoids the additional working step of connecting the top portion to the bottom portion.

In certain embodiments of the invention, the top portion and the bottom portion are adjacent to one another below the ankle of the wearer of the sports shoe. The top portion can be adjusted in this way in order to tightly surround the ankle of the wearer in order to protect it on the one hand and to counteract twisting of the foot on the other hand.

In certain embodiments of the invention, the knitwear is manufactured on a flat weft-knitting machine with two beds of needles. Due to this, the top portion can be weft-knitted as a tube in a simple manner.

In certain embodiments of the invention, the bottom portion is formed as two-ply knitwear. In this way, the upper can be provided with additional stability in the area of the foot.

In certain embodiments of the invention, the top portion comprises a weft-knitted-in pocket. This pocket can be filled with a shin guard, padding, an insulating layer, a warming or cooling pack and/or a sensor (particularly for communication with a mobile device), for example, and/or be used as a storage facility (e.g. for a key or money). By the pocket being weft-knitted into the top portion, it can be formed in one working step as the top portion is weft-knitted. A separate working step in which the pocket is attached can be done without.

In certain embodiments of the invention, the bottom portion comprises a weft-knitted-in pocket. This pocket can be filled with padding and/or a warming or cooling pack, for example.

In certain embodiments of the invention, the bottom portion comprises at least one lace bar, formed integrally with the knitwear, with at least one lace eyelet. Due to this, separately attaching a lace bar, for example by sewing on or gluing together, can be done without.

In certain embodiments of the invention, the at least one lace eyelet is weft-knitted into the lace bar. Thus, the lace eyelet is formed as the lace bar is weft-knitted. Subsequently forming the lace eyelet, for example by punching, can be done without and fraying of the lace eyelet can be avoided or at least reduced.

In certain embodiments of the invention, the lace bar is formed as one ply of the knitwear. In a further embodiment of the invention, a second ply of the knitwear assumes the function of a tongue. In this way, the lace bar and the tongue can be formed in one working step as the bottom portion is weft-knitted.

In certain embodiments of the invention, the bottom portion comprises two lace bars and the knitwear is more elastic in an area between the two lace bars than in other areas. In this way, the upper can adjust to different foot widths and the sports shoe can be laced up without creases being formed under the laces, since the area between the two lace bars is elastic.

In certain embodiments of the invention, the upper comprises a front portion which is not formed as knitwear. In this way, the upper can be designed depending on the requirements and it can comprise, in the front portion, a more rigid material or a material with a particular surface finish, for example.

In certain embodiments of the invention, the front portion comprises leather or artificial leather. Leather or artificial leather can be advantageous in soccer shoes in order to increase friction ("grip") with the ball.

In certain embodiments of the invention, the top portion, at its upper edge, comprises an elastic cuff formed integrally with the knitwear. The elastic cuff prevents or reduces sliding down of the top portion. By the cuff being formed integrally with the knitwear, an additional working step of connecting the cuff to the knitwear is omitted.

In certain embodiments of the invention, the cuff is weft-knitted as single Jersey. In this way, the cuff can be provided with elasticity in a simple manner. However, the cuff can also be weft-knitted as rib fabric front or purl fabric.

In certain embodiments of the invention, the top portion is adjusted to the anatomical conditions of a shank of a wearer of the sports shoe. This can take the fact into consideration that the human shank does not have a constant circumference but is usually tapered towards the ankle.

In certain embodiments of the invention, the top portion is tapered from an upper edge towards an ankle area. Thus, the top portion is ideally adjusted to the human anatomy and the top portion exerts essentially, i.e. palpably, constant pressure on the shank along its length. Pressure sores or chafe marks are avoided or reduced by this.

The invention principally allows an individual adjustment of the style and design of the sports shoe. For example, a custom-made sports shoe can be obtained using initial parameters, which have been obtained by a body scan, for example, and which represent the circumference of a leg, a calf or an ankle joint, for example. For this purpose, a standard weft-knitting pattern can be started out from, for example, and stitches can then be omitted or added depending on the initial parameters.

Moreover, the invention allows for individual designs of a sports shoe by the use of knitwear which can be formed with individual, colored yarns, graphics, logos, patterns, etc.

In certain embodiments of the invention, the top portion is elastic and exerts pressure on at least a part of the shank. The support of the sports shoe is improved by the pressure. On the other hand, a certain amount of pressure by pieces of apparel is desirable in sports, in order to provide the athlete with feedback regarding the position of their body parts ("proprioception").

In certain embodiments of the invention, the exerted pressure is adjusted to the sport for which the sports shoe is used. In this way, the foot can, for example, be provided with better support by higher pressure in case of a tennis shoe, which is subject to high accelerations due to abrupt decelerations and accelerations. In case of a running shoe, which is usually not subject to such high accelerations as a tennis shoe is, less pressure on the shank is sufficient.

In certain embodiments of the invention, the exerted pressure is adjusted to the respective wearer of the sports shoe. Depending on their personal preferences, the wearer can decide on more or less pressure on the shank by the top portion.

In certain embodiments of the invention, the top portion comprises an elastic yarn. By an elastic yarn, the top portion can be designed elastically in a simple manner, so as to exert pressure on at least a part of the shank.

The invention also relates to a sports shoe which comprises an upper according to the invention and a sole connected to the upper.

Finally, the invention relates to a method for manufacturing an upper according to the invention, comprising the following steps: Flat weft-knitting the knitwear such that the flat weft-knitted knitwear forms a top portion and a bottom portion of the upper; forming the top portion as tube weft-knitted knitwear such that it is suitable for surrounding a part of the shank of a wearer of the sports shoe; and forming the bottom portion such that it is suitable for covering at least a part of a foot of the wearer of the sports shoe.

On principle, all embodiments of the invention mentioned in this description can be combined with one another, i.e. the features of one embodiment together with the features of another embodiment constitute a further embodiment of the invention.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments and variations of the present invention will be described in more detail below.

The use of knitwear allows products such as an upper (also referred to as a shoe upper) or a sole of a shoe, such as an insole, strobel sole, midsole and/or outer sole to be equipped with areas with different characteristics providing different functions with low production effort. The properties include bendability, stretchability (expressed as Young's modulus, for example), permeability to air and water, thermoconductivity, thermal capacity, moisture absorption, static friction, abrasion resistance, hardness and thickness, for example.

Various techniques are applied in order to achieve such characteristics or functions, which will be described in the following. This includes suitable techniques in manufacturing knitwear such as knitting techniques, the selection of fibers and yarns, coating the fibers, yarns or knitwear with polymer or other materials, the use of monofilaments, the combination of monofilaments and polymer coating, the application of fuse/melt yarns, and multi-layer textile material. In general, the yarns used for the manufacture of knitwear can be equipped, e.g. coated, accordingly. In addition or alternatively, the finished knitwear can be equipped accordingly.

Another aspect of providing functions concerns the specific use of knitwear for certain areas of a product, for example of an upper or a sole, and the connection of different parts by suitable connection techniques. The mentioned aspects and techniques as well as other aspects and techniques will be explained in the following.

The described techniques can be used individually or they can be combined in any manner.

Knitwear

Knitwear used in the present invention is divided into weft-knitted fabrics and single-thread warp-knitted fabrics on the one hand and multi-thread warp-knitted fabrics on the other hand. The distinctive characteristic of knitwear is that it is formed of interlocking yarn or thread loops. These thread loops are also referred to as stitches and can be formed of one or several yarns or threads.

Yarn or thread are the terms for a structure of one or several fibers which is long in relation to its diameter. A fiber is a flexible structure which is rather thin in relation to its length. Very long fibers, of virtually unlimited length with regard to their use, are referred to as filaments. Monofilaments are yarns consisting of one single filament, that is, one single fiber.

In weft-knitted fabrics and single-thread warp-knitted fabrics, the stitch formation requires at least one thread or yarn, with the thread running in longitudinal direction of the product, i.e. substantially at a right angle to the direction in which the product is made during the manufacturing process. In multi-thread warp-knitted fabrics, the stitch formation requires at least one warp sheet, i.e. a plurality of so-called warps. These stitch-forming threads run in longitudinal direction, i.e. substantially in the direction in which the product is made during the manufacturing process.

FIG. 1*a* shows the basic difference between a woven fabric 10, weft-knitted fabrics 11 and 12 and a warp-knitted fabric 13. A woven fabric 10 has at least two thread sheets which are usually arranged at a right angle to one another. In this regard, the threads are placed above or underneath each other and do not form stitches. Weft-knitted fabrics 11 and 12 are created by weft-knitting with one thread from the left to the right, or vice versa, by interlocking stitches. View 11 shows a front view (also referred to as the front loop fabric side) and view 12 a back view (also referred to as the back loop fabric side) of a weft-knitted fabric. The front loop and back loop product sides differ in the run of the legs 14. On the back loop fabric side 12 the legs 14 are covered in contrast to the front loop fabric side 11.

Figure 1B:
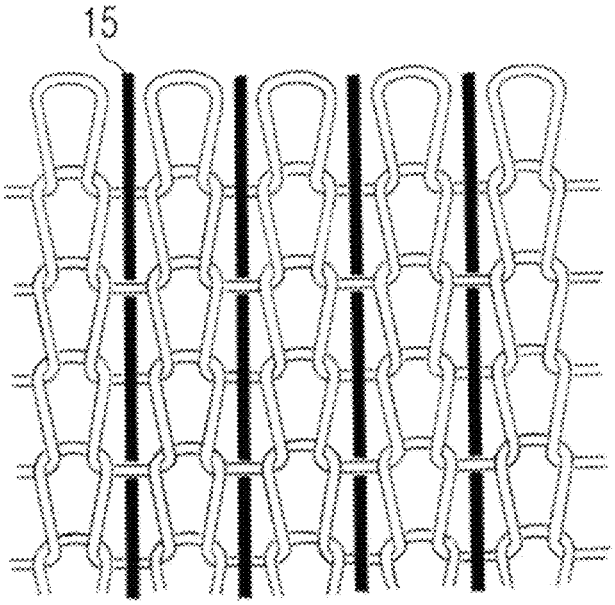
FIG. 1*b* is a schematic representation of a weft-knitted fabric with a filler yarn, according to certain embodiments of the present invention.

An alternative of a weft-knitted fabric which can be used for the present invention with a so-called filler yarn 15 is shown in FIG. 1*b*. A filler yarn 15 is a length of a thread placed between two wales in longitudinal direction, which is held by transverse threads of other weave elements. By the combination of the filler yarn 15 with other weave elements the properties of the weft-knitted fabric are influenced or various pattern effects are achieved. Stretchability of the weft-knitted fabric in the direction of the wales can for example be reduced by a filler yarn 15.

Instead of or in addition to a filler yarn, a weft can also be introduced into the knitwear during weft-knitting or warp-knitting, e.g. in order to reduce elasticity of the knitwear.

Warp-knitted fabric 13 is created by warp-knitting with many threads from top down, as shown in FIG. 1*a*. In doing so, the stitches of a thread are interlocked with the stitches of the neighboring threads. Depending on the pattern according to which the stitches of the neighboring threads are interlocked, one of the seven known basic connections (also referred to as "interlaces" in multi-thread warp-knitting) pillar, tricot, 2×1 plain, satin, velvet, atlas and twill are created, for example.

Figure 2:
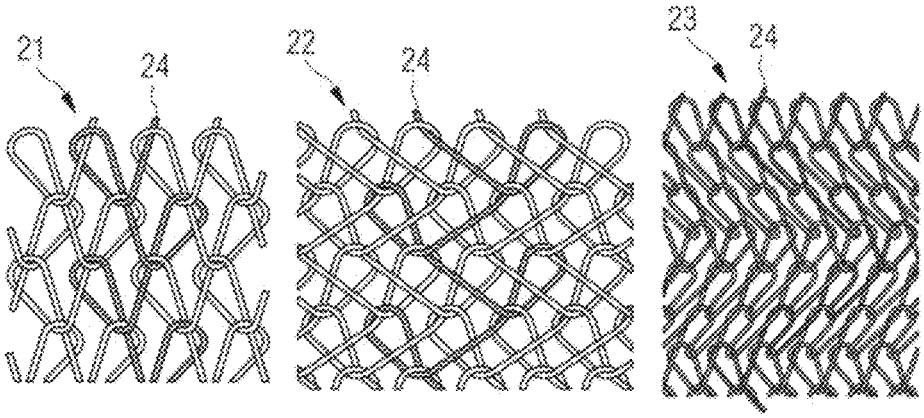
FIG. 2 are schematic representations of various interlaces of a warp-knitted fabric, according to certain embodiments of the present invention.

By way of example, the interlaces tricot 21, 2×1 plain 22 and atlas 23 are shown in FIG. 2. A different interlocking results depending on how the stitches of thread 24, which is highlighted by way of example, are interlocked in the stitches of neighboring threads. In the tricot interlace 21, the stitch-forming thread zigzags through the knitwear in the longitudinal direction and binds between two neighboring wales. The 2×1 plain interlace 22 binds in a manner similar to that of the tricot interlace 21, but each stitch-forming warp skips a wale. In the atlas interlace 23 each stitch-forming warp runs to a turning point in a stairs-shape and then changes direction.

Figure 3:
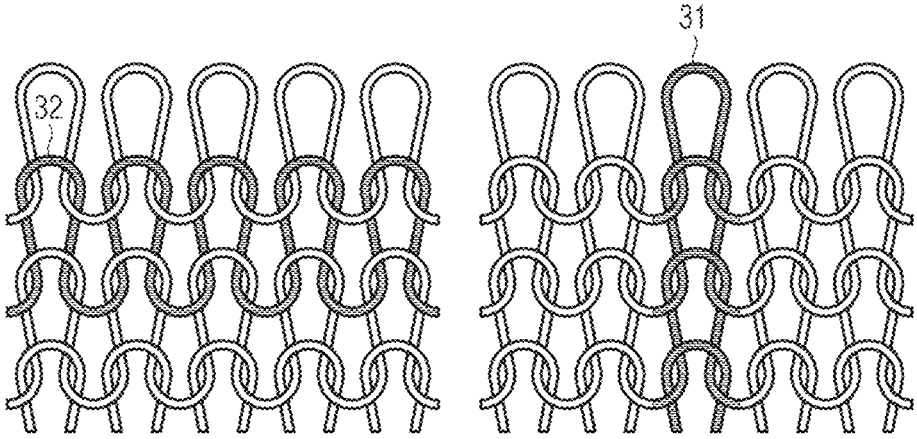
FIG. 3 are schematic representations of weft-knitted fabrics, according to certain embodiments of the present invention.

Stitches arranged above each other with joint binding sites are referred to as wales. FIG. 3 shows a wale as an example of a weft-knitted fabric with reference number 31. The term wale is also used analogously in warp-knitted fabrics. Accordingly, wales run vertically through the mesh fabric. Rows of stitches arranged next to one another, as shown by way of example for a weft-knitted fabric with reference number 32 in FIG. 3 are referred to as courses. The term course is also used analogously in warp-knitted fabrics. Accordingly, courses run through the mesh fabric in the lateral direction.

Figure 4:
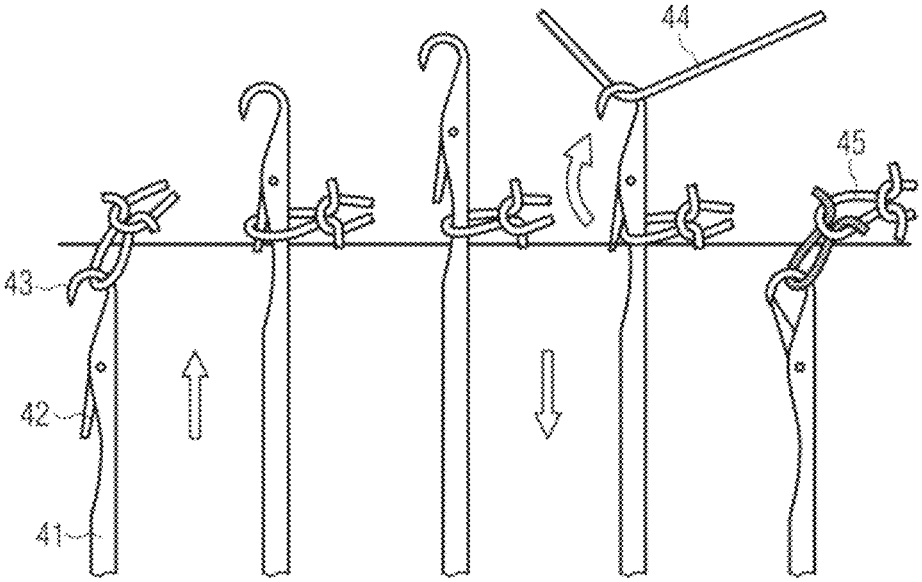
FIG. 4 are illustrations showing a process of stitch forming by latch needles during weft-knitting, according to certain embodiments of the present invention.

Three basic weft-knitted structures are known in weft-knitted fabrics, which can be recognized by the run of the stitches along a wale. With plain, single Jersey, only back loops can be recognized along a wale on one side of the fabric and only back loops can be recognized along the other side of the product. This structure is created on a bed of needles of a knitting machine, i.e. an arrangement of neighboring knitting needles, and also referred to as single Jersey. With rib fabric, front and back loops alternate within a course, i.e. either only front or back loops can be found along a wale, depending on the side of the product from which the wale is considered. This structure is created on two beds of needles with needles offset opposite each other. With purl fabric, front and back loops alternate in one wale. Both sides of the product look the same. This structure is manufactured by latch needles as illustrated in FIG. 4 by stitch transfer. The transfer of stitches can be avoided if double latch needles are used, which comprise both a hook and a latch at each end.

An essential advantage of knitwear over weaved textiles is the variety of structures and surfaces which can be created with it. It is possible to manufacture both very heavy and/or stiff knitwear and very soft, transparent and/or stretchable knitwear with substantially the same manufacturing technique. The parameters by which the properties of the material can be influenced substantially are the pattern of weft-knitting or warp-knitting, the used yarn, the needle size or the needle distance, and the tensile strain subject to which the yarn is placed on the needles.

An advantage of weft-knitting may be that certain yarns can be weft-knitted in at freely selectable places. In this manner, selected zones can be provided with certain properties. For example, the shoe upper for the soccer shoe according to the invention can be provided with zones made from rubberized yarn in order to achieve higher static friction and thus enable the player to better control the ball. With certain yarns being weft-knitted in at selected places, no additional elements have to be applied.

Knitwear is manufactured on machines in the industrial context. These usually comprise a plurality of needles. In weft-knitting, latch needles 41 are usually used, which each comprise a moveable latch 42, as illustrated in FIG. 4. This latch 42 closes the hook 43 of the needle 41 such that a thread 44 can be pulled through a stitch 45 without the needle 41 being caught on the stitch 45. In weft-knitting, the latch needles are usually moveable individually, so that every single needle can be controlled such that it catches a thread for stitch formation.

A differentiation is made between flat weft-knitting and circular-knitting machines. In flat weft-knitting machines, a thread feeder feeds the thread back and forth along one or several beds of needles. In a circular-knitting machine, the needles are arranged in a circular manner and the thread feeding correspondingly takes place in a circular movement along one or more round beds of needles.

Instead of a single bed of needles, it is also possible for a knitting machine to comprise two parallel beds of needles. When looked at from the side, the needles of the two beds of needles may, for example, be opposite each other at a right angle. This enables the manufacture of more elaborate structures or weaves. The use of two beds of needles allows the manufacture of a one-layered or two-layered weft-knitted fabric. A one-layered weft-knitted fabric is created when the stitches generated on the first bed of needles are enmeshed with the stitches generated on the second bed of needles. Accordingly, a two-layered weft-knitted fabric is created when the stitches generated on the first bed of needles are not or only selectively enmeshed with the stitches generated on the second bed of needles and/or if they are merely enmeshed at the end of the weft-knitted fabric. If the stitches generated on the first bed of needles are loosely enmeshed only selectively with the stitches generated on the second bed of needles by an additional yarn, this is also referred to as spacer weft-knitted fabric. The additional yarn, for example a monofilament, is thus guided back and forth between two layers, so that a distance between the two layers is created. The two layers can e.g. be connected to each other via a so-called tuck-stitch.

Generally, the following weft-knitted fabrics can thus be manufactured on a weft-knitting machine with two beds of needles: If only one bed of needles is used, a one-layered weft-knitted fabric is created. When two beds of needles are used, the stitches of both beds of needles can consistently be connected to each other so that the resulting knitwear comprises a single layer. If the stitches of both beds of needles are not connected or only connected at the edge when two beds of needles are used, two layers are created. If, when using two beds of needles, the stitches of both beds of needles are connected selectively in turns by an additional thread, a spacer weft-knitted fabric is created. The additional thread is also referred to as spacer thread and it can be fed via a separate yarn feeder.

On principle, weft-knitting machines with more than two beds of needles can also be used, which allows the design of the knitwear manufactured on them to be fashioned even more flexibly.

The techniques described herein as well as further aspects of the manufacture of knitwear can be found in "Fachwissen Bekleidung", 6th ed. by H. Eberle et al. (published with the title "Clothing Technology" in English), in "Textil- and Modelexikon", 6th ed. by Alfons Hofer and in "Maschenlexikon", 11th ed. by Walter Holthaus, for example.

Three-Dimensional Knitwear

Three-dimensional (3D) knitwear can also be manufactured on weft-knitting machines and warp-knitting machines, particularly on flat weft-knitting machines. This is knitwear which comprises a spatial structure although it is weft-knitted or warp-knitted in a single process. A three-dimensional weft-knitting or warp-knitting technique allows for spatial knitwear to be manufactured without seams, cut or manufacture in one piece and in a single process.

Three-dimensional knitwear may, for example, be manufactured by varying the number of stitches in the direction of the wales by the formation of partial courses. The corresponding mechanical process is referred to as "needle parking". Depending on the requirement, this can be combined with structural variations and/or variations of the number of stitches in the direction of the course. When partial courses are formed, stitch formation temporarily occurs only along a partial width of the weft-knitted fabric or warp-knitted fabric. The needles which are not involved in the stitch formation keep the half stitches ("needle parking") until weft-knitting occurs again at this position. In this way, it is possible to achieve bulges, for example.

By three-dimensional weft-knitting or warp-knitting an upper can be adjusted to the cobbler's last or the foot and a sole can be treaded, for example. The tongue of a shoe can e.g. be weft-knitted into the right shape. Contours, structures, knobs, curvatures, notches, openings, fasteners, loops and pockets can be integrated into the knitwear in a single process.

Three-dimensional knitwear can be used for the present invention in an advantageous manner.

For example, a three-dimensional shoe can be weft-knitted using a single-Jersey material which extends from the topmost portion of the upper to the toes and/or another area of a bottom portion of the shoe. The topmost portion of the upper can be weft-knitted using elastic yarns with a predetermined elasticity module, whereas the bottom portion of the upper can include several yarns of different types. For example, the bottom portion of a shoe upper can include several yarns, such as yarns made from polyester, monofilament, elastic yarns and/or combinations thereof.

Functional Knitwear

Knitwear and particularly weft-knitted fabric can be provided with a range of functional properties and used in the present invention in an advantageous manner.

It is possible by a weft-knitting technique to manufacture knitwear which has different functional areas and simultaneously maintains its contours. The structures of knitwear may be adjusted to functional requirements in certain areas, by the stitch pattern, the yarn, the needle size, the needle distance or the tensile strain subject to which the yarn is placed on the needles being selected accordingly.

It is possible, for example, to include structures with large stitches or openings within the knitwear in areas in which airing is desired. In contrast, in areas in which support and stability are desired, fine-meshed stitch patterns, stiffer yarns or even multi-layered weft-knitting structures can be used, which will be described in the following. In the same manner, the thickness of the knitwear is variable.

Knitwear having more than one layer provides numerous possible constructions for the knitwear, which provide many advantages. Knitwear with more than one layer, e.g. two, can be weft-knitted or warp-knitted on a weft-knitting machine or a warp-knitting machine with several beds of needles, e.g. two, in a single stage, as described in the section "knitwear" above. Alternatively, the several layers, e.g. two, can be weft-knitted or warp-knitted in separate stages and then placed above each other and connected to each other if applicable, e.g. by sewing, gluing, welding or linking.

Several layers fundamentally increase solidness and stability of the knitwear. In this regard, the resulting solidness depends on the extent to which and the techniques by which the layers are connected to each other. The same yarn or different yarns can be used for the individual layers. For example, it is possible in a weft-knitted fabric for one layer to be weft-knitted from multi-fiber yarn and one layer to be weft-knitted from monofilament, whose stitches are enmeshed. In particular stretchability of the weft-knitted layer is reduced due to this combination of different yarns. It is an advantageous alternative of this construction to arrange a layer made from monofilament between two layers made from multi-fiber yarn in order to reduce stretchability and increase solidness of the knitwear. This results in a pleasant surface made from multi-fiber yarn on both sides of the knitwear.

An alternative of two-layered knitwear is referred to as spacer weft-knitted fabric or spacer warp-knitted fabric, as explained in the section "knitwear". In this regard, a spacer yarn is weft-knitted or warp-knitted more or less loosely between two weft-knitted or warp-knitted layers, interconnecting the two layers and simultaneously serving as a filler. The spacer yarn can comprise the same material as the layers themselves, e.g. polyester or another material. The spacer yarn can also be a monofilament which provides the spacer weft-knitted fabric or spacer warp-knitted fabric with stability.

Such spacer weft-knitted fabrics or spacer warp-knitted fabrics, which are also referred to as three-dimensional weft-knitted fabrics or warp-knitted fabrics, but have to be differentiated from the formative 3D weft-knitted fabrics or 3D warp-knitted fabrics mentioned in the section "three-dimensional knitwear" above, can be used wherever additional cushioning or protection is desired, e.g. at the upper or the tongue of an upper or in certain areas of a sole. Three-dimensional structures can also serve to create spaces between neighboring textile layers or also between a textile layer and the foot and thus ensure airing. Moreover, the layers of a spacer weft-knitted fabric or a spacer warp-knitted fabric can comprise different yarns depending on the position of the spacer weft-knitted fabric on the foot.

The thickness of a spacer weft-knitted fabric or a spacer warp-knitted fabric can be set in different areas depending on the function or the wearer. Various degrees of cushioning can be achieved with areas of various thicknesses, for example. Thin areas can increase bendability, for example, thus fulfilling the function of joints or flex lines.

Multi-layer constructions also create possibilities of color design, by different colors being used for the different layers. In this way, knitwear can be provided with two different colors for the front and the back, for example. An upper made from such knitwear can then comprise a different color on the outside than on the inside.

An alternative of multi-layered constructions are pockets or tunnels, in which two textile layers or knitwear weft-knitted or warp-knitted on two beds of needles are connected to each other only in certain areas so that a hollow space is created. Alternatively, items of knitwear weft-knitted or warp-knitted in two separate processes are connected to each other such that a void is created, e.g. by sewing, gluing, welding or linking. It is then possible to introduce a cushioning material such as a foam material, eTPU (expanded thermoplastic urethane), ePP (expanded polypropylene), expanded EVA (ethylene vinyl acetate) or particle foam, an air or gel cushion for example, through an opening, e.g. at the tongue, the upper, the heel, the sole or in other areas. Alternatively or additionally, the pocket can also be filled with a filler thread or a spacer knitwear. It is furthermore possible for threads to be pulled through tunnels, for example as reinforcement in case of tension loads in certain areas of an upper. Moreover, it is also possible for the laces to be guided through such tunnels. Moreover, loose threads can be placed into tunnels or pockets for padding, for example in the area of the ankle. However, it is also possible for stiffer reinforcing elements, such as caps, flaps or bones to be inserted into tunnels or pockets. These can be manufactured from plastic such as polyethylene, TPU, polyethylene or polypropylene, for example.

A further possibility for a functional design of knitwear is the use of certain variations of the basic weaves. In weft-knitting, it is possible for bulges, ribs or waves to be weft-knitted in certain areas, for example, in order to achieve reinforcement in these places. A wave may, for example, be created by stitch accumulation on a layer of knitwear. This means that more stitches are weft-knitted or warp-knitted on one layer than on another layer. Alternatively, different stitches are weft-knitted on the one layer than on the other layer, e.g. with these being weft-knitted tighter, wider or using a different yarn. Thickening is caused in both alternatives.

Ribs, waves or similar patterns may, for example, also be used at the bottom of a weft-knitted outer sole of a shoe in order to provide a tread and provide the shoe with better non-slip properties. In order to obtain a rather thick weft-knitted fabric, for example, it is possible to use the weft-knitting techniques "tuck" or "half cardigan", which are described in "Fachwissen Bekleidung", 6th ed. by H. Eberle et al., for example.

Waves can be weft-knitted or warp-knitted such that a connection is created between two layers of a two-layered knitwear or such that no connection is created between the two layers. A wave can also be weft-knitted as a right-left wave on both sides with or without a connection of the two layers. A structure in the knitwear can be achieved by an uneven ration of stitches on the front or the back of the knitwear.

Ribs, waves or similar patterns, for example, may be included in the knitwear of the soccer shoe according to the invention in order to increase friction with a soccer ball, for example, and/or in order to generally allow for a soccer player to have better control of the ball.

A further possibility of functionally designing knitwear within the framework of the present invention is providing openings in the knitwear already during weft-knitting or warp-knitting. In this manner, airing of the soccer shoe according to the invention may be provided in specific places in a simple manner.

Yet another possibility of functionally designing knitwear within the framework of the present invention is forming laces integrally with the knitwear of the shoe upper according to the invention. In these embodiments, the laces are warp-knitted or weft-knitted integrally with the knitwear already when the knitwear of the shoe upper according to the invention is weft-knitted or warp-knitted. In this regard, a first end of a lace is connected to the knitwear, while a second end is free.

In certain embodiments, the first end is connected to the knitwear of the upper in the area of the transition from the tongue to the area of the forefoot of the upper. In further embodiments, a first end of a first lace is connected to the knitwear of the upper at the medial side of the tongue and a first end of a second lace is connected to the knitwear of the upper at the lateral side of the tongue. The respective second ends of the two laces can then be pulled through lace eyelets for tying the shoe.

A possibility of speeding up the integral weft-knitting or warp-knitting of laces is having all yarns used for weft-knitting or warp-knitting knitwear end in the area of the transition from the tongue to the area of the forefoot of the upper. The yarns may end in the medial side of the upper on the medial side of the tongue and form the lace connected on the medial side of the tongue. The yarns may end in the lateral side of the upper on the lateral side of the tongue and form the lace connected to the lateral side of the tongue. The yarns may then be cut off at a length which is sufficiently long for forming laces. The yarns can be twisted or intertwined, for example. The respective second end of the laces may be provided with a lace clip. Alternatively, the second ends are fused or provided with a coating.

The knitwear is particularly stretchable in the direction of the stitches (longitudinal direction) due to its construction. This stretching can be reduced e.g. by subsequent polymer coating of the knitwear. The stretching can also be reduced during manufacture of the knitwear itself, however. One possibility is reducing the mesh openings, that is, using a smaller needle size. Smaller stitches generally result in less stretching of the knitwear. Moreover, the stretching of the knitwear can be reduced by weft-knitted reinforcements, e.g. three-dimensional structures. Such structures may be arranged on the inside or the outside of the knitwear of the shoe upper according to the invention. Furthermore, non-stretchable yarn, e.g. made from nylon, can be laid in a tunnel along the knitwear in order to limit stretching to the length of the non-stretchable yarn.

Colored areas with several colors can be created by using a different thread and/or by additional layers. In transitional areas, smaller mesh openings (smaller needle sizes) are used in order to achieve a fluent passage of colors.

Further effects can be achieved by weft-knitted insets (inlaid works) or Jacquard knitting. Inlaid works are areas which only provide a certain yarn, e.g. in a certain color. Neighboring areas which can comprise a different yarn, for example in a different color, are then connected to each other by a so-called tuck-stitch.

During Jacquard knitting, two beds of needles are used and two different yarns run through all areas, for example. However, in certain areas only one yarn appears on the visible side of the knitwear and the respective other yarn runs invisibly on the other side of the knitwear.

A product manufactured from knitwear can be manufactured in one piece on a weft-knitting machine or a warp-knitting machine. Functional areas can then already be manufactured during weft-knitting or warp-knitting by corresponding techniques as described here.

Alternatively, the product can be combined from several parts of knitwear and it can also comprise parts which are not manufactured from knitwear. In this regard, the parts of knitwear can each be designed separately with different functions, for example regarding thickness, insulation, transport of moisture, stability, protection, abrasion-resistance, durability, cooling, stretchability, rigidity, compression, etc.

The shoe upper of the soccer shoe according to the invention and/or its sole may, for example, be generally manufactured from knitwear as a whole or it may be put together from different parts of knitted goods. A whole upper or parts of that may, for example, be separated, e.g. punched, from a larger piece of knitwear. The larger piece of knitwear may, for example, be a circular weft-knitted fabric or a circular warp-knitted fabric or a flat weft-knitted fabric or a flat warp-knitted fabric.

In a further example, a shoe comprises a flat weft-knitted strobel sole, an insole and/or an outsole. The outsole can be connected to the upper by sewing, for example. Other connecting techniques may be utilized.

For example, a tongue can be manufactured as a continuous piece and connected with the upper subsequently, or it can be manufactured in one piece with the upper. With regard to their functional designs, ridges on the inside can e.g. improve flexibility of the tongue and ensure that a distance is created between the tongue and the foot, which provides additional airing. Laces may be guided through one or several weft-knitted tunnels of the tongue. The tongue can also be reinforced with polymer in order to achieve stabilization of the tongue and e.g. prevent a very thin tongue from convolving. Moreover, the tongue can then also be fitted to the shape of the cobbler's last or the foot.

Applications such as polyurethane (PU) prints, thermoplastic polyurethane (TPU) ribbons, textile reinforcements, leather, rubber, etc., may be subsequently applied to the knitwear of the soccer shoe according to the invention. Thus, it is possible, for example, to apply a plastic heel or toe cap as reinforcement or logos and eyelets for laces on the shoe upper, for example by sewing, gluing or welding, as described below.

Sewing, gluing or welding, for example, constitute suitable connection techniques for connecting individual parts of knitwear with other textiles or with parts of knitwear. Linking is another possibility for connecting two parts of knitwear. Therein, two edges of knitwear are connected to each other according to the stitches (usually stitch by stitch).

A possibility for welding textiles, particularly ones made from plastic yarns or threads, is ultrasonic welding. Therein, mechanical oscillations in the ultrasonic frequency range are transferred to a tool referred to as a sonotrode. The oscillations are transferred to the textiles to be connected by the sonotrode under pressure. Due to the resulting friction, the textiles are heated up, softened and ultimately connected in the area of the place of contact with the sonotrode. Ultrasonic welding allows rapidly and cost-effectively connecting particularly textiles with plastic yarns or threads. It is possible for a ribbon to be attached, for example glued, to the weld seam, which additionally reinforces the weld seam and is optically more appealing. Moreover, wear comfort is increased since skin irritations—especially at the transition to the tongue—are avoided.

Figure 5A:
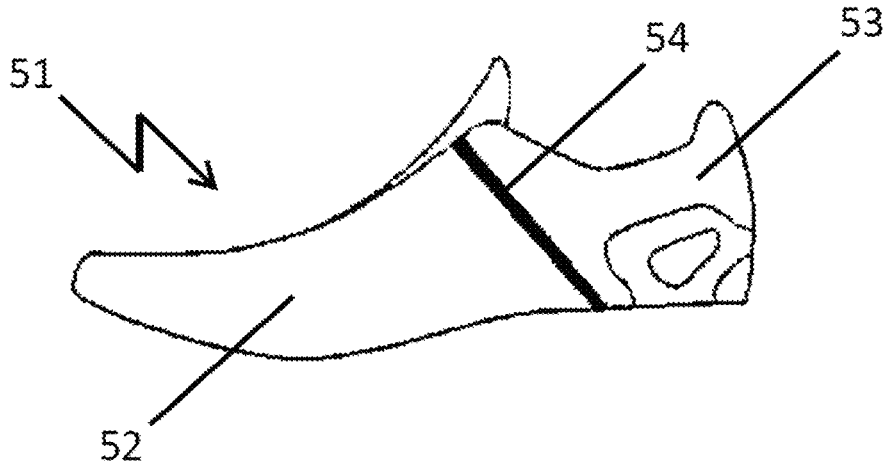
FIG. 5*a* is a side view of an upper with two connected textile areas, according to certain embodiments of the present invention.
Figure 5B:
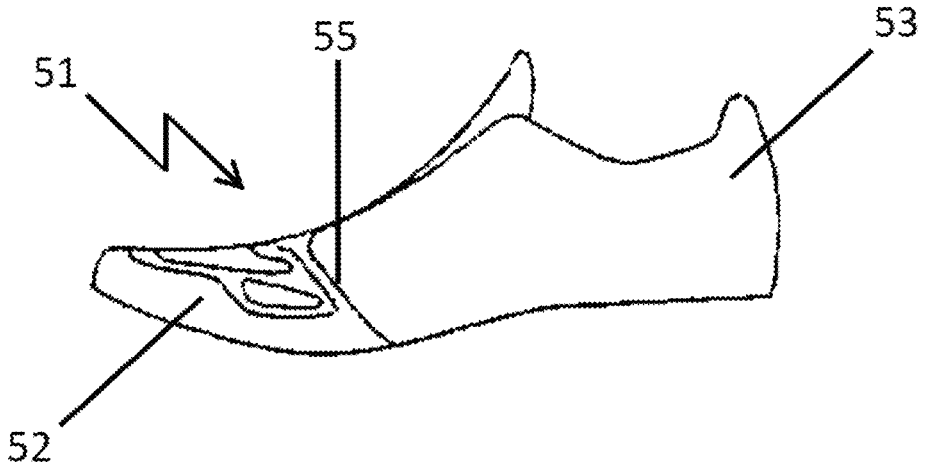
FIG. 5*b* is a side view of an upper with two connected textile areas, according to certain embodiments of the present invention.

Connecting various textile areas, such as parts of knitwear, may occur at quite different locations. For example, the seams for connecting various textile areas of the shoe upper of the soccer shoe according to the invention can be arranged at various positions, as shown in FIGS. 5*a* and 5*b*. An upper 51 is shown in FIG. 5*a* which comprises two textile areas 52 and 53. They are sewn to each other. The seam 54 which connects the two textile areas 52 and 53 runs diagonally from an instep area of the upper to an area of the sole in the transition area from the midfoot to the heel. In FIG. 5*b* the seam 55 also runs diagonally, but it is arranged more to the front in the direction of the toes. Other arrangements of seams and connecting places in general may be utilized. The seams shown in FIGS. 5*a* and 5*b* can each be a thread seam, a glued seam, a welded seam or a linking seam. The two seams 54 and 55 can each be attached only on one side of the upper 51 or on both sides of the upper.

The use of adhesive tape constitutes a further possibility for connecting textile areas. This can also be used in addition to an existing connection, e.g. over a sewn seam or a welded seam. An adhesive tape can fulfill further functions in addition to the function of connecting, such as e.g. protection against dirt or water. An adhesive tape can comprise properties which change over its length.

Figure 6A:
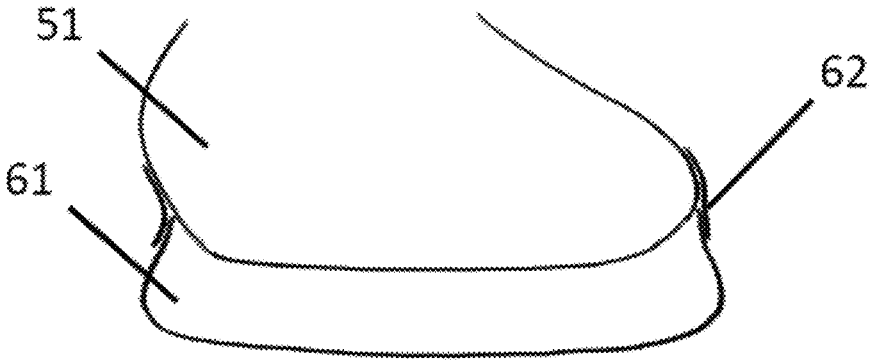
FIGS. 6*a*-6*c* are cross-sectional views of an upper connected to a shoe sole via adhesive tape, according to certain embodiments of the present invention.
Figure 6B:
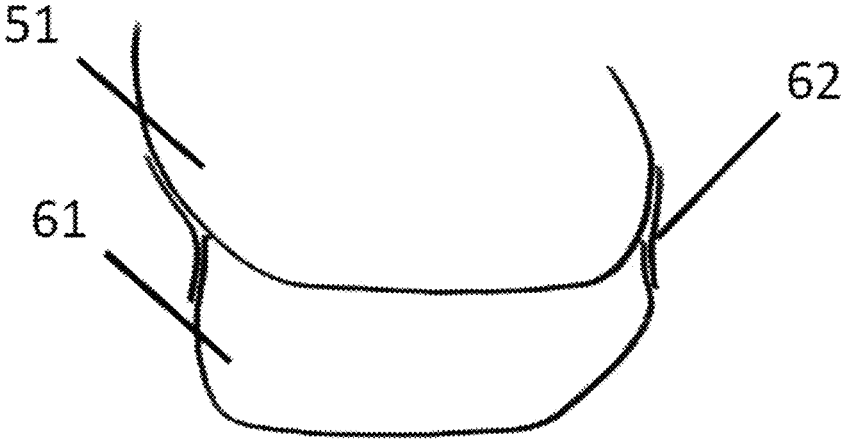
Figure 6C:
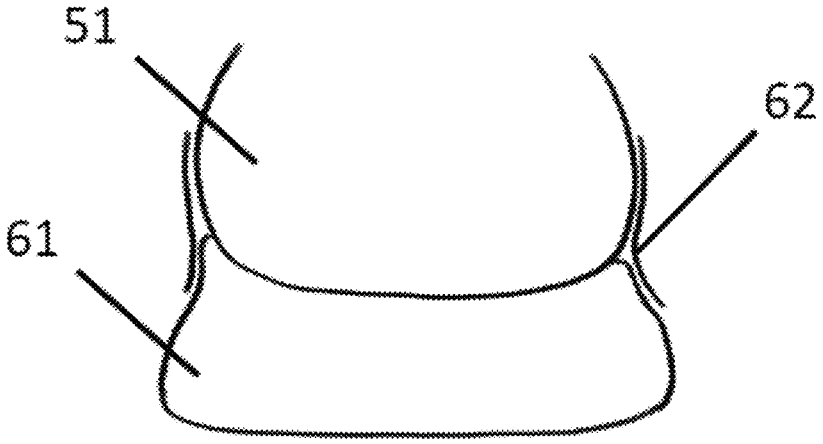

Certain embodiments of an upper 51 connected to a shoe sole 61 by adhesive tape is shown in FIGS. 6*a*, 6*b* and 6*c*. Each of FIGS. 6*a*, 6*b* and 6*c* shows a cross-section through a shoe with different positions of the foot and the deformations of the shoe caused by that. For example, tensile forces work on the right side of the shoe in FIG. 6*a*, whereas compression forces work on the left side.

The shoe sole 61 can be an outer sole or a midsole. The upper 51 and the shoe sole 61 are connected to each other by a surrounding adhesive tape 62. The adhesive tape 62 can be of varying flexibility along its length. For example, the adhesive tape 62 might be particularly rigid and not very flexible in the shoe's heel area in order to provide the shoe with the necessary stability in the heel area. This may be achieved by varying the width and/or the thickness of the adhesive tape 62, for example. The adhesive tape 62 can generally be constructed such that it is able to receive certain forces in certain areas along the tape. In this way, the adhesive tape 62 does not only connect the upper to the sole but simultaneously fulfils the function of structural reinforcement.

Fibers

The yarns or threads used for the knitwear of the present invention usually comprise fibers. As was explained above, a flexible structure which is rather thin in relation to its length is referred to as a fiber. Very long fibers, of virtually unlimited length with regard to their use, are referred to as filaments. Fibers are spun or twisted into threads or yarns. Fibers can also be long, however, and twirled into a yarn. Fibers can consist of natural or synthetic materials. Natural fibers are environmentally friendly, since they are compostable. Natural fibers include cotton, wool, alpaca, hemp, coconut fibers or silk, for example. Among the synthetic fibers are polymer-based fibers such as Nylon™, polyester, elastane or spandex or Kevlar®, which can be produced as classic fibers or as high-performance fibers or technical fibers.

In certain embodiments, a soccer shoe according to the invention may be assembled from various parts, with a weft-knitted or a warp-knitted part comprising natural yarn made from natural fibers and a removable part, e.g. the insole, comprising plastic, for example. In this manner, both parts can be disposed of separately. In this example, the weft-knitted part could be directed to compostable waste, whereas the insole could be directed to recycling of reusable materials, for example.

Figure 7:
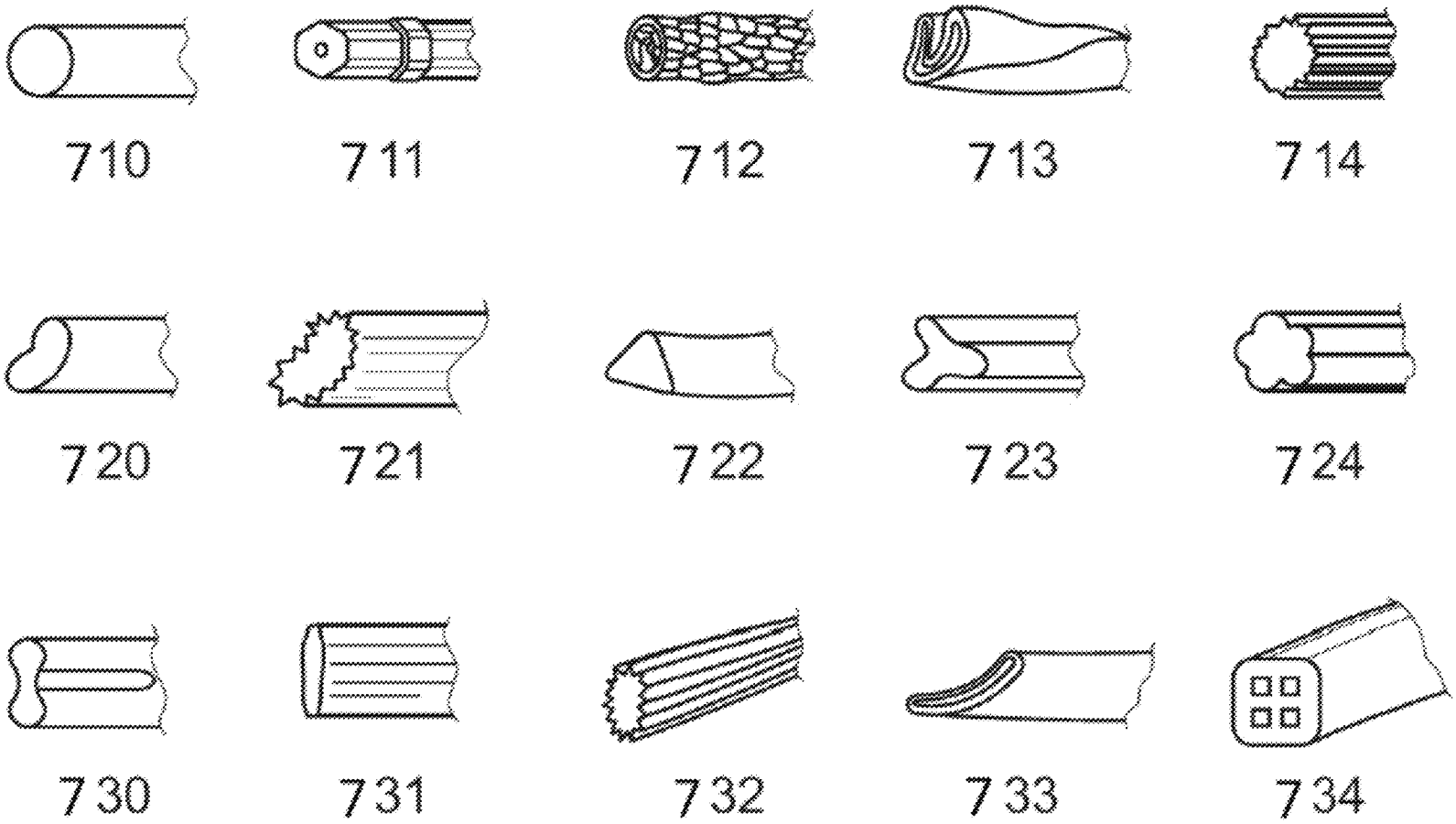
FIG. 7 are cross-sectional views of fibers for yarns used in knitwear, according to certain embodiments of the present invention.

The mechanical and physical properties of a fiber and the yarn manufactured therefrom are also determined by the fiber's cross-section, as illustrated in FIG. 7. These different cross-sections, their properties and examples of materials having such cross-sections will be explained in the following.

A fiber having the circular cross-section 710 can either be solid or hollow. A solid fiber is the most frequent type, it allows easy bending and is soft to the touch. A fiber as a hollow circle with the same weight/length ratio as the solid fiber has a larger cross-section and is more resistant to bending. Examples of fibers with a circular cross-section are Nylon™, polyester and Lyocell.

A fiber having the bone-shaped cross-section 730 has the property of wicking moisture. Examples of materials for such fibers are acrylic and spandex. The concave areas in the middle of the fiber support moisture being passed on in the longitudinal direction, with moisture being rapidly wicked from a certain place and distributed.

The following further cross-sections are illustrated in FIG. 7:

Polygonal cross-section 711 with flowers; example: flax;

Oval to round cross-section 712 with overlapping sections; example: wool;

Flat, oval cross-section with expansion and convolution 713; example: cotton;

circular, serrated cross-section 714 with partial striations; rayon;

lima bean cross-section 720; smooth surface;

Serrated lima bean cross-section 721, example: Avril™ rayon;

triangular cross-section 722 with rounded edges; example: silk;

trilobal star cross-section 723; like triangular fiber with shinier appearance;

Clubbed cross-section 724 with partial striations; sparkling appearance; example: acetate;

flat and broad cross-section 731; example: acetate in another design;

star-shaped or concertina cross section 732;

cross-section 733 in the shape of a collapsed tube with a hollow center; and Square cross-section with voids 734; example: AnsoIV™ nylon.

Individual fibers with their properties which are relevant for the manufacture of knitwear for the present invention will be described in the following:

Aramid fibers: good resistance to abrasion and organic solvents; non-conductive; temperature-resistant up to 500° C.; low flammability.

Para-aramid fibers: known under trade names Kevlar®, Techova™ and Twaron™; outstanding strength-to-weight properties; high Young's modulus and high tensile strength (higher than with meta-aramides); low stretching and low elongation at break (approx. 3.5%).

Meta aramides: known under trade names Numex™, Teijinconex™, New Star™, Fiper™.

Dyneema fibers: highest impact strength of any known thermoplastics; highly resistant to corrosive chemicals, with exception of oxidizing acids; extremely low moisture absorption; very low coefficient of friction, which is significantly lower than that of Nylon™ and acetate and comparable to Teflon; self-lubricating; highly resistant to abrasion (15 times more resistant to abrasion than carbon steel); nontoxic.

Carbon fiber: an extremely thin fiber about 0.005-0.010 mm in diameter, composed substantially of carbon atoms; highly stable with regard to size; one yarn is formed from several thousand carbon fibers; high tensile strength; low weight; low thermal expansion; very strong when stretched or bent; thermal conductivity and electric conductivity.

Glass fiber: high ratio of surface area to weight; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; correlation between bending diameter of the fiber and the fiber diameter; thermal, electrical and sound insulation; higher stretching before it breaks than carbon fibers.

Yarns

A plurality of different yarns can be used for the manufacture of knitwear which is used in the present invention. As was already defined, a structure of one or several fibers which is long in relation to its diameter is referred to as a yarn.

Functional yarns are capable of transporting moisture and thus of absorbing sweat and moisture. They can be electrically conducting, self-cleaning, thermally regulating and insulating, flame resistant, and UV-absorbing, and can enable infrared radiation. They can be suitable for sensorics. Antibacterial yarns, such as silver yarns, for example, prevent odor formation.

Stainless steel yarn contains fibers made of a blend of nylon or polyester and steel. Its properties include high abrasion resistance, high cut resistance, high thermal abrasion, high thermal and electrical conductivity, higher tensile strength and high weight.

In textiles made from knitwear, electrically conducting yarns can be used for the integration of electronic devices. These yarns may, for example, forward impulses from sensors to devices for processing the impulses, or the yarns can function as sensors themselves, and measure electric streams on the skin or physiological magnetic fields, for example. Examples for the use of textile-based electrodes can be found in European patent application EP 1 916 323.

Fuse yarns can be a mixture of a thermoplastic yarn and a non-thermoplastic yarn. There are essentially three types of fuse/melt yarns: a thermoplastic yarn surrounded by a non-thermoplastic yarn; a non-thermoplastic yarn surrounded by thermoplastic yarn; and pure fuse/melt yarn of a thermoplastic material. After being heated to the melting temperature, the thermoplastic yarn fuses with the non-thermoplastic yarn (e.g. polyester or nylon), stiffening the knitwear. The melting temperature of the thermoplastic yarn is determined accordingly and it is usually lower than that of the non-thermoplastic yarn in case of a mixed yarn.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

A further yarn for use in knitwear are luminescent or reflecting yarns and so-called "intelligent" yarns. Examples of intelligent yarns are yarns which react to humidity, heat or cold and alter their properties accordingly, e.g. contracting and thus making the stitches smaller or changing their volume and thus increasing permeability to air. Yarns made from piezo fibers or yarn coated with a piezo-electrical substance are able to convert kinetic energy or changes in pressure into electricity, which can provide energy to sensors, transmitters or accumulators, for example.

Yarns can furthermore generally be reworked, e.g. coated, in order to maintain certain properties, such as stretching, water resistance/water repellence, color or humidity resistance.

Polymer Coating

Due to its structure, weft-knitted or warp-knitted knitwear is considerably more flexible and stretchable than weaved textile materials. For certain applications and requirements, e.g. in certain areas of a shoe upper according to the present invention, it is therefore necessary to reduce flexibility and stretchability in order to achieve sufficient stability.

For that purpose, a polymer layer can be applied to one side or both sides of knitwear (weft-knit or warp-knit goods), but generally also to other textile materials. Such a polymer layer causes a reinforcement and/or stiffening of the knitwear. In a shoe upper in accordance with the present invention, it may, for example, serve the purpose of supporting and/or stiffening and/or reducing elasticity in the toe area, in the heel area, along the lace eyelets, on lateral and/or medial surfaces or in other areas. Furthermore, elasticity of the knitwear and particularly stretchability are reduced.

Moreover, the polymer layer protects the knitwear against abrasion. Furthermore, it is possible to give the knitwear a three-dimensional shape by the polymer coating by compression-molding. The polymer coating may be thermoplastic urethane (TPU), for example.

In the first step of polymer coating, the polymer material is applied to one side of the knitwear. It can also be applied on both sides, however. The material can be applied by spraying on, coating with a doctor knife, laying on, printing on, sintering, ironing on or spreading. If it is polymer material in the form of a film, the latter is placed on the knitwear and connected with the knitwear by heat and pressure, for example. The most important method of applying is spraying on. This can be carried out by a tool similar to a hot glue gun. Spraying on enables the polymer material to be applied evenly in thin layers. Moreover, spraying on is a fast method. Effect pigments such as color pigments, for example, may be mixed into the polymer coating.

The polymer is applied in at least one layer with a thickness of approximately 0.2-1 mm. One or several layers can be applied, with it being possible for the layers to be of different thicknesses and/or colors. For example, a shoe can comprise a polymer coating with a thickness of 0.01 to 5 mm. Furthermore, with some shoes, the thickness of the polymer coating can be in the range of 0.05 to 2 mm. Between neighboring areas of a shoe with polymer coating of various thicknesses there can be continuous transitions from areas with a thin polymer coating to areas with a thick polymer coating. In the same manner, different polymer materials can be used in different areas, as will be described in the following.

During application, polymer material attaches itself to the points of contact or points of intersection, respectively, of the yarns of the knitwear, on the one hand, and to the gaps between the yarns, on the other hand, forming a closed polymer surface on the knitwear after the processing steps described in the following. However, in case of larger mesh openings or holes in the textile structure, this closed polymer surface can also be intermittent, e.g. so as to enable airing. This also depends on the thickness of the applied material: The more thinly the polymer material is applied, the easier it is for the closed polymer surface to be intermittent. Moreover, the polymer material can also penetrate the yarn and soak it and thus contributes to its stiffening.

After application of the polymer material, the knitwear is pressed in a press under heat and pressure. The polymer material liquefies in this step and fuses with the yarn of the textile material.

In a further optional step, the knitwear can be pressed into a three-dimensional shape in a machine for compression-molding. For example the area of the heel or the area of the toes of a shoe upper can be shaped three-dimensionally over a cobbler's last. Alternatively, the knitwear can also be directly fitted to a foot.

After pressing and molding, the reaction time until complete stiffening can be one to two days, depending on the used polymer material.

The following polymer materials can be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

The described polymer coating can be used sensibly wherever support functions, stiffening, increased abrasion resistance, elimination of stretchability, increase of comfort, increase of friction and/or fitting to prescribed three-dimensional geometries are desired. In certain embodiments, the shoe upper in accordance with the present invention may be fitted to the individual shape of the foot of the person wearing it, by polymer material being applied to the shoe upper and then adapting to the shape of the foot under heat.

In addition or alternatively to a reinforcing polymer coating, a knitwear can also be equipped with a water-repellant coating in order to avoid or at least reduce the ingress of humidity into an upper, for example. In this regard, the water-repellant coating can be applied to the entire upper or only to a part thereof, e.g. in the area of the toes. Water-repellant coatings can be based on hydrophobic materials such as polytetrafluoroethylene (PTFE), wax or paraffin. A commercially available coating is Scotchgard™ by 3M.

Monofilaments for Reinforcement

As was already defined, a monofilament is a yarn consisting of one single filament, that is, one single fiber. Therefore, stretchability of monofilaments is considerably lower than that of yarns which are manufactured from many fibers. This also reduces the stretchability of knitwear which are manufactured from monofilaments or comprise monofilaments and which are used in the present invention. Monofilaments are typically made from polyamide. However, other materials, such as polyester or a thermoplastic material, may also be used.

So whereas knitwear made from a monofilament is considerably more rigid and less stretchable, this knitwear, however, does not have the desired surface properties such as e.g. smoothness, colors, transport of moisture, outer appearance and variety of textile structures as usual knitwear has. This disadvantage is overcome by the knitwear described in the following.

Figure 8:
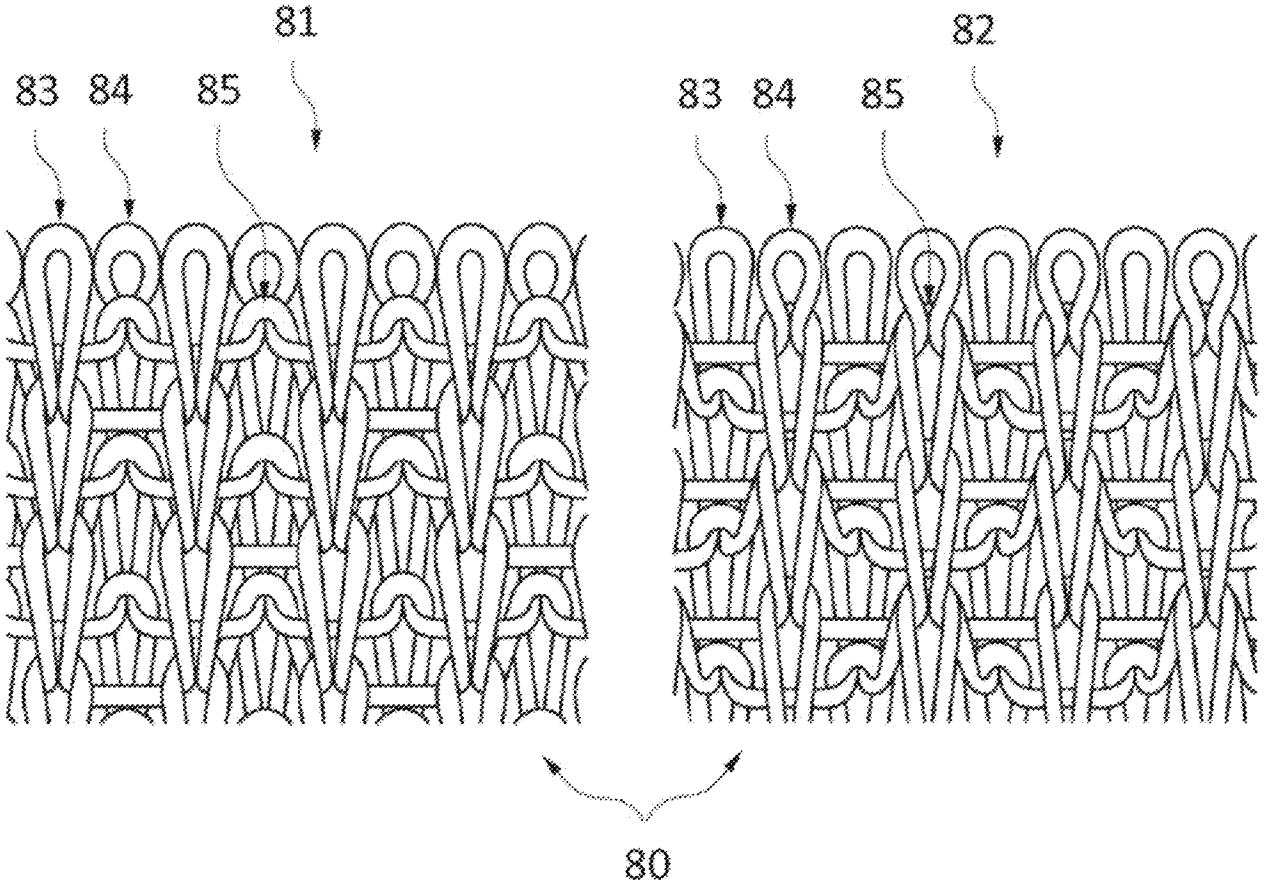
FIG. 8 is a front view and a back view of a knitwear, according to certain embodiments of the present invention.

FIG. 8 depicts a weft-knitted fabric having a weft-knitted layer made from a first yarn, such as a multi-fiber yarn, for example, and a weft-knitted layer made from monofilament. The layer of monofilament is weft-knitted into the layer of the first yarn. The resulting two-layered knitwear is considerably more solid and less stretchable than the layer made from yarn alone.

FIG. 8 particularly depicts a front view 81 and a back view 82 of a two-layered knitwear 80. Both views show a first weft-knitted layer 83 made from a first yarn and a second weft-knitted layer 84 made from monofilament. The first textile layer 83 made from a first yarn is connected to the second layer 84 by stitches 85. Thus, the greater solidness and smaller stretchability of the second textile layer 84 made from the monofilament is transferred to the first textile layer 83 made from the first yarn.

A monofilament can also be begun to be melted slightly in order to connect with the layer of the first yarn and limit stretching even more. The monofilament then fuses with the first yarn at the points of contact and fixates the first yarn with respect to the layer made from monofilament.

Combination of Monofilaments and Polymer Coating

The weft-knitted fabric having two layers described in the preceding section can additionally be reinforced by a polymer coating as was already described in the section "polymer coating". The polymer material is applied to the weft-knitted layer made from monofilament. In doing so, it does not connect to the material (e.g. polyamide material) of the monofilament, since the monofilament has a very smooth and round surface, but substantially penetrates the underlying first layer of a first yarn (e.g. polyester yarn). During subsequent pressing, the polymer material therefore fuses with the yarn of the first layer and reinforces the first layer. In doing so, the polymer material has a lower melting point than the first yarn of the first layer and the monofilament of the second layer. The temperature during pressing is selected such that only the polymer material melts but not the monofilament or the first yarn.

Fuse Yarn

For reinforcement and for the reduction of stretching, the yarn of the knitwear which is used according to the invention can additionally or alternatively also be a melted yarn which fixes the knitwear after pressing. There are essentially three types of fuse/melt yarns: a thermoplastic yarn surrounded by a non-thermoplastic yarn; a non-thermoplastic yarn surrounded by thermoplastic yarn; and pure fuse/melt yarn of a thermoplastic material. In order to improve the bond between thermoplastic yarn and the non-thermoplastic yarn, it is possible for the surface of the non-thermoplastic yarn to be texturized.

Pressing may take place at a temperature ranging from 110 to 150° C., and may further take place at 130° C. The thermoplastic yarn melts at least partially in the process and fuses with the non-thermoplastic yarn. After pressing, the knitwear is cooled, so that the bond is hardened and fixed. The fuse yarn may be arranged in the entire knitwear or only in selective areas.

In certain embodiments, the fuse yarn is weft-knitted or warp-knitted into the knitwear. In case of several layers, the melted yarn can be weft-knitted into one, several or all layers of the knitwear.

In further embodiments, the melt yarn can be arranged between two layers of knitwear. In doing so, the melt yarn can simply be placed between the layers. Arrangement between the layers has an advantage that the mold is not stained during pressing and molding, since there is no direct contact between the melt yarn and the mold.

Thermoplastic Textile for Reinforcement

A further possibility for reinforcing knitwear which is used for the present invention is the use of a thermoplastic textile. This is a thermoplastic woven fabric or thermoplastic knitwear. A thermoplastic textile melts at least partially subject to heat and stiffens as it cools down. A thermoplastic textile may, for example, be applied to the surface of the knitwear by applying pressure and heat. When it cools down, the thermoplastic textile stiffens and specifically reinforces the shoe upper in the area in which it was placed, for example.

The thermoplastic textile can specifically be manufactured for the reinforcement in its shape, thickness and structure. Additionally, its properties can be varied in certain areas. The stitch structure, the knitting stitch and/or the yarn used can be varied such that different properties are achieved in different areas.

In certain embodiments, a thermoplastic textile is a weft-knitted fabric or warp-knitted fabric made from thermoplastic yarn. Additionally, the thermoplastic textile can also comprise a non-thermoplastic yarn. The thermoplastic textile may be applied to the shoe upper of the soccer shoe according to the invention, for example, by pressure and heat.

A woven fabric whose wefts and/or warps are thermoplastic are further embodiments of a thermoplastic textile. Different yarns can be used in the weft direction and the warp direction pf the thermoplastic woven fabric, so as to achieve different properties, such as stretchability, in the weft direction and the warp direction.

A spacer weft-knitted fabric or spacer warp-knitted fabric made from thermoplastic material are further embodiments of a thermoplastic textile. In this regard, only one layer may be thermoplastic, for example, e.g. so as to be attached to the shoe upper of the soccer shoe according to the invention. Alternatively, both layers are thermoplastic, e.g. in order to connect the sole to the upper.

A thermoplastic weft-knitted fabric or warp-knitted fabric can be manufactured using the manufacturing techniques for knitwear described in the section "knitwear".

A thermoplastic textile can be connected with the surface to be reinforced only partially subject to pressure and heat so that only certain areas or only a certain area of the thermoplastic textile connects to the surface. Other areas or another area do not connect, so that the permeability for air and/or humidity is maintained there, for example. The function and/or the design of the shoe upper of the soccer shoe according to the invention can be modified by this.

Flat Weft-Knitted Upper

Figure 9:
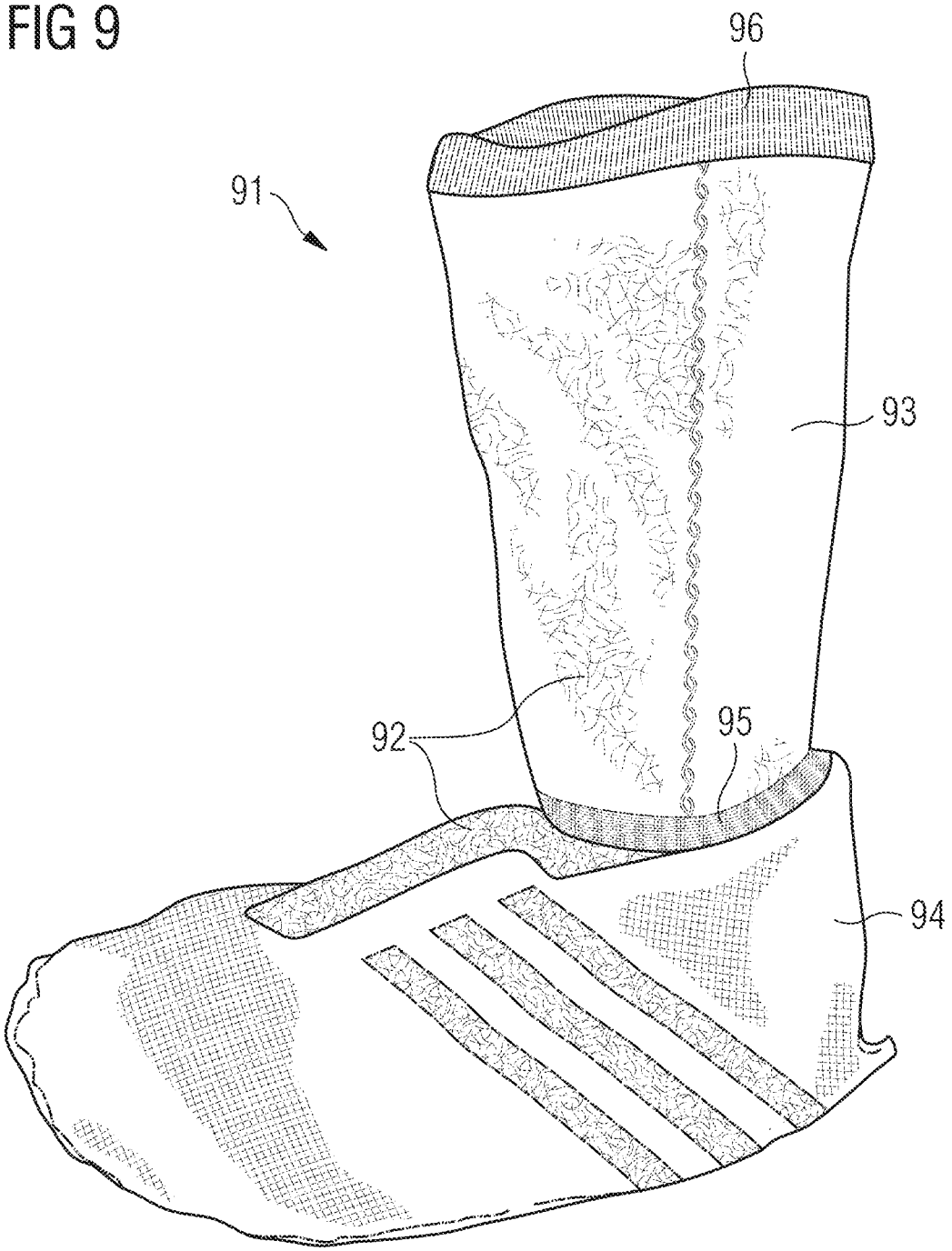
FIG. 9 is perspective view of an upper, according to certain embodiments of the present invention.

FIG. 9 shows embodiments of an upper 91 according to the present invention. The upper 91 shown in FIG. 9 comprises flat weft-knitted knitwear 92. The knitwear 92 can be manufactured on a suitable flat weft-knitting machine. In a flat weft-knitting machine, a thread feeder feeds the thread back and forth along one or several beds of needles.

The flat weft-knitted knitwear 92 of the upper 91 according to the invention forms a top portion 93 and a bottom portion 94 of the upper. The top portion 93 is positioned essentially above the bottom portion 94 when the sports shoe in which the upper 91 is used is standing. In other words, the top portion 93 is located closer to the edge of foot opening than the bottom portion 94, with the foot opening being the opening through which a foot is inserted when the sports shoe is put on. The top portion 93 and the bottom portion 94 can be directly adjacent to one another or they can be spaced from one another. In the embodiments of FIG. 9, the top portion 93 and the bottom portion 94 are adjacent to one another.

The top portion 93 shown in FIG. 9 is formed as tube weft-knitted knitwear such that it is suitable for surrounding a part of the shank of the wearer of the sports shoe. Tube weft-knitted knitwear is two-ply knitwear which was manufactured on a flat weft-knitting machine with at least two beds of needles and the two plies of which are only connected on the edges. Thus, tube weft-knitted knitwear is created when the stitches created on a first bed of needles are weft-knitted to the stitches created on a second bed of needles merely on the edge of the weft-knitted fabric.

The bottom portion 94 of the upper 91 according to the invention is suitable for covering at least a part of a foot of the wearer of the sports shoe. In the embodiments of FIG. 9, the bottom portion 94 covers the foot essentially completely, i.e. from the toes to below the ankle, for example. However, in certain embodiments, the bottom portion 94 may not cover the entire foot or may at least partially not comprise knitwear but another material in another area. For example, the upper can comprise a front portion, e.g. in the area of the toes, which is not formed as knitwear but comprises leather or artificial leather, for example.

In the embodiments of FIG. 9, the knitwear 92 is formed as single-surface knitwear. Thus, the top portion 93 and the bottom portion 94 are weft-knitted on a flat weft-knitting machine in one go and connected to one another in the process in the area specified with reference number 95. However, in certain embodiments, the top portion 93 and the bottom portion 94 may be manufactured as separate knitwear and subsequently connected to one another by linking. In linking, two edges of knitwear are connected to each other according to the stitches (usually stitch by stitch). Due to this, no seam or at most a seam which only adds a little thickness is created at the connecting line 95 of the top portion 93 and the bottom portion 94.

Alternatively, the top portion 93 and the bottom portion 94 can be manufactured separately and connected to one another by ultrasonic welding or other connecting techniques. Additionally, the welded seam can be covered by a band of adhesive material (e.g. thermoplastic or duroplastic (thermoset) material or adhesive, etc.). The band can be arranged on the inside of the upper 91. Alternatively or additionally, the band can be arranged on the outside of the upper 91.

In some embodiments, the top portion 93 and the bottom portion 94 may be sewn or glued together. The seam can also be covered by a band as described before in this case.

In the embodiments of FIG. 9, the top portion 93 and the bottom portion 94 are adjacent to one another below an ankle (not shown in the Figure) of a wearer of the sports shoe in the area specified with reference number 95. In certain embodiments, however, the top portion 93 and the bottom portion may be adjacent to one another in another area of the foot, e.g. above the ankle.

Since the embodiments of FIG. 9 are single-surface knitwear 92, both the knitwear of the top portion 93 and that of the bottom portion 94 are weft-knitted on a flat weft-knitting machine with two beds of needles. In this regard, the top portion 93 is weft-knitted as a tube, i.e. the stitches of the two plies of the knitwear are only connected to one another at the edges. The bottom portion 94 is weft-knitted as a two-ply knitwear, whose plies are connected to one another, in the embodiments of FIG. 9. When weft-knitting from the top end, i.e. from the opening for the foot, the two plies of the top portion 93, which are only connected at the edge, therefore pass into two plies which are consistently connected to one another in the area of the transition 95 to the bottom portion 94. If the upper is weft-knitted from its sole end, the two consistently connected plies of the bottom portion 94 pass into two plies of the top portion 93, which are only connected at the edge, in the area of the transition 95 to the top portion 93.

In the embodiments of FIG. 9, the bottom portion is therefore formed as two-ply knitwear. If the top portion 93 and the bottom portion 94 are knitted separately and connected to one another subsequently, the knitwear of the bottom portion 94 can also be one-ply knitwear, i.e. knitwear which was weft-knitted on only one bed of needles.

In the embodiments of FIG. 9, the top portion 93, at its upper edge, comprises an elastic cuff 96 formed integrally with the knitwear 92. The cuff 96 is therefore also knitwear. In this regard, the cuff 96 can e.g. comprise a particularly elastic knitting stitch (e.g. single Jersey) and additionally or alternatively comprise an elastic yarn, e.g. based on elastane. In certain embodiments, the cuff 96 may be manufactured separately and subsequently connected to the upper 91 by sewing, welding or linking.

In the embodiments of FIG. 9, the top portion 93 is adjusted to the anatomical conditions of a shank of a wearer of the sports shoe. The human shank is tapered towards the ankle. Accordingly, the circumference of the top tube weft-knitted portion 93 increases from the transition area 95 to the portion 94 towards the top end, at which the cuff 96 is located. Thus, the top portion 93 is tapered from the top edge of the upper towards the ankle. Such a variation of the circumference can be realized on a flat weft-knitting machine by altering the number of stitches along the length of the top portion 93.

In the embodiments of FIG. 9, the top portion 93 is elastic and exerts pressure on at least a part of the shank. Elasticity can be caused by the type of knitting stitch. For example, the top portion 93 can be weft-knitted as single Jersey. Additionally or alternatively, an elastic yarn can also be used.

The exerted pressure can be adjusted to the sport for which the sports shoe is used. For example, the foot can, for example, be provided with better support by higher pressure in case of a tennis shoe, which is subject to high accelerations due to abrupt decelerations and accelerations. In case of a running shoe, which is usually not subject to such high accelerations as a tennis shoe is, less pressure on the shank is sufficient.

The exerted pressure can additionally or alternatively be adjusted to the respective wearer of the sports shoe. Depending on their personal preferences, the wearer can decide on more or less pressure on the shank by the top portion 93.

Figure 10:
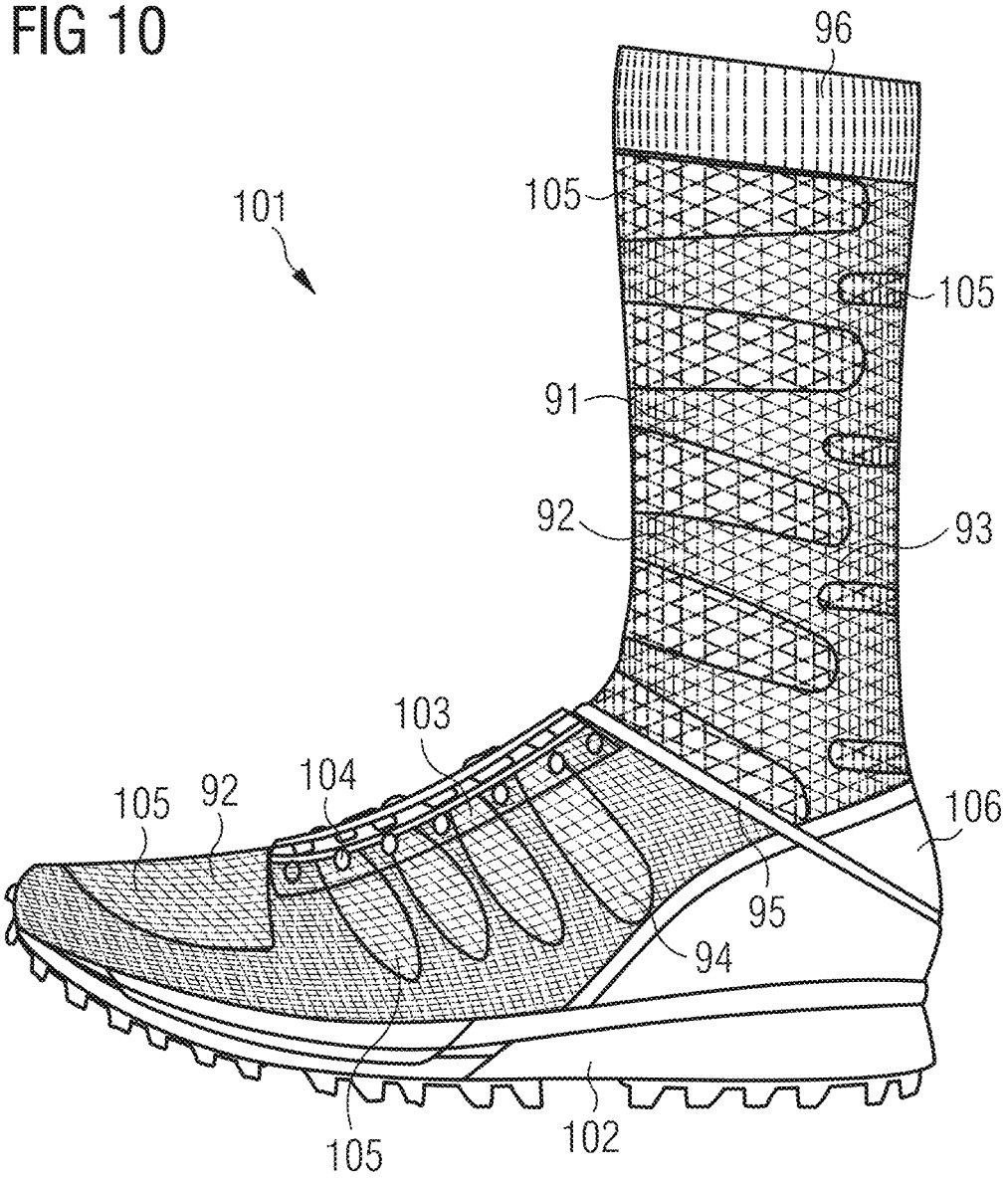
FIG. 10 is a side view of a sports shoe with an upper, according to certain embodiments of the present invention.

FIG. 10 shows embodiments of a sports shoe 101 according to the invention which comprises an upper 91 according to the invention and a sole 102 connected to the upper 91. As shown in the embodiments of FIG. 10, the sole 102 can comprise a midsole and an outsole. Additionally, the sports shoe 101 can comprise an insole (not shown in FIG. 10). In certain embodiments, the sole may be a one-piece element fulfilling the function of an outsole, midsole and insole, if applicable. The sole 102 can e.g. be manufactured from EVA (ethylene vinyl acetate), rubber, extruded polyurethane (eTPU), extruded polyether block amide (ePEBA) or other plastics. In certain embodiments, the sole 102 may be manufactured from knitwear.

In the embodiments of FIG. 10, the outsole is treaded. Depending on the use of the sports shoe 101, the outsole can be strongly treaded, less strongly treaded or not treaded at all. If the sports shoe 101 is a soccer shoe, the sole 102 can comprise studs.

The sole 102 can be connected to the upper 91 e.g. by gluing, sewing or ultrasonic welding. If the sole 102 is manufactured from knitwear, the sole 102 can be weft-knitted integrally with the bottom portion 94 of the upper 91.

In the embodiments of FIG. 10, the bottom portion 94 comprises at least one lace bar 103, formed integrally with the knitwear 92, with at least one lace eyelet 104. In certain embodiments, the lace bar 103 may be manufactured separately and connected to the upper 91 by e.g. sewing, gluing, welding or linking. In the embodiments of FIG. 10, the lace bar is formed as a ply of the two-ply knitwear 92 of the bottom portion 94. The second ply of the knitwear 92 assumes the function of a tongue.

In the embodiments of FIG. 10, the at least one lace eyelet 104 is weft-knitted into the lace bar 103. Thus, the lace eyelet 104 is formed as the lace bar 103 is weft-knitted. In certain embodiments, the lace eyelet 104 may be subsequently formed in the lace bar 103, for example by punching. The lace bar 103 can comprise any desired number of lace eyelets.

The knitwear 92 of the upper 91 of FIG. 10 is also partially provided with a polymer coating. In the areas of which four are specified by reference number 105 by way of example, the knitwear 92 is not provided with a polymer coating. In the other areas, the knitwear 92 is provided with a polymer coating. The arrangement of the coated and uncoated areas can also differ from the arrangement shown in FIG. 10 on principle, or the knitwear 92 does not comprise any polymer coating.

The polymer coating can be a coating as described in the section "Polymer coating" and it can be processed as described therein. Instead of a polymer coating, a thermoplastic textile can also be used as reinforcement, as described in the corresponding section. The statements made with regard to the polymer coating then apply analogously with regard to the arrangement of reinforced and non-reinforced areas.

In the embodiments of FIG. 10, the knitwear is coated with polymer especially along the back shank area from the top cuff 96 to the heel area, i.e. in the area of the Achilles' tendon, and along the area adjacent to the sole. The coated areas extend from there, finger-like, to the area of the shin or the instep. This arrangement of coated and uncoated areas allows the upper 91 to be provided with stability, on the one hand, and to maintain its flexibility when walking or running, on the other hand.

The upper 91 of FIG. 10 furthermore comprises a reinforcement 106 in the heel area. The reinforcement 106 can e.g. be manufactured from polyurethane, EVA or rubber. The reinforcement 106 can e.g. be glued or welded to the upper 91. Additionally or alternatively, the upper 106 can comprise reinforcements in other areas, e.g. in the toe area.

Figure 11:
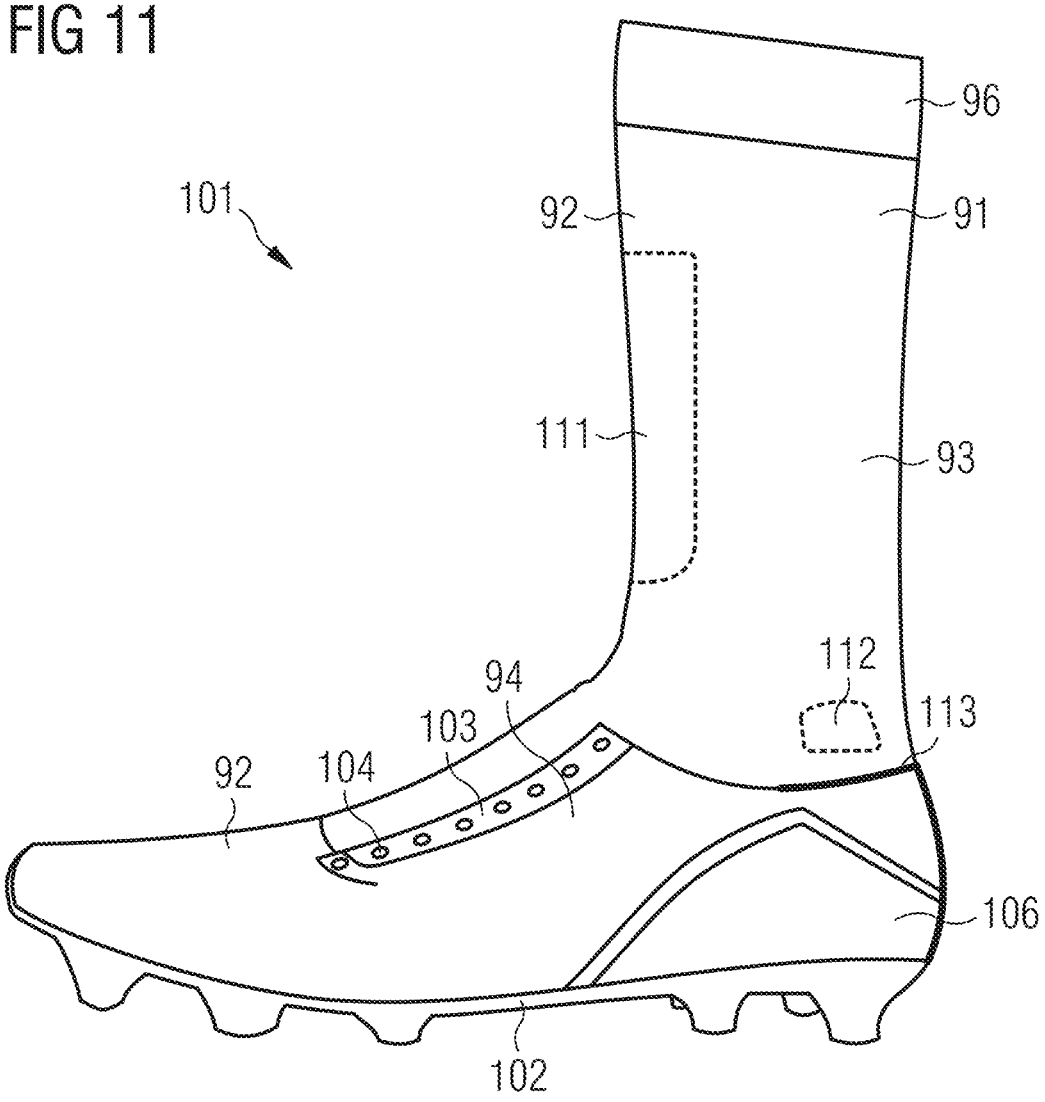
FIG. 11 is a side view of a sports shoe with an upper, according to certain embodiments of the present invention.

FIG. 11 shows further embodiments of a sports shoe 101 according to the invention with an upper 91 according to the invention in a schematic representation. The sports shoe 101 shown in FIG. 11 is particularly suitable for sports like soccer or rugby, since its sole 102 comprises studs. On principle, however, the sports shoe 101 can also comprise no studs but only a tread or no tread.

In addition to the embodiments of FIG. 10, the upper 91 comprises a pocket 111 in FIG. 11. A shin guard can be inserted into the pocket 111, for example. The pocket 111 can be manufactured from knitwear. The pocket 111 can be formed integrally with the knitwear 92 of the top portion 94, i.e. it can be weft-knitted in one working step as a ply of the knitwear 92. The pocket can, for example, be knitted in a third row of the weft-knitting machine, whereas the tube weft-knitted knitwear 92 of the top portion 94 is weft-knitted on the first and second rows of the knitwear. Alternatively, the pocket can also be weft-knitted as a third ply of the two-ply tube weft-knitted knitwear 92 of the top portion 93 with every other needle of a first or second row of a flat weft-knitting machine. Further alternatively, the pocket 111 is manufactured separately, e.g. as knitwear, and subsequently connected to the top portion, e.g. by sewing, gluing, welding or linking.

In the embodiments of FIG. 11, the top portion 93 comprises an inner clasp 112. The clasp 112 e.g. enables a padding (e.g. on the basis of gel or foam) to be fastened, which pads the heel and increases comfort and stability. The clasp 112 can also be used for fastening a warming or cooling pack.

In the embodiments of FIG. 11, the top portion 93 and the bottom portion 94 are formed as single-surface knitwear 92. Since in flat weft-knitting, transitions of more than 180° cannot be realized as connected knitwear, the first portion 93 and the second portion 94 are additionally connected in the heel area by a seam 113. The seam 113 can be formed by linking of the top portion 93 and the bottom portion 94 or e.g. by ultrasonic welding. An advantage of linking is that the seam is not perceivable at all or hardly perceivable and that the knitting patters of the portions are connected to one another stitch by stitch. In certain embodiments, the top portion 93 may be sewn to the bottom portion 94 in the area of the seam 103.

Figure 12:
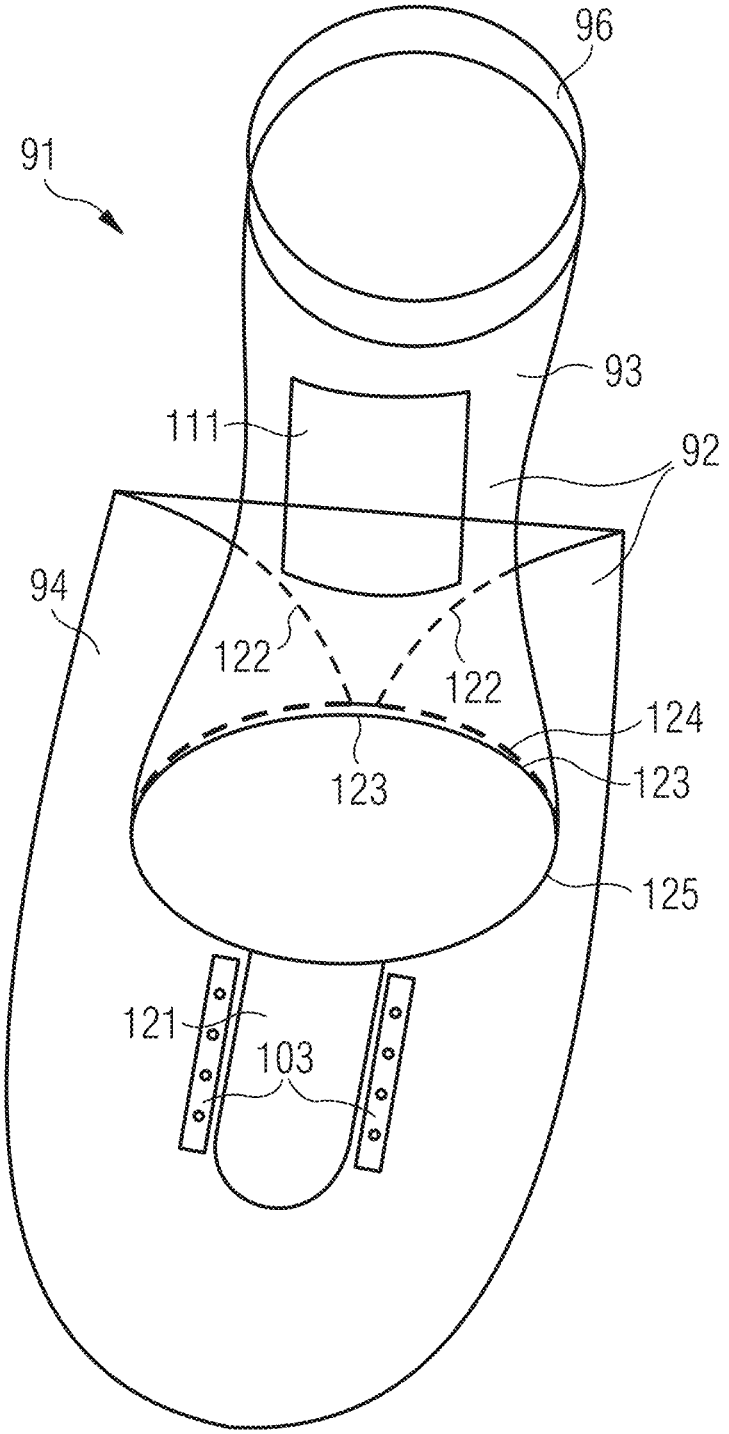
FIG. 12 is a top view of an upper, according to certain embodiments of the present invention.

FIG. 12 shows a schematic view of an upper 91 according to the invention. In these embodiments, the bottom portion 94 comprises two lace bars 103. The lace bars 103 can be formed integrally with the knitwear 92 of the bottom portion 94. In certain embodiments, however, the lace bars 103 may be manufactured separately and connected to the upper 91 by e.g. sewing, gluing, welding or linking.

In the embodiments of FIG. 12, the lace bars 103 are formed as a first ply of the two-ply knitwear 92 of the bottom portion 94. The area 121 between the lace bars 103 is formed as two-ply knitwear 92 and assumes the function of a tongue. The area 121 can be more elastic than other areas of the upper. The area 121 can comprise an elastic stitch, e.g. single Jersey or double Jersey. Additionally or alternatively, an elastic yarn can also be used in the area 121. Instead of single Jersey, rib fabric or purl fabric can also be used.

FIG. 12 shows the connection between the top portion 93 and the bottom portion 94. As shown in FIG. 12, the top portion 93 is weft-knitted integrally with the bottom portion 94 in part. The integrally weft-knitted part 125 can constitute approximately 50% of the length of the connection between the top portion 93 and the bottom portion 94. Alternatively, the integrally weft-knitted part 125 can constitute at least 25% of the length of the connection between the top portion 93 and the bottom portion 94. As shown in FIG. 12, the unconnected part 123 of the top portion 93 can be connected to the bottom portion 94 using the edge parts 124. The edges 122 can be connected by sewing, welding or any other known connecting method so as to form a seam near the heel. Alternatively, the edges 122 can be weft-knitted into shape as shown together or weft-knitted in a straight manner.

Figure 13A:
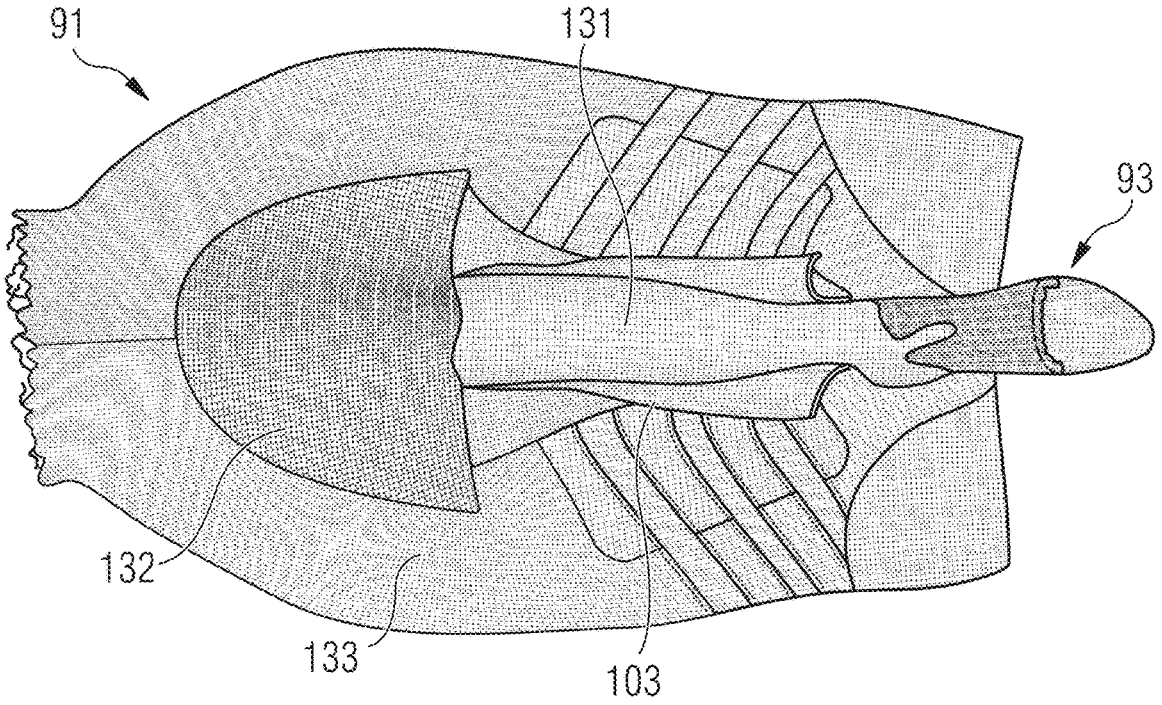
FIG. 13*a* is a top view of an upper, according to certain embodiments of the present invention.
Figure 13B:
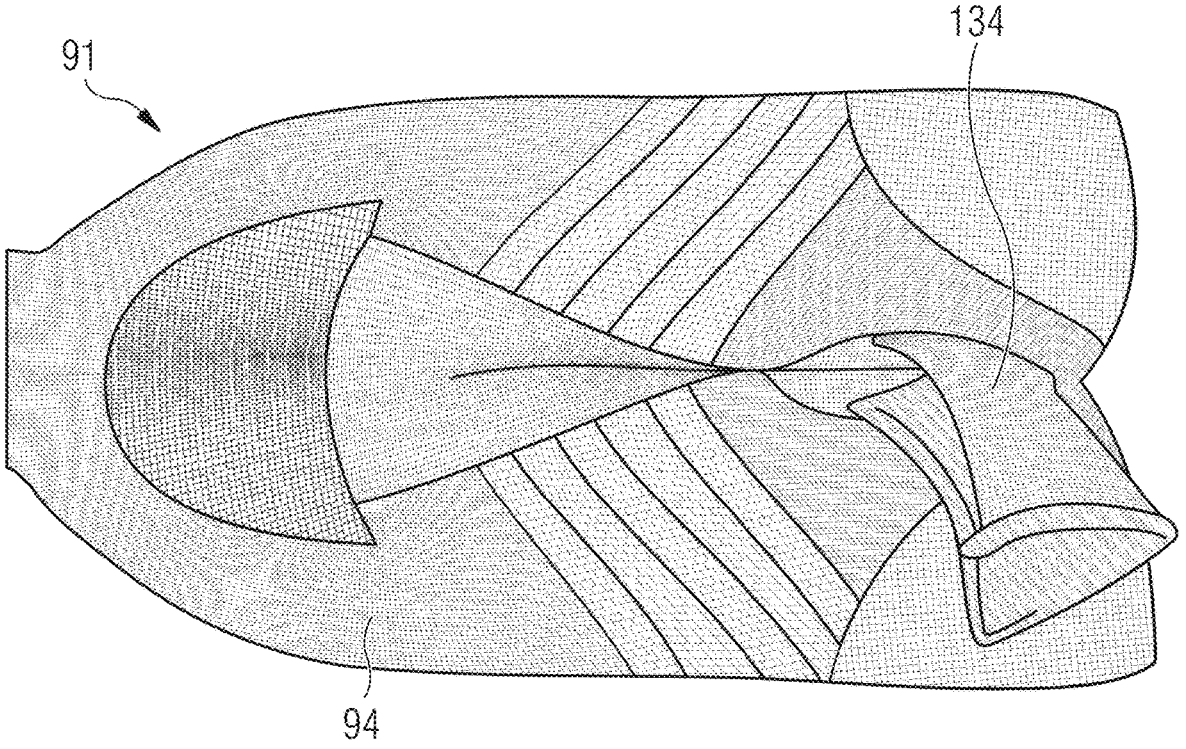
FIG. 13*b* is an inside view of the upper of FIG. 13*a*.
Figure 13C:
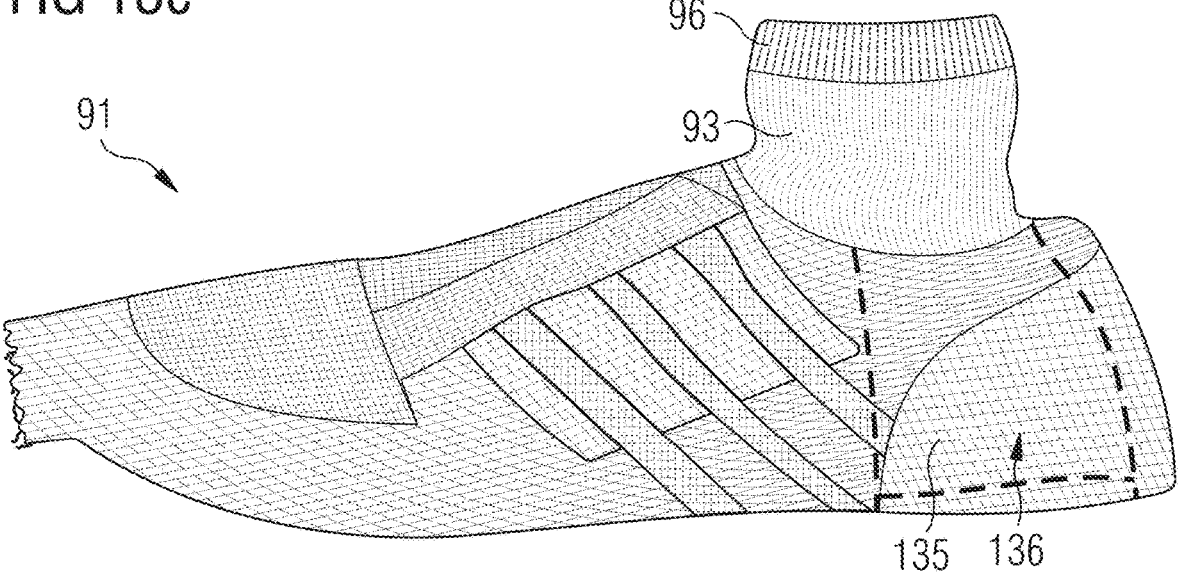
FIG. 13*c* is a side view of the upper of FIG. 13*a*.

FIGS. 13*a*, 13*b* and 13*c* show further embodiments of an upper 91 according to the invention. In this regard, FIG. 13*a* shows a top view, FIG. 13*b* shows an inside view and FIG. 13*c* shows a side view.

In these embodiments, the upper 91 comprises an elastic instep area 131. In the area of the forefoot, the knitwear comprises two areas 132 and 133, with the stitch structure in the area 132 being different from the stitch structure of the area 133. The lace bar 103 is formed integrally with the knitwear of the upper 91. The top portion 93 of the upper 91 is formed as a tube weft-knitted knitwear and comprises an elastic cuff 96, which can be of different elasticity than the area 93 lying below it.

As shown in FIG. 13*b*, the tube weft-knitted knitwear of the top portion 93 continues below the bottom portion 94 and forms a heel lining 134, which at surrounds at least part of a heel of a wearer, within the upper 91. Thus, the heel lining 134 provides additional padding. In the side view of FIG. 13*c*, the course of the heel lining 134 in the area 135 is suggested by the dashed line. The upper 91 further comprises a heel pocket in the area specified with reference number 136.

Figure 14:
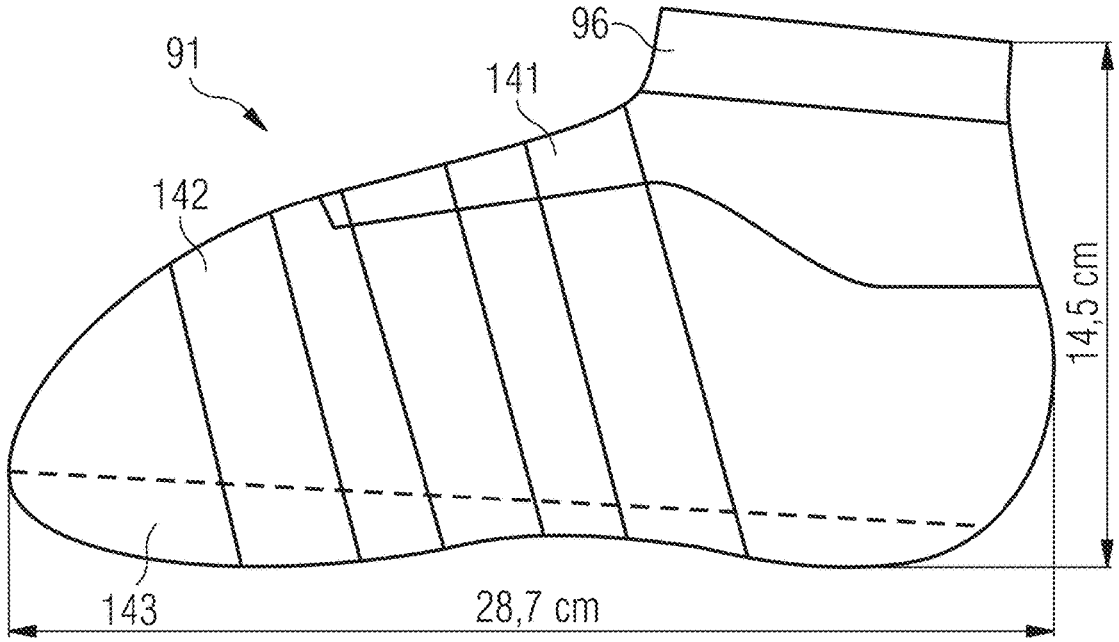
FIG. 14 is a schematic side view of an upper, according to certain embodiments of the present invention.

FIG. 14 shows further embodiments of an upper 91 according to the invention. As shown in that Figure, the upper 91 can comprise several zones with different properties. In the case of the upper 91 shown in FIG. 14, the upper 91 can comprise a single layer when two beds of needles are used in the manufacture of the upper 91. For example, weft-knitting the upper 91 can start at the cuff 96 and run along portions 141 and 142 to the bottom area 143 of the upper 91. In this regard, area 141 comprises an elastic weft-knitted fabric, whereas area 142 comprises a rigid weft-knitted fabric.

The area 143 is an example of a strobel sole replacement which can be flat weft-knitted and then connected to the weft-knitted upper. For example, the area 143 can be connected with an upper by a seam near the dashed line. Furthermore, in some embodiments a weft-knitted insole and/or outsole can be provided and connected with the upper. These flat weft-knitted parts (e.g. strobel sole, insole and/or outsole) can include elastic yarns in some embodiments.

When manufacturing the upper 91, every bed of needles can be used for weft-knitting a side of the upper 91, for example the lateral side and the medial side. During knitting of the upper 91, the sides of the upper 91 are connected with one another at the ends of the bed of needles. For example, the lateral side can be connected to the medial side by the stitches being transferred between the beds of needles, i.e. being shifted from one bed of needles to the respective other bed of needles. Once weft-knitting of the upper 91 is completed, the open stitches on the beds of needles can also be linked so as to form the upper 91.

Alternatively, some embodiments of a weft-knitted upper 91 can be manufactured using additional beds of needles so as to increase the number of plies on one or both sides of the upper 91. Additional layers can provide additional padding, allow the manufacture of structures (e.g. support, strips, bands, pockets, etc.) and allow the selection of predetermined properties in the shoe such as heat-transport properties, regulation of humidity, etc.

Instead of being manufactured by several beds of needles, additional layers can also be manufactured on a single bed of needles, by each nth (e.g. each second or third) needle being responsible for a single ply. Needles which are responsible for a certain ply can use a separate thread feeder and/or a different yarn. A different thread feeder could be used for the 1st, 3rd, 5th, etc. needle than for the 2nd, 4th, 6th, etc. needle, for example. A first ply of the knitwear is then manufactured on needles 1, 3, 5, etc. while a second ply of the knitwear is simultaneously manufactured on needles 2, 4, 6, etc.

In a further example, an upper can be weft-knitted using two or more beds of needles. A first bed of needles can be used for weft-knitting a first side of an upper 91 with a first length and the second bed of needles can be used for weft-knitting the second side of the upper 91 with a shorter second length. The two sides can also be connected with one another by linking. In some embodiments, weft-knitting can be continued after linking on at least one side, so as to obtain an additional weft-knitted portion which continues on from the linking area. This additional weft-knitted area can e.g. be used for providing additional support in a part of the upper, for enveloping the midsole and/or for creating structures (e.g. strips, bands, pockets) on the upper 91.

Figure 15:
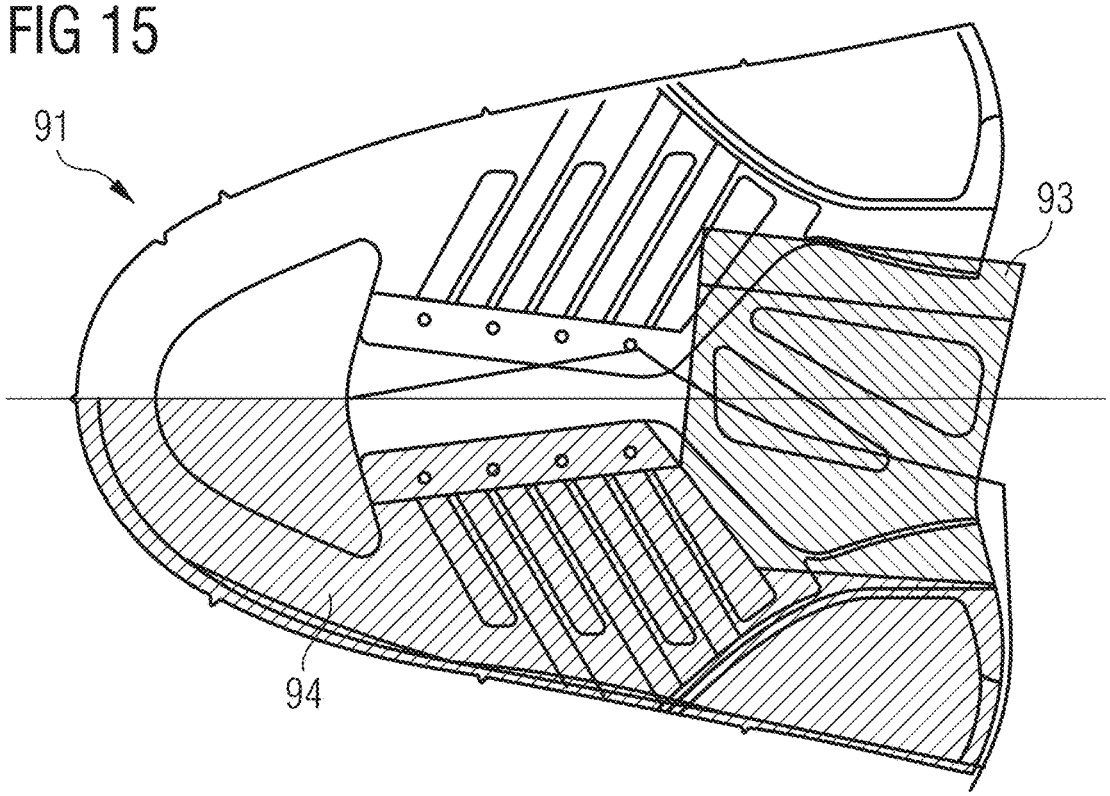
FIG. 15 is a schematic view of an upper, according to certain embodiments of the present invention.
Figure 16:
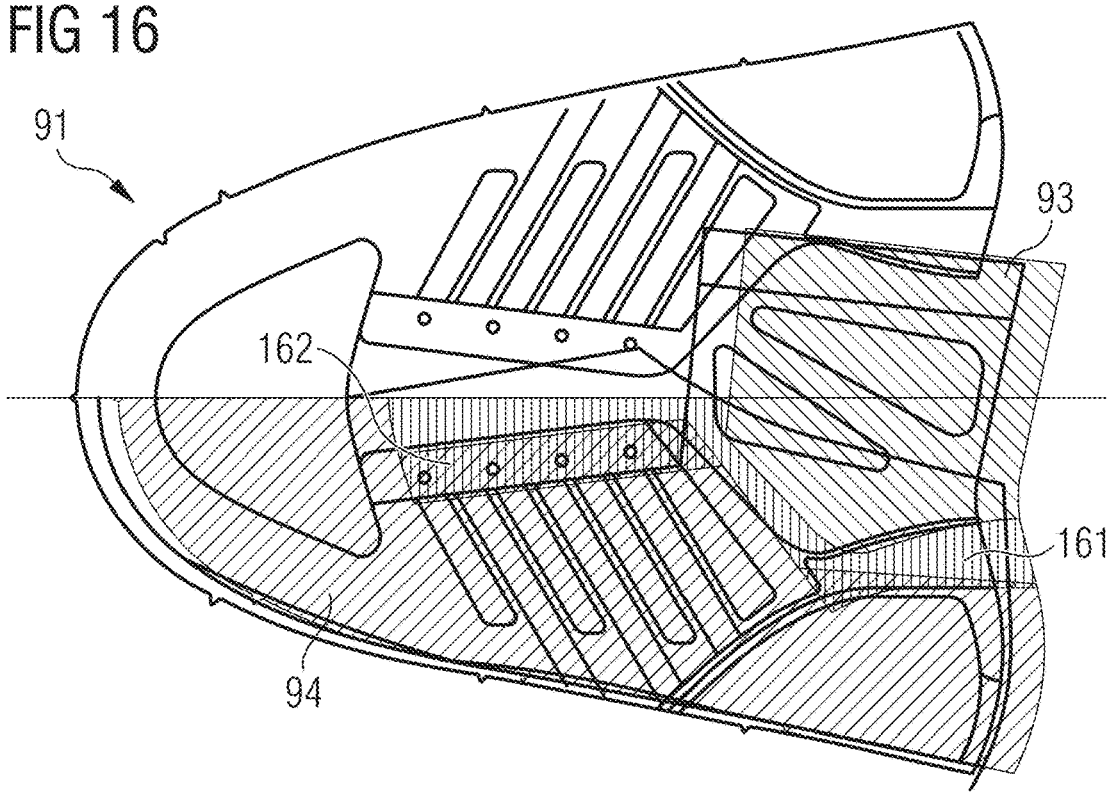
FIG. 16 is a schematic view of an upper, according to certain embodiments of the present invention.
Figure 17:
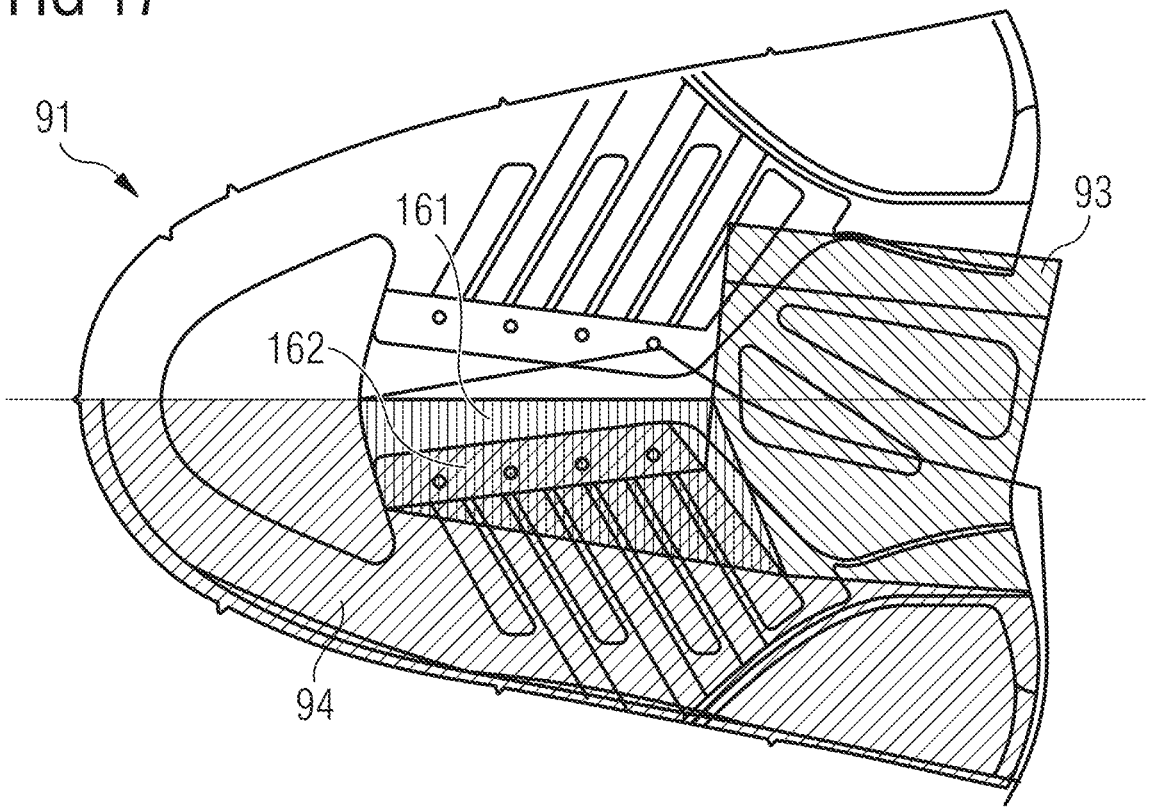
FIG. 17 is a schematic view of an upper, according to certain embodiments of the present invention.

FIGS. 15, 16 and 17 show further embodiments of an upper according to the invention. The uppers 91 shown in FIGS. 15, 16 and 17 comprise a tube weft-knitted top portion 93 and a bottom portion 94. In the embodiments of FIGS. 16 and 17, the upper 91 further comprises a portion 161, which comprises flat weft-knitted, elastic knitwear. The portion 161 is partially arranged in the instep area and assumes the function of a tongue there. The portion 161 overlaps with the bottom portion in the area 162.

A method for manufacturing an upper according to the invention comprises the following steps: Flat weft-knitting the knitwear such that the flat weft-knitted knitwear forms a top portion and a bottom portion of the upper; forming the top portion as tube weft-knitted knitwear such that it is suitable for surrounding a part of the shank of a wearer of the sports shoe; and forming the bottom portion such that it is suitable for covering at least a part of a foot of the wearer of the sports shoe.

On principle, all described embodiments can be combined with one another, i.e. the features of one embodiment together with the features of another embodiment constitute a further embodiment of the invention.

In the following, further examples are described to facilitate the understanding of the invention:

1. Upper (91) for a sports shoe, comprising:
   flat weft-knitted knitwear (92),
   wherein the flat weft-knitted knitwear (92) forms a top portion (93) and a bottom portion (94) of the upper (91),
   wherein the top portion (93) is formed as tube weft-knitted knitwear such that it is suitable for surrounding a part of the shank of the wearer of the sports shoe, and
   wherein the bottom portion (94) is suitable for covering at least a part of a foot of the wearer of the sports shoe.
2. Upper (91) according to example 1, wherein the top portion (93) and the bottom portion (94) are connected to one another by linking and/or by weft-knitting.
3. Upper (91) according to example 1, wherein the top portion (93) and the bottom portion (94) are connected to one another by ultrasonic welding.
4. Upper (91) according to example 3, wherein the welded seam is covered by a band of adhesive material.
5. Upper (91) according to example 1, wherein the knitwear (92) is formed as single-surface knitwear.
6. Upper (91) according to any one of the preceding examples, wherein the top portion (93) and the bottom portion (94) are adjacent to one another below the ankle of the wearer of the sports shoe.
7. Upper (91) according to any one of the preceding examples, wherein the knitwear (92) is manufactured on a flat weft-knitting machine with two beds of needles.
8. Upper (91) according to any one of the preceding examples, wherein the bottom portion (94) is formed as two-ply knitwear.
9. Upper (91) according to any one of the preceding examples, wherein the top portion (93) comprises a weft-knitted-in pocket (111) for a shin guard.
10. Upper (91) according to any one of the preceding examples, wherein the bottom portion (94) comprises at least one lace bar (103), formed integrally with the knitwear (92), with at least one lace eyelet (104).
11. Upper (91) according to example 10, wherein the lace bar (103) is formed as a layer of the knitwear (92).
12. Upper (91) according to any one of examples 10 or 11, wherein the bottom portion (94) comprises two lace bars (103) and the knitwear (92) is more elastic in an area (121) between the two lace bars (103) than in other areas.
13. Upper (91) according to any one of the preceding examples, further comprising a front portion which is not formed as knitwear.
14. Upper (91) according to example 13, wherein the front portion comprises leather or artificial leather.
15. Upper (91) according to any one of the preceding examples, wherein the top portion (93), at its upper edge, comprises an elastic cuff (96) formed integrally with the knitwear.
16. Upper (91) according to any one of the preceding examples, wherein the top portion (93) is adjusted to the anatomical conditions of a shank of a wearer of the sports shoe.
17. Upper (91) according to any one of the preceding examples, wherein the top portion (93) is tapered from an upper edge to an ankle area.

18. Upper (91) according to any one of the preceding examples, wherein the top portion (93) is elastic and exerts pressure on at least a part of the shank.
19. Upper (91) according to example 18, wherein the exerted pressure is adjusted to the sport for which the sports shoe is used.
20. Upper (91) according to one of examples 18 or 19, wherein the exerted pressure is adjusted to the respective wearer of the sports shoe.
21. Upper (91) according to one of examples 18 through 20, wherein the top portion (93) comprises an elastic yarn.
22. Sports shoe (101) comprising:
an upper (91) according to one of examples 1 through 21; and
a sole (102) which is connected to the upper (91).
23. A method of manufacturing a shoe upper (91) according to one of examples 1 through 21, comprising the following steps:
flat-knitting the knitwear (92) such that the flat weft-knitted knitwear (92) forms a top portion (93) and a bottom portion (94) of the upper (91);
forming the top portion (93) as tube weft-knitted knitwear (92) such that it is suitable for surrounding a part of the shank of the wearer of the sports shoe; and
forming the bottom portion (94) such that it is suitable for covering at least a part of a foot of the wearer of the sports shoe.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An upper for a sports shoe comprising:
a weft-knitted element comprising:
a top portion comprising multi-ply knitwear, wherein at least two plies are separated from each other and joined at edges to form a tube that surrounds a part of a shank of a wearer of the sports shoe when the sport shoe is worn; and
a bottom portion comprising multi-ply knitwear, wherein at least two plies are consistently connected to one another and substantially cover a top and sides of a foot of the wearer of the sports shoe when the sports shoe is worn;
wherein the bottom portion and the top portion are unitarily knitted together in a single knitting process.

2. The upper according to claim 1, wherein the weft-knitted element is formed from at least one yarn mechanically manipulated in a weft-knitting process.

3. The upper according to claim 1, wherein the top portion and the bottom portion are adjacent to one another below an ankle of the wearer of the sports shoe when worn.

4. The upper according to claim 1, wherein the top portion comprises a weft-knitted-in pocket for a shin guard.

5. The upper according to claim 4, wherein the weft-knitted-in pocket comprises at least one ply of the multi-ply knitwear.

6. The upper according to claim 4, wherein the weft-knitted-in pocket is integrally knitted with the weft-knitted element.

7. The upper according to claim 1, wherein at least a portion of the weft-knitted element comprises a polymer coating.

8. The upper according to claim 1, wherein the weft-knitted element is formed as a single-surface knitwear.

9. The upper according to claim 1, further comprising a front portion, wherein the weft-knitted element excludes the front portion, and wherein the front portion comprises leather or artificial leather.

10. The upper according to claim 1, wherein the top portion, at its upper edge, comprises an elastic cuff formed integrally with the weft-knitted element.

11. The upper according to claim 1, wherein the top portion is adjusted to anatomical conditions of at least the part of the shank of the wearer of the sports shoe.

12. The upper according to claim 1, wherein the top portion is tapered from an upper edge to an ankle area.

13. The upper according to claim 1, wherein the top portion is elastic, and wherein the elastic is configured to exert pressure on at least the part of the shank.

14. The upper according to claim 13, wherein a configuration of the elastic results in the pressure being specific to a sport for which the sports shoe is used or being respective to the wearer.

15. A method of manufacturing a shoe upper for a sports shoe, comprising:
flat knitting a weft-knitted element, wherein knitting the weft-knitted element comprises:
forming a top portion comprising multi-ply knitwear, wherein at least two plies are separated from each other and joined at edges to form a tube that surrounds a part of a shank of a wearer of the sports shoe when the sport shoe is worn; and
forming a bottom portion comprising multi-ply knitwear, wherein at least two plies are consistently connected to one another and substantially cover a top and sides of a foot of the wearer of the sports shoe when the sports shoe is worn;
wherein the bottom portion and the top portion are unitarily knitted together in a single knitting process.

16. The method according to claim 15, wherein the weft-knitted element comprises at least one yarn mechanically manipulated in a weft-knitted process.

17. The method according to claim 15, wherein at least a portion of the weft-knitted element comprises a polymer coating.

18. The method according to claim 15, wherein the weft-knitted element is formed as a single-surface knitwear.

19. The method according to claim 15, wherein the top portion comprises a weft-knitted-in pocket for a shin guard.

20. The method according to claim 19, wherein the weft-knitted-in pocket comprises at least one ply of the multi-ply knitwear and is integrally knitted with the weft-knitted element.

* * * * *